US011421963B2

(12) United States Patent
Inglefield et al.

(10) Patent No.: US 11,421,963 B2
(45) Date of Patent: Aug. 23, 2022

(54) LIGHTWEIGHT ENHANCED BALLISTIC ARMOR SYSTEM

(71) Applicant: American Technical Coatings, Inc., Westlake, OH (US)

(72) Inventors: Charles F. Inglefield, Rocky River, OH (US); Brian D. Barry, Westlake, OH (US); Robert W. Eilmann, North Olmsted, OH (US); William A. Gooch, Palm Harbor, FL (US)

(73) Assignee: American Technical Coatings, Inc., Westlake, OH (US)

( * ) Notice: Subject to any disclaimer, the term of this patent is extended or adjusted under 35 U.S.C. 154(b) by 85 days.

(21) Appl. No.: 14/661,860

(22) Filed: Mar. 18, 2015

(65) Prior Publication Data

US 2015/0345913 A1 Dec. 3, 2015

Related U.S. Application Data

(63) Continuation-in-part of application No. 14/006,065, filed as application No. PCT/US2012/041642 on Jun. 8, 2012, now Pat. No. 11,015,903.

(Continued)

(51) Int. Cl.
*F41H 5/04* (2006.01)
*F42B 35/00* (2006.01)

(Continued)

(52) U.S. Cl.
CPC ..... *F41H 5/0428* (2013.01); *F41H 1/00* (2013.01); *F41H 5/0421* (2013.01);

(Continued)

(58) Field of Classification Search
CPC .... F41H 5/0421; F41H 5/0464; F41H 5/0428; F41H 1/00; F41H 7/04; F42B 35/00

(Continued)

(56) References Cited

U.S. PATENT DOCUMENTS 4,061,815 A 12/1977 Poole, Jr.
4,716,810 A * 1/1988 DeGuvera ..... F41H 5/013 109/83

(Continued)

FOREIGN PATENT DOCUMENTS

CA 1335240 C 4/1995
EP 1574810 A1 9/2005

(Continued)

OTHER PUBLICATIONS

EPO Search Report issued in a related EP Application, dated May 22, 2015.

(Continued)

*Primary Examiner* — Michelle Clement
(74) *Attorney, Agent, or Firm* — Sean Mellino

(57) ABSTRACT

A lightweight ballistic armor system comprising at least one metal strike face plate, a laminate composite backing material secured to the at least one metal strike face plate and an optional air space provided between the metal strike face plate and the laminate composite backing material. The metal strike face plate or plates has a predetermined defined thickness and has a plurality of slotted holes set at an angle relative to the vertical orientation or axis of the metal strike face plate, or which are straight. The plurality of slotted holes is sufficiently small to prevent the passage of a projectile or fragment therethrough. The laminate composite backing material comprises at least one material selected from an aramid fiber material, S-glass, E-glass, polypropylene and UHMWPE, and is provided in combination with a polymer-based resin material. The optional air space provided between the metal strike face plate and the composite backing material has a depth in the range between 0-12 inches.

67 Claims, 37 Drawing Sheets

Related U.S. Application Data

(60) Provisional application No. 62/090,492, filed on Dec. 11, 2014, provisional application No. 61/954,985, filed on Mar. 18, 2014, provisional application No. 61/587,894, filed on Jan. 18, 2012, provisional application No. 61/520,320, filed on Jun. 8, 2011.

(51) Int. Cl.
*F41H 1/00* (2006.01)
*F41H 7/04* (2006.01)

(52) U.S. Cl.
CPC ..... *F41H 5/0464* (2013.01); *F41H 7/04* (2013.01); *F42B 35/00* (2013.01)

(58) Field of Classification Search
USPC ..... 89/36.02
See application file for complete search history.

(56) References Cited

U.S. PATENT DOCUMENTS 4,835,033 A * 5/1989 Auyer ..... E05G 1/024 428/131
4,836,084 A 6/1989 Vogelesang et al.
4,857,119 A * 8/1989 Karst ..... C21D 9/42 109/78
4,965,138 A * 10/1990 Gonzalez ..... B62D 25/2054 428/593
4,981,067 A * 1/1991 Kingery ..... F41H 5/007 109/36
5,007,326 A * 4/1991 Gooch, Jr. ..... F41H 5/013 109/85
5,014,593 A * 5/1991 Auyer ..... F41H 5/0457 109/84
5,200,256 A 4/1993 Dunbar
5,221,807 A * 6/1993 Vives ..... F41H 5/023 109/82
5,330,820 A 7/1994 Li et al.
5,601,895 A * 2/1997 Cunningham ..... A41D 31/0061 128/878
5,723,807 A 3/1998 Kuhn, II
5,970,843 A 10/1999 Strasser et al.
6,135,006 A 10/2000 Strasser et al.
6,314,858 B1 11/2001 Strasser et al.
6,638,572 B1 10/2003 Inglefield
6,698,331 B1 3/2004 Yu et al.
7,077,048 B1 * 7/2006 Anderson, Jr ..... F41H 5/04 2/2.5
7,098,275 B2 8/2006 Inglefield
7,191,694 B1 * 3/2007 Gonzalez ..... F41H 5/013 89/36.02
7,300,893 B2 11/2007 Barsoum et al.
7,513,186 B2 * 4/2009 Ravid ..... F41H 5/013 89/36.02
7,546,796 B2 6/2009 Hunn
7,562,612 B2 7/2009 Lucuta et al.
7,608,322 B2 10/2009 Thurau et al.
7,790,252 B2 * 9/2010 Nematollahi ..... B32B 5/28 428/34.7
7,827,898 B2 11/2010 Park et al.
7,866,248 B2 1/2011 Moore, III et al.
7,926,407 B1 * 4/2011 Hallissy ..... F41H 1/02 109/49.5
7,938,053 B1 5/2011 Dudt et al.
8,096,223 B1 * 1/2012 Andrews ..... F41H 5/0492 89/36.02
8,225,704 B2 * 7/2012 Ogrin ..... C04B 35/053 156/245
8,234,965 B2 * 8/2012 Ravid ..... F41H 5/0492 109/49.5
8,375,841 B2 * 2/2013 Bocini ..... F41H 5/023 89/36.02
8,459,167 B1 * 6/2013 Gonzalez ..... F41H 7/042 296/187.07
8,468,926 B2 * 6/2013 Treadway ..... F41H 5/023 89/36.02
8,505,432 B2 * 8/2013 Kidd ..... B32B 37/02 109/49.5
8,667,879 B2 * 3/2014 Kidd ..... B32B 37/02 109/49.5
9,038,332 B1 * 5/2015 Littlestone ..... F41H 5/0457 52/202
9,097,495 B1 * 8/2015 Kesterson ..... F41H 5/04
9,470,481 B2 * 10/2016 Livesey ..... F41H 5/023
2004/0216595 A1 * 11/2004 Dickson ..... F41H 5/0464 89/36.02
2005/0257677 A1 11/2005 Ravid et al.
2006/0030226 A1 * 2/2006 Park ..... F41H 5/0464 442/135
2006/0065111 A1 3/2006 Henry
2006/0162537 A1 * 7/2006 Anderson ..... F41H 5/04 89/36.02
2006/0213360 A1 * 9/2006 Ravid ..... F41H 5/013 89/36.01
2007/0240621 A1 10/2007 Qiao
2007/0293107 A1 * 12/2007 Folio ..... B32B 3/12 442/134
2008/0171166 A1 * 7/2008 Nematollahi ..... B32B 5/28 428/35.9
2008/0264244 A1 * 10/2008 Ravid ..... F41H 5/0428 89/36.02
2009/0095147 A1 4/2009 Tunis et al.
2009/0214812 A1 8/2009 Bartus et al.
2009/0293709 A1 12/2009 Joynt et al.
2009/0320676 A1 12/2009 Cronin et al.
2010/0212486 A1 8/2010 Kurtz et al.
2010/0282062 A1 11/2010 Sane et al.
2010/0294123 A1 11/2010 Joynt et al.
2011/0036234 A1 * 2/2011 Fisher ..... F41H 5/0414 89/36.02
2011/0167998 A1 * 7/2011 Lyons ..... B29C 33/68 89/36.02
2011/0192274 A1 * 8/2011 Fingerhut ..... F41H 5/0435 89/36.02
2011/0239851 A1 * 10/2011 Mason ..... B32B 27/04 89/36.02
2011/0296979 A1 * 12/2011 Howland ..... B32B 3/16 89/36.02
2012/0024137 A1 * 2/2012 Chiou ..... B32B 5/12 89/36.02
2012/0060676 A1 * 3/2012 Kidd ..... B32B 37/02 89/36.02
2012/0060678 A1 * 3/2012 Peters ..... B29C 70/06 89/36.02
2012/0090454 A1 * 4/2012 Treadway ..... F41H 5/023 89/36.02
2012/0174747 A1 * 7/2012 Hummel ..... F41H 5/0414 89/36.02
2012/0186433 A1 * 7/2012 Braiewa ..... B32B 5/18 89/36.02
2012/0216669 A1 * 8/2012 Bovenschen ..... F41H 5/0485 89/36.02
2012/0234164 A1 * 9/2012 Kucherov ..... F41H 5/0428 89/36.02
2012/0266744 A1 * 10/2012 Lyons ..... B29C 33/68 89/36.02
2012/0325076 A1 * 12/2012 Monette, Jr. ..... F41H 5/0464 89/36.02
2013/0061739 A1 * 3/2013 Cheong ..... F41H 5/007 89/36.02
2013/0180393 A1 * 7/2013 Kienzle ..... F41H 5/0414 89/36.02
2013/0284003 A1 * 10/2013 Dodworth ..... F41H 5/023 89/36.02
2013/0284004 A1 * 10/2013 Hanks ..... F41H 1/08 89/36.02
2013/0284007 A1 * 10/2013 de Haas ..... F41H 5/0435 89/36.02

(56) References Cited

U.S. PATENT DOCUMENTS

| | | | | |
|---|---|---|---|---|
| 2014/0000802 | A1* | 1/2014 | Kidd | B32B 37/02 156/247 |
| 2014/0013934 | A1* | 1/2014 | Inglefield | F41H 5/023 89/36.02 |
| 2014/0041517 | A1 | 2/2014 | Leeming et al. | |
| 2014/0076140 | A1* | 3/2014 | Ravid | F41H 5/0492 89/36.02 |
| 2014/0109756 | A1* | 4/2014 | Aghjanian | C04B 35/573 89/36.02 |
| 2014/0305293 | A1* | 10/2014 | Kucherov | F41H 5/0428 89/36.02 |
| 2015/0345913 | A1* | 12/2015 | Inglefield | F41H 5/0428 89/36.02 |

FOREIGN PATENT DOCUMENTS

| | | | | |
|---|---|---|---|---|
| WO | 91/00490 | A1 | 1/1991 | |
| WO | WO91/00490 | | 1/1991 | |
| WO | 2009096956 | A1 | 8/2009 | |
| WO | WO 2009/096956 | A1 | 8/2009 | |
| WO | WO 2009096956 | A1 * | 8/2009 | F41H 5/023 |
| WO | WO 2011/094740 | A2 | 8/2011 | |
| WO | 2012010829 | A1 | 1/2012 | |
| WO | WO 2012/010829 | A1 | 1/2012 | |

OTHER PUBLICATIONS

Office action issued in related EPO App. No. 12796778.4 dated Jun. 24, 2016.

International Search report and Written Opinion dated Nov. 27, 2015 issued in related PCT/US15/21303.

Office Action from the Canadian Intellectual Property Office dated Jul. 11, 2017 for corresponding CA Application No. 2,864,692.

Communication and Supplementary European Search Report from the European Patent Office dated Oct. 9, 2017 for corresponding EP Application No. 15795701.0.

Written Opinion of the International Searching Authority dated Aug. 10, 2012 for corresponding International Application No. PCT/US2012/041642.

International Search Report of the international Searching Authority dated Aug. 10, 2012 for International Application No. PCT/US2012/041642.

Examination Report No. 1 from IP Australia dated Apr. 28, 2016 for corresponding AU Application No. 2012267563.

Examination Report No. 2 from IP Australia dated Apr. 24, 2017 for corresponding AU Application No. 2012267563.

Office Action from the Canadian Intellectual Property Office dated Jan. 24, 2018 for corresponding CA Application No. 2,864,692.

William A. Gooch, Jr., An Overview of Protection Technology for Ground and Space Applications, NATO Applied Vehicle Technology Panel, Aalborg, Denmark, Sep. 23-26, 2002.

MIL-PRF-32269 (MR), Oct. 18, 2007, Performance Specification, Perforated Homogeneous Steel Armor, U.S. Dept, of Defense, AMSC NA, FSC 9515.

EPO Supplementary Partial European Search Report dated Jan. 16, 2015.

Communication pursuant to Article 94(3) from the European Patent Office dated Aug. 29, 2018 for corresponding European Patent Application No. 15795701.0.

* cited by examiner

Overall General Test Configuration

Bullet Impact Instrumentation Setup

Post–Test Condition

Test Plate Secured to Target Stand

Post–Test Witness Plate

Fragment Impact Test Instrumentation Setup

Test Plate Pre-Test Setup

All comprise:

1. Perforated strike plate
   a. Steel, titanium, iron, other
   b. Holes (straight or angular)
   c. Manufactured by cast, punch, laser, plasma or additive
2. Space (0' to 12")
3. Composite
   a. UHMWPE, Kevlar, S Glass, Other
   c. Encapsulated or not Table 5 – Fragment Reaction Table 5 – Fragment Reaction Table 6 – Fragment Reaction Table 6 – Fragment Reaction

LIGHTWEIGHT ENHANCED BALLISTIC ARMOR SYSTEM

CROSS-REFERENCE TO RELATED APPLICATIONS

This application claims the benefit of U.S. Provisional Application Nos. 61/954,985 filed on Mar. 18, 2014 and 62/090,492 filed on Dec. 11, 2014, under Title 35, United States Code, Section 119(e). This application is also a continuation-in-part of U.S. application Ser. No. 14/006,065, filed on Sep. 18, 2013, which is a U.S. national phase application of and claims the benefit of International Application No. PCT/US2012/041642 filed Jun. 8, 2012, under Title 35, United States Code, Section 371, which claims the benefit of U.S. Provisional Application No. 61/520,320, filed Jun. 8, 2011, under Title 35, United States Code, Section 119(e), and U.S. Provisional Application No. 61/587,894, filed Jan. 18, 2012, under Title 35, United States Code, Section 119(e), the entire disclosures of all the foregoing are incorporated herein by reference in their entireties.

STATEMENT OF GOVERNMENTAL SUPPORT

The framework structure for a possible use of the invention was made with government support under N00024-07-C-5361 and/or N00024-03-D-6606 awarded by the Department of the Navy. This invention was also made with government support under HQ0276-15-D-0001 awarded by the Missile Defense Agency. The government has certain rights in the framework structure for a possible use of an embodiment of the invention, but does not have rights in the embodiments of the invention per se.

FIELD OF THE INVENTION

The present invention generally relates to lightweight ballistic armor systems which can be integrally formed within, or secured to, a structure, such as a trailer, shipping containers, and the like, for protecting individuals, structures, missile canisters, vehicles and the like against low, medium and high velocity and low, medium and high caliber projectiles, as well as systems and structures, such as trailers, shipping containers, vehicles, body armor, aircraft, missile canisters and the like being integrally formed of such a lightweight ballistic armor system. More particularly, the present invention relates to an enhanced ballistic armor system which is integrally formed within a structure or vehicle, or secured directly thereto, for protection of individuals, structures, vehicles, cargo and the like against low, medium and high velocity and low, medium and high caliber projectiles. These projectiles can include low-caliber to high-caliber bullets, rockets, exploding grenades, exploding mortar shells, exploding mines and the like.

DESCRIPTION OF THE PRIOR ART

Ceramic-based armors and armor systems are well known in the art. However, many conventional armors and armor systems tend to be too heavy and/or bulky to be easily employed as a protection system against high caliber artillery and projectiles, or even lower caliber threats. Moreover, many conventional armors and armor systems can also tend to be too expensive for practical use or manufacture. Furthermore, ballistic armor and armor systems are subjected to a variety of projectiles or fragments over a wide range of velocities and calibers designed to defeat the armor or armor systems by penetrating the armor or armor systems, or by causing an impact against the armor or armor system that can cause spalling (i.e., flaking off of material from on object due to impact from another object), in particular spalling through mechanical stress which in turn eventually defeats the armor.

Many and various types of armor and armor systems are known for protecting personnel, vehicles, equipment and the like from damage or destruction caused by high caliber artillery and projectiles. Many such armor and armor systems are employed in military applications to protect individuals (such as via body armor), aircraft, tanks, ships and vehicles from damage or destruction caused by high caliber artillery and projectiles. In yet other applications, many such armor and armor systems are employed in military applications to protect missiles during their storage or transport, such as for example in the form of canisters in which the missiles are stored, held or transported.

The use of such armor and armor systems for protecting missiles maintained in protective canisters during storage or transport of the missiles is also well known. However, munitions must comply with the MIL-STD-2105 bullet impact and fragment impact requirements as defined in STANAG 4241 and STANAG 4496. Meeting these requirements by protecting the munitions with conventional ceramic armor systems is difficult due to the limited multi-hit performance of ceramic systems. In some known applications, the armor or armor systems is incorporated into the structure that is to be protected. Such applications can include military vehicles, armored vehicles or missile storage canisters. In such applications, it is typically not possible for the armor or armor systems to be temporarily applied but rather thus tend to be permanent aspects of the structure. In this regard, the armor systems can be difficult or even impossible to replace in the event of damage or failure.

In order to address the issue of weight in armor or armor systems, some conventional systems employ ceramic materials that can protect against a range of projectiles or fragments of projectiles. Ceramic tiles can often be used to break up and dissipate the energy of high caliber projectiles, and can be applied in specific thicknesses or patterns of the arrangement of tiles to maximize effectiveness. However, a disadvantage of conventional ceramic tiles is that ceramic is brittle and is more susceptible to cracking after impact, thus reducing the effectiveness against subsequent impacts. Cracking of the conventional ceramics can also leave the underlying structure to be protected vulnerable to exposure to outside elements, such as water, air, heat, cold, wind, chemicals, biological agents, etc., thereby further weakening the structure to be protected.

One known disadvantage in certain conventional armored applications is the allowable road weight that limits the numbers of encased missiles from being transported together. Due to the strict road weight limits, the excessive load created by the combined weight of the missiles, truck, etc. allows for only a few (e.g., 1-4) missiles to be transported together. For example, the Department of Transportation (DOT) has established that the total road weight of a truck, including the weight of the load, cannot exceed 80,000 pounds per vehicle. It should of course be understood that different trucks have different weights, while the specific weight of the particular load, such as missiles to be transported and the respective container or canister, can vary depending on the nature of the type of missile at issue. Typically, the combined weight of a single missile and the respective canister may be about 7,500 pounds. Nevertheless, the combined weight of the truck and the missiles being transported which comprise the respective load cannot exceed 80,000 pounds. Consequently, the missiles are oftentimes unprotected (i.e., lack a protective structure) in order to maximize the number of missiles that are transported together while also meeting the strict road weight limits or only have the standard protective canisters without additional protective means. Oftentimes, the excessive load caused by the combined weight of the missiles and storage protective canister allows for just one, or at most two, missiles to be transported together. In the event more missiles are transported, such as 3-4, the transport might be done in a manner without any additional protection in which case the missiles are vulnerable to attack. To achieve the requirement of not exceeding the 80,000 pound load limit, the protective system of the present invention in an embodiment may be provided at a weight in the range of about 18-30 lb./square foot (psf). However, it should be appreciated that the specific weight per $ft^2$ in accordance with the present invention depends on the specific nature of the application type with which the present invention is employed.

Another disadvantage with conventional armor systems in the case of armor systems employed as protection for vehicles is that the excessive weight of the armor systems can tend to render the vehicles relatively immobile, or at least significantly slower. This in turn can tend to cause the vehicles to be more vulnerable to attacks by high velocity and high caliber projectiles, and more significantly more vulnerable to attack, and even more significantly more vulnerable to repeated attacks by projectiles or fragments of projectiles.

In some known applications, the armor or armor systems is incorporated into the structure that is to be protected. Such applications can include military vehicles, armored vehicles or missile storage canisters. In such applications, it is typically not possible for the armor or armor systems to be temporarily applied but rather are aspects of the structure. In this regard, the armor systems could be difficult to replace in the event of damage or failure.

Projectiles, such as armor piercing ammunition, are designed to specifically penetrate conventional armor and armor systems. Conventional ceramic-faced armor systems were consequently developed to defeat armor piercing ammunition. For example, at impact, the projectile can be blunted or otherwise damaged by the conventional ceramic-faced armor system. At the same time, cracking or other damage to the conventional ceramic-faced armor system is inevitable which leads to a weakening of the integrity of the conventional ceramic-faced armor system and thus more vulnerable to future attacks.

Some specific examples of conventional prior art armor and armor systems are now set forth below.

U.S. Publication No. 2009/0320676 (Cronin, et al.) is directed to the use of an armor for protection against projectiles having a ceramic layer with a confinement layer on the front thereof. The ceramic layer is backed by a first metallic layer and the first metallic layer in turn is backed by a composite layer. The composite layer is backed by a second metallic layer, which in turn is backed by an anti-trauma layer.

WO 91/00490 (Prevorsek, et al.) discusses a composite ballistic article comprising at least one hard rigid layer, at least one fibrous layer and a void layer between the rigid layer and the at least one fibrous layer. The relative weight percents of the hard rigid layer and the fibrous layer(s), and the relative positions of the layers are such that the article is said to exhibit a mass efficiency equal to or greater than about 2.5.

U.S. Pat. No. 4,061,815 (Poole, Jr.) discusses a laminated sheet material having high impact resistance for use in with armor plates. One or more layers of cellular or non-cellular polyurethane is sandwiched between a rigid, high impact resistant sheet of material, such as aluminum armor plate and fiberglass, in the one face and a thin retaining skin on the other. A filler, such as ceramic, particulate refractory or strip metal, can be embedded in the polyurethane layer(s).

U.S. Publication No. 2010/0212486 (Kurtz, et al.) discusses a strike plate including a base armor plate having an outwardly facing surface and a hard layer deposited on the base armor plate to substantially overlay the outwardly facing surface. A ballistic attenuation assembly is allegedly provided having multiple sheets of a first fibrous material and a sheet of a second fibrous material laminated together by a modified epoxy resin with the first sheet of a second fibrous material being exposed along an outward facing surface. An alternative ballistic attenuation assembly is also discussed having a first panel having opposed inward and outward facing surfaces, a second panel having opposed inward and outward facing surfaces, and a spacer interposed between the first and second panels forming a gap between the inward facing surfaces of the first and second panels.

U.S. Pat. No. 5,200,256 (Dunbar) discusses an armor lining for protecting objects from high velocity projectiles having an extended sheet-like body having a weight of less than eight pounds per square foot and having an inner strike surface being positioned away from the object to be protected. A first layer of woven fabric material is carried at a position adjacent the outer strike surface layer and a second layer of material is carried internally of the woven layer between the outer strike surface and an inner attachment surface. A third layer of energy absorbent material is positioned adjacent the inner attachment surface and interfaces with the second fabric layer.

U.S. Publication No. 2009/0293709 (Joynt, et al.) discusses an armor system for protecting a vehicle from high energy projectiles having a leading layer, relative to the projectile trajectory, positioned exterior to the hull, a first plurality of sheet-like layers of a low density material positioned between the leading layer and the hull; and a second plurality of sheet-like high strength metal layers positioned between the leading layer and the hull. The individual ones of the first plurality of high strength metal layers are positioned alternating with and to the rear of individual ones of the second plurality of low density material layers. The leading layer can be one of a sheet-like metallic layer, a metalicized grid layer, and the outer-most layer of the first plurality of low materials layers. The materials of the high strength metal layers can be steel and high strength aluminum, and the materials of the low density material may be low density polypropylene composites and R-Glass composites.

U.S. Publication No. 2010/0294123 (Joynt, et al.) discusses a modular armor system having a leading layer with a metal and an intermediate sheet-like layer of a low density material lesser than that of metal, abutting a rear surface of the leading layer. The armor system also has an intermediate sheet-like layer having glass fiber material and abutting a rear surface of the intermediate low density material layer, and an intermediate sheet-like layer having metal and abutting a rear surface of the intermediate glass fiber layer.

U.S. Pat. No. 4,836,084 (Vogelesang, et al.) discusses an armor plate composite having four main components, namely, a ceramic impact layer, a sub-layer laminate, a supporting element and a backing layer. The ceramic layer serves for allegedly blunting the tip of a projectile. The sub-layer laminate of metal sheets alternate with fabrics impregnated with a viscoelastic synthetic material for absorbing the kinetic energy of the projectile by plastic deformation. The backing layer away from the side of impact consists of a pack of impregnated fabrics.

U.S. Publication No. 2006/0065111 (Henry) discusses an armor system having an outer case of woven or unidirectional fibers filled with one or more protective materials. The outer case includes a pressure sensitive adhesive bonded to one side for allegedly quick and easy application to a body to be protected. The protective materials may include ceramic material which may be in the form of ceramic tile sheets, loose ceramic balls or perforated tiles, multiple layers of woven or unidirectional cloth and steel mesh.

With reference to FIG. 1, an example of a conventional prior art protective system for transporting missiles is shown and referenced generally at numeral 1. As shown in FIG. 1, the conventional prior art system includes a flatbed trailer 10 having a standard dimension of about 53'×102" and a set of missiles (not shown) inside a corresponding protective canister 12. Protective canister 12 may comprise any missile protective material known in the art, such as steel. A frame 14 is provided for securing each canister 12 to the flatbed trailer 10. Frame 14 may comprise any material conventional in the art, such as wood or steel. As depicted in FIG. 1, the conventional prior art system for the transport of missiles inside protective canisters 12 lacks any additional type of protective structure since an additional protective structure that would provide sufficient protection to the canisters 12 would be too heavy to comply with STANG 4241 and STANAG 4496 requirements and thus would cause the weight of the entire load to exceed 80,000 pounds. Therefore, an additional protective structure cannot be employed and the missiles must be transported in a vulnerable manner as shown in FIG. 1.

There is a need for an improved armor system for protecting individuals, structures, missile canisters, vehicles and the like against low, medium and high velocity and low, medium and high caliber projectiles, as well as a need for manufacturing a missile transport canister that can defeat a range of projectiles and fragments over a wide velocity range from anti-armor devices while reducing overall armor thickness, and which is capable of defeating multiple close proximity strikes from these projectiles. Moreover, there is a need for such an armor system that is relatively inexpensive to manufacture, relatively easy to manufacture and relatively easy to employ in a variety of applications, including but not limited to body armor, vehicle armor and missile canister protective armor.

Also known in the art are body armor, armored trucks, vehicles, armored trailers for semi-trailer trucks and the like. Typical armored vehicles and body armor known in the art can be disadvantageous in that they fail to meet the requirements for protecting against, even low-caliber ammunition and/or are too heavy for normal use on streets in a city environment. On the other hand, armored vehicles known in the art that may sufficiently protect against even low-caliber threats tend to be too heavy or cumbersome for use on roads and highways and can be too expensive to manufacture. Therefore, there is a need for an armored vehicle in which a lightweight ballistic armor system is integrally built into the armored trailer, which is relatively inexpensive and easy to manufacture and can be employed in a wide range of applications for a wide range of purposes, including protecting cargo such as missiles, munitions, explosives and high value cargo, as well as for use with body armor, or vehicles such as police cars.

SUMMARY OF THE INVENTION

In accordance with an embodiment of the present invention, the present invention is a lightweight armor system comprising a laminate composite material backing alone or in combination with at least one perforated metal or expanded metal strike face plate (also known as a tipping plate or an appliqué armor). The metal strike face plate or plates may be, for example, steel or steel alloys, cast irons, aluminum, magnesium, titanium, and the like, or any combination thereof. A thin composite skin or metal skin may cover the front face of the strike plate for protection from outside elements. An example of a perforated metal strike face plate is that found in U.S. Pat. No. 5,007,326 (Gooch, et al.), the details of which are incorporated herein by reference.

The laminate composite backing may comprise a cross-sectional composition of a backing material of fibers, such as KEVLAR® fibers, E-glass, S-Glass, polypropylene, Ultrahigh Molecular Weight Polyethylene (UHMWPE), including fibrous UHMWPE such as a pressed Spectra Shield II® SR-3130 ballistic composite material from Honeywell Advanced Fibers and Composites, Colonial Heights, Va., with polymer resin binders such as, but not limited to, silicones, epoxies, polyethylenes, polyurethanes, and polyureas, such as those disclosed in U.S. Pat. Nos. 6,638,572 and 7,098,275 (both to Inglefield), the details of which are incorporated herein by reference. The laminate composite backing may optionally be enclosed or encased within a surrounding support layer of a silicone, epoxy, polyurethane, and/or polyurea, such as those disclosed in U.S. Pat. Nos. 6,638,572 and 7,098,275 (both to Inglefield) to encase the cross-sectional composition during application.

In an alternative embodiment of the present invention, an optional environmentally insensitive protective layer, wrapping, or encasement may be employed such as comprising an appropriate polymer or metal material, as discussed further below. It should be understood that the environmentally insensitive protective layer may also advantageously provide an additional layer for improving the ballistic characteristics of the present invention. Still further, a single-layered or multi-layered perforated metal sheet may be employed in accordance with the present invention, or even alone without an associated composite layer, for use with, for example, low or medium level insensitive munitions applications including on a missile canister.

An air space may be present between the strike face plate or plates, when employed, and the laminate composite backing. The air space may be provided in the range from about 0 to at least 12 inches depending on the specific type of application with which the present invention armor system is employed, in particular in the range from about 0-8 inches, and more particularly in the range from about 0.25 to 4 inches or even 0.5-3 inches. The air space in accordance with the present invention may be optionally filled with an energy absorbing foam material or other comparable energy absorbing material, such as but not limited to a low density foam, and in particular, but not limited to, a polyurethane-based foam or a polypropylene-based foam. It should be appreciated that air space having zero inches in depth would be having essentially no air space employed in accordance with the present invention.

The armor system according to an embodiment the present invention is designed to defeat lead, copper, steel or high density cored projectiles of tungsten carbide or tungsten alloy by fracture, erosion and enhanced rotation via the strike face plate. In accordance with the armor system of an embodiment of the present invention, the remaining energy and projectile fragments are then absorbed in the laminate composite backing.

The lightweight armor system according to an embodiment of the present invention is designed to defeat, or at least slow down, small arms to heavy machine gun threats and/or low, medium and high caliber projectiles, (5.45 mm to 14.5 mm) including, but not limited to 0.30-Cal APM2, 0.50-Cal APM2, or 5.56X45 M193, 5.45X45 M855/M855A1, and/or meet the requirements defined in VPAM 2009 (German Association of Test Laboratories for Bullet Resistant Materials and Constructions)—Edition: 2009-05-14; Ballistic Resistance of Body Armor NU Standard-0101.06; Department of State SD-STD-01.01, Forced Entry And Ballistic Resistance of Structural Systems, Revision G, Apr. 30, 1993; Underwriters laboratories UL752, Standard UL Protection Levels; STANAG AEP Edition 1 1955, STANAG 4569, STANAG 4241, STANAG 4496, STANAG 4439, or MIL-STD-2105 (the details and specifics of which are incorporated herein by reference), as well as steel or high density cored projectiles, fragments or Fragment Simulating Projectiles of steel, tungsten carbide or tungsten alloy by fracture, erosion and enhanced rotation via the strike face plate when employed. In accordance with the armor system of the present invention, the remaining energy and projectile fragments are then absorbed in the laminate composite backing.

The lightweight system can also advantageously be employed to disrupt, deflect and dissipate the energy of a small arms impact. In the case of munitions protection, the allowed munitions response to STANAG 4241 bullet impact or STANAG 4496 fragment impacts as defined in STANAG 4439 may not require a defeat of the threat but only a reduction of the threat. This lightweight system of an embodiment of the present invention is provided at a weight of about 4.0 psf to 15.0 psf, and is designed to disrupt STANAG 4241 and STANAG 4496 impacts enabling the munitions to meet minimum requirements as defined in STANAG 4439.

The lightweight armor system according to the present invention can be used for various applications such as tanks, trucks, vehicles, individual protective systems (i.e., body armor), aircraft, helicopters, barriers, protective structures and missile storage containers or canisters.

It is an object of the present invention to provide an improved armor system or lightweight armor system for protection against high velocity projectiles, including steel or high density cored projectiles of tungsten carbide or tungsten alloy.

It is another object of the present invention to provide an improved armor system that is relatively lightweight relative to conventional lightweight armor systems.

It is yet another object of the present invention to provide an improved armor system or an improved lightweight armor system having reduced or comparable production costs relative to conventional lightweight armor systems.

It is an object of the present invention to provide a lightweight armor or armor system and a method of construction thereof, that is lightweight and relatively thin relative to conventional lightweight armor systems, yet provides protection against projectiles and fragments.

It is a further object of the present invention to provide an improved armor/armor system, or a lightweight armor or armor system and a method of construction thereof where the lightweight armor can be used as protective armor for individuals, vehicles or missile transport canisters, and the like, with reduced deformation and destruction when impacted by projectiles and fragments.

Yet another object of the present invention is to provide a lightweight armor system that meets all relevant and required military standards and requirements for weight and size for the specific type of application with which the system of the present invention is employed, and for defeating the necessary projectiles and fragments.

Yet another object of the present invention is to provide an armor system that meets all relevant and required military standards and requirements for weight and size for the specific type of application with which the system of the present invention is employed, and for defeating projectiles and fragments.

Still yet another object of the present invention is to provide an armor system that provides an improved multi-hit capacity.

An object of an embodiment of the present invention is to provide an armored structure or vehicle, such as an armored trailer, an armored shipping container or an armored canister, and the like having a ballistic armor system integrally built within the walls, roof/ceiling and/or floor of the structure, trailer, shipping container or canister, or secure directly thereto.

Another object of an embodiment of the present invention is to provide an armored structure or vehicle, such as an armored trailer or armored shipping container, and the like that employs conventional end loading/unloading of cargo or alternative methods for loading/unloading of cargo.

Yet another object of an embodiment of the present invention is to provide an armored structure, such as an armored trailer or armored shipping container, and the like that sufficiently protects cargo held and carried therein from a range of ballistics, including from small arms to heavy machine gun threats, and larger scale threats, including improvised explosive devices (IEDs).

Still yet another object of the present invention is to provide a lightweight armor system for incorporating directly into the body of body armor or canisters, as well as vehicles, including police vehicles, aircraft, and military vehicles and having improved multi-hit capability, increased durability, lower cost and increased structural properties, or secure directly thereto.

Still yet another object of an embodiment of the present invention is to provide a lightweight armor system for protecting the body of an individual having improved multi-hit capability, increased durability and increased structural properties.

An additional object of the present invention is to provide an armor system or a lightweight armor system that, regardless of the specific application with which it is employed, meets the necessary requirements of any potential natural environment, including extreme temperatures such as between −46° C. to +71° C., various levels of humidity, thermal shock, contaminating fluids, radiation including solar radiation, rain, fungus, and salt fog.

An additional object of the present invention is to provide an armor system or a lightweight armor system that, regardless of the specific application with which it is employed, meets the necessary requirements of any potential induced environment, including shock, functional shock, handling drop shock, transient drop shock, truck and trailer vibrations, aircraft, jet, helicopter and other vehicle cargo vibrations.

It is to be understood that both the foregoing general description and the following detailed description are exemplary and explanatory only and are intended to provide a further explanation of the present invention, as claimed.

Other objects of the present invention will become apparent from the description to follow and from the appended claims.

DETAILED DESCRIPTION OF THE PREFERRED EMBODIMENTS

Figure 1:
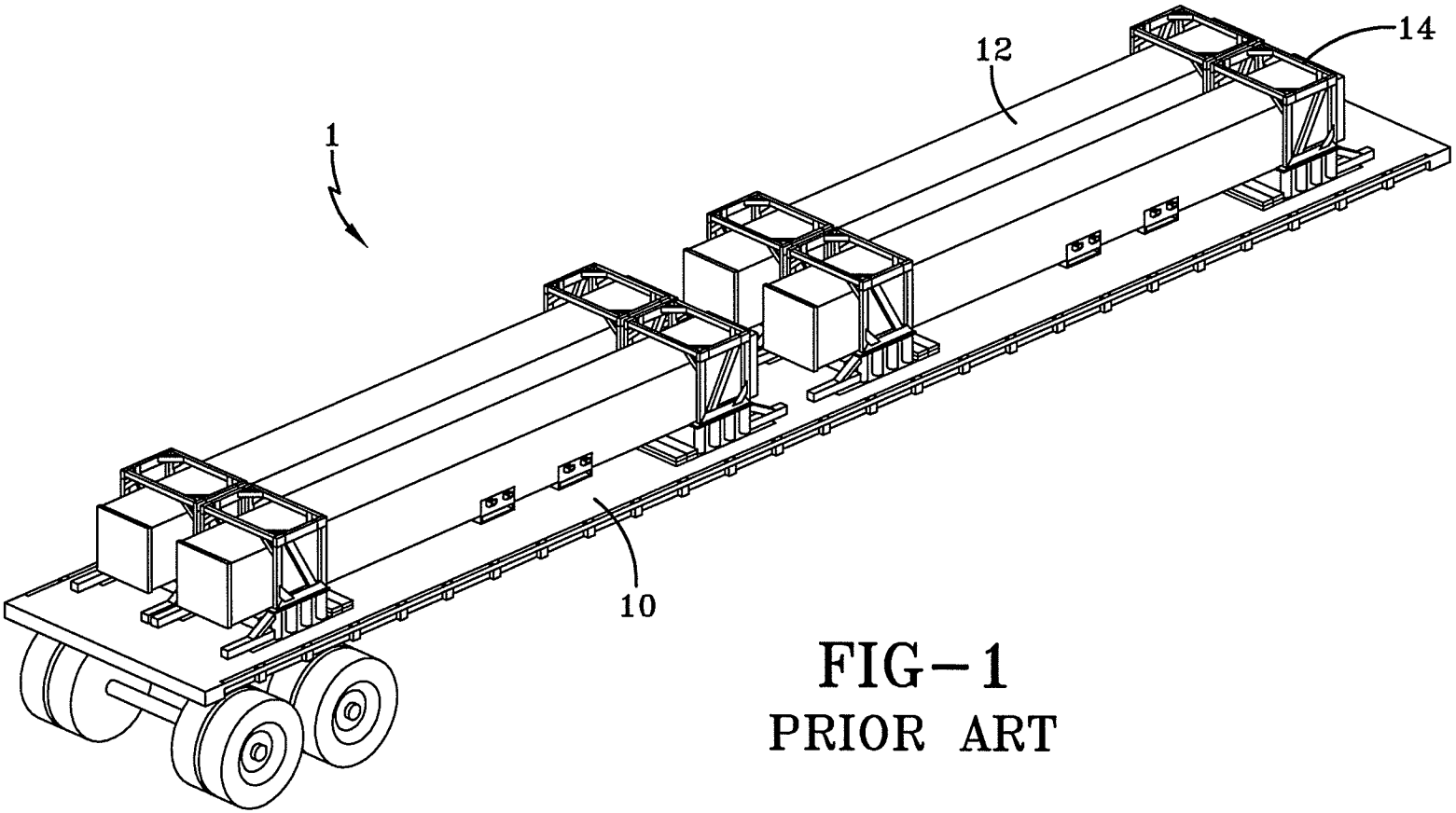
FIG-1 PRIOR ART
FIG. 1 is a perspective view of a prior art missile container transport system.

The present invention is now described with reference to the drawings, wherein like reference numerals are used to refer to like elements throughout. In the following description, for purposes of explanation, numerous specific details are set forth in order to provide a thorough understanding of the present invention. It will be evident, however, to one skilled in the art that the present invention may be practiced without these specific details.

Turning now to FIGS. 2, 3, 3A and 3B, the armor system according to a first embodiment (FIG. 2) and a second or alternative embodiment (FIG. 3) of the present invention is shown generally at numerals 100 and 200, respectively. It should be understood that the armor system as described herein may be employed for use in an armor trailer system, such as that described in co-pending application Ser. No. 14/006,065, the entirety of which is incorporated herein by reference, or alternatively for use as body armor, missile canisters or with a vehicle including for use with the body of a vehicle or portions thereof, as described below. Armor systems 100 and 200 both comprise a perforated metal or expanded metal strike face plate 110, 210 and a laminate composite backing 120, 220. It should be appreciated that multiple layers of both strike face plate and/or laminate composite backing may be employed in accordance with the present invention. However, for purposes of explanation a single layer of both strike face plate and laminate composite backing is shown and described herein. It should also be appreciated that any type, configuration, design or style of strike face plate (i.e., tipping plate) may be employed with the present invention as known in the art. However, for purposes of explanation, particular versions of the strike face plate (i.e., tipping plate) are shown and described herein. The term "strike face plate" refers to a high strength metal that has a front face surface that would receive the initial impact of a projectile or shock waves or material from a blast. The back surface of the strike face plate can be adjacent to the front surface of the laminate composite backing in one embodiment of the present invention. In other words, the perforated metal or expanded metal strike face plate provides a ballistic strike face which is the first layer of the ballistic armor or armor system that is struck by a projectile or fragment. The perforated metal or expanded metal plate 110, 210 fractures and/or rotates the projectile or fragment. In accordance with the present invention, strike face plate 110, 210 is provided at a thickness in the range of about 0.10-1.5 inches, or even 0.25 inch-1.5 inches. More particularly, in accordance with the present invention, strike face plate 110, 210 is provided at a thickness in the range of about 0.15 inch to 0.50 inch, or even ½ inch-⅝ inch. It should be appreciated that the particular thickness of strike face plate or plates 110, 210 depends on the specific application with which the present invention is employed as discussed below.

Perforated metal or expanded metal strike face plate 110, 210 may be a material that is for example, but not limited to, steel or steel alloys, hardened steel, cast irons, aluminum, magnesium, titanium and the like, or a combination thereof. In an embodiment, strike face plate 110, 210 may comprise a cast iron material such as a cast steel material, i.e., ductile cast iron. As noted above, an example of a perforated metal strike face plate is that found in U.S. Pat. No. 5,007,326 (Gooch, et al.), and which is incorporated herein by reference in its entirety. It should be appreciated, however, that strike face plate 110, 210 can be any buffer plate of a high strength material that receives impact or impact-induced stress waves prior to a shock-absorbing element. In this regard, strike face plate 110, 210 can alternatively be a flat sheet of a high strength metal, or polymer-based composite such as a fiber-reinforced polymer composite. It should be appreciated that any wrought iron plate or casting in accordance with MIL-PRF-32269 would be in accordance with the present invention. In particular, it should be appreciated that MIL-PRF-32269 provides that 4130 steel alloy and 4330 steel alloy are acceptable alloys for cast perforated plate (Class 2 armor), that MIL-A-12560 rolled homogenous steel (Class 1a armor) and MIL-A-46100 high hard rolled homogenous steel armor (Class 1b armor) is acceptable for imparting a hole pattern into to make perforated plate. These are examples of perforated material types which are qualified to date and are by no means comprehensive. It should be appreciated by the skilled artisan that other candidate alloys for making cast perforated plates (or alternatives, e.g., expanded metal) may exist.

Figure 3:
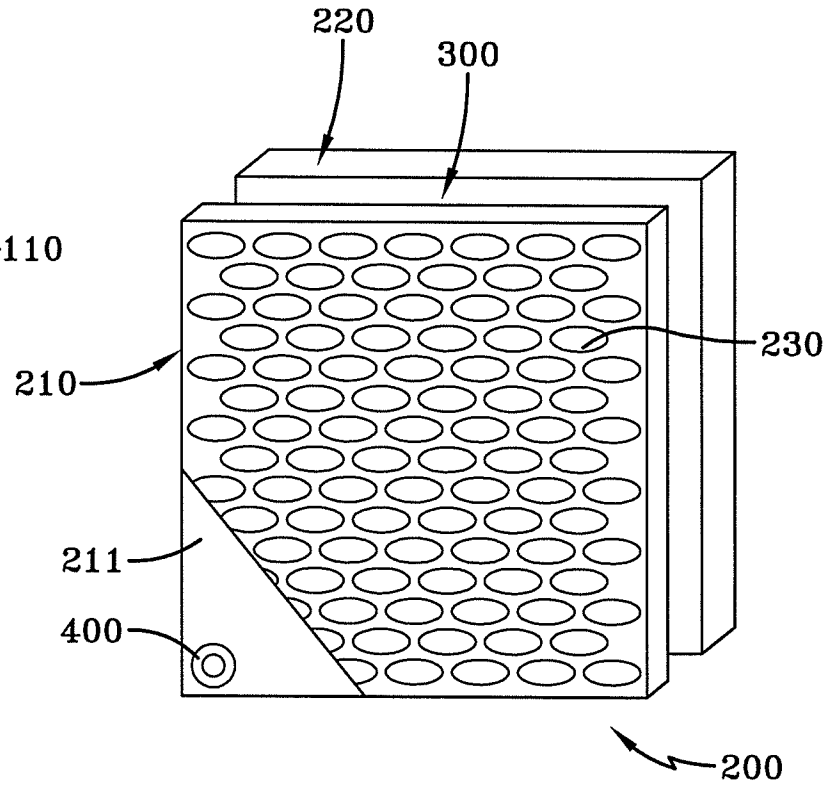
FIG. 3 is a perspective view of a second embodiment of the armor system according to the present invention.
Figure 2:
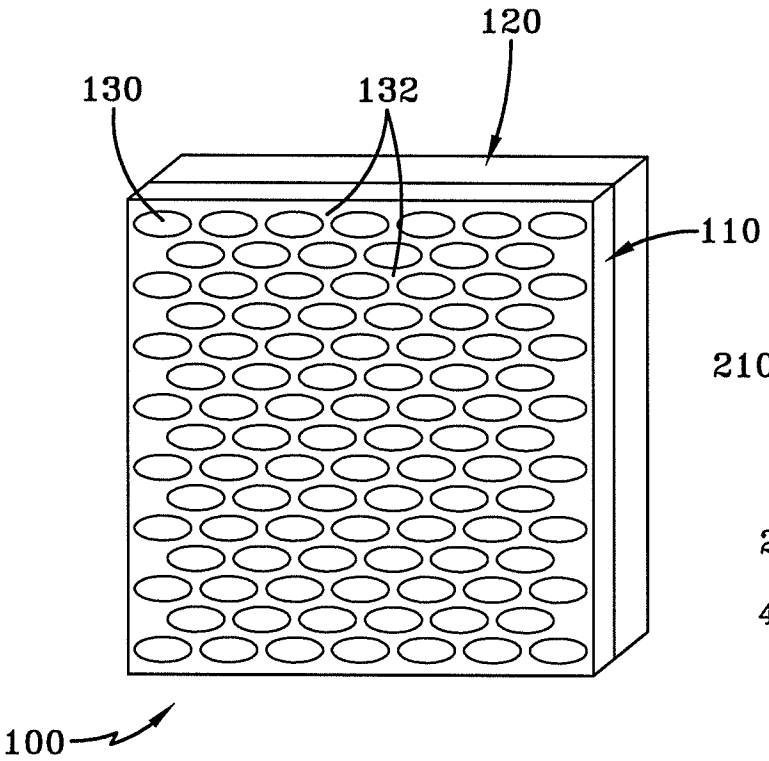
FIG. 2 is a perspective view of a first embodiment of the armor system according to the present invention.
Figure 5:
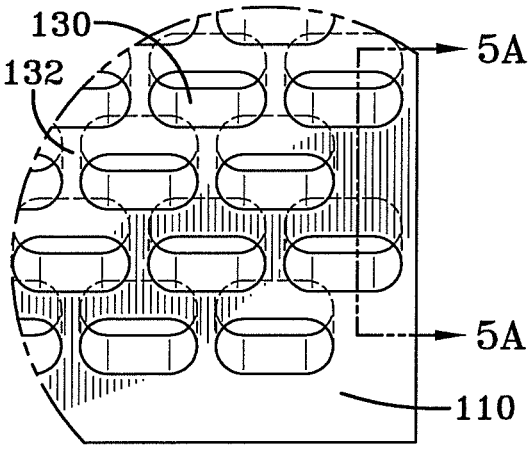
FIG. 5 is an exploded schematic view of a portion of the perforated metal or expanded metal strike face plate in accordance with an embodiment of the present invention as shown in FIG. 4.

In an alternative embodiment of the present invention, a composite layer or metal skin layer 211 may optionally cover the perforated metal or expanded metal strike face plate 210 as shown in FIGS. 3 and 5. Composite layer or metal skin layer 211 is depicted only in the embodiment of FIG. 3 (i.e., armor system 200), but it should be appreciated that composite layer or metal skin layer 211 may be employed with the embodiment of the present invention as shown in FIG. 2 as well (i.e., armor system 100) or any other embodiment of the present invention as discussed below. It should also be appreciated that composite layer or metal skin layer 211 covers the entire front surface of strike face plate 210, but only a cut-away portion of composite layer or metal skin layer 211 is depicted in FIG. 3 for illustrative purposes only. The optional, thin metal skin layer provides reinforcement protection against any projectile effect and aids in the breakup of a projectile striking armor systems 100 or 200. The optional, thin metal skin layer also facilitates cleaning and painting of perforated metal or expanded metal strike face plate 210.

In accordance with the present invention, composite layer or metal skin layer 211 may be a material that is the same as or different from the material of strike face plate 210. As understood from FIG. 3, composite layer or metal skin layer 211 comprises a thickness that is relatively thin and is thinner than the thickness of strike face plate 210. In particular, composite layer or metal skin layer 211 can comprise a thickness in the range of from about 1/32 inch to ¼ inch, or even ⅛ inch-¼ inch.

As shown in FIGS. 2-5, strike face plate 110, 210 comprises a plurality of slotted holes 130 (230 in FIG. 3) which are set at an oblique angle relative to the vertical orientation of perforated metal or expanded metal strike face plate 110, 210. Plurality of holes 130, 230 of perforated metal or expanded metal strike face plate 110, 210 is preferably produced by a casting method, a punching method, or by an additive manufacturing method which should be understood by those skilled in the art. Alternatively, plurality of holes 130, 230 can be produced in perforated metal or expanded metal strike face plate 110, 210 via a water jet, laser, or plasma cutting method.

Figure 4:
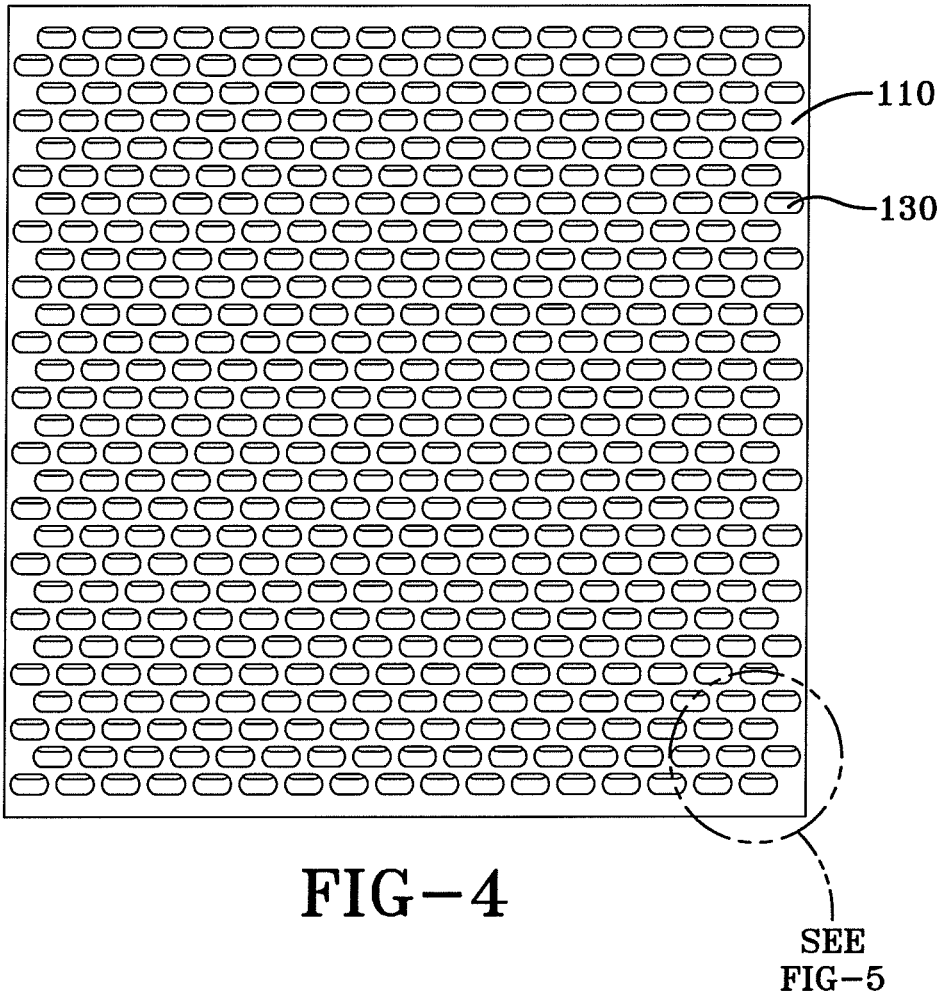
FIG. 4 is a front view of a perforated metal or expanded metal strike face plate in accordance with an embodiment of the present invention.
Figure 6:
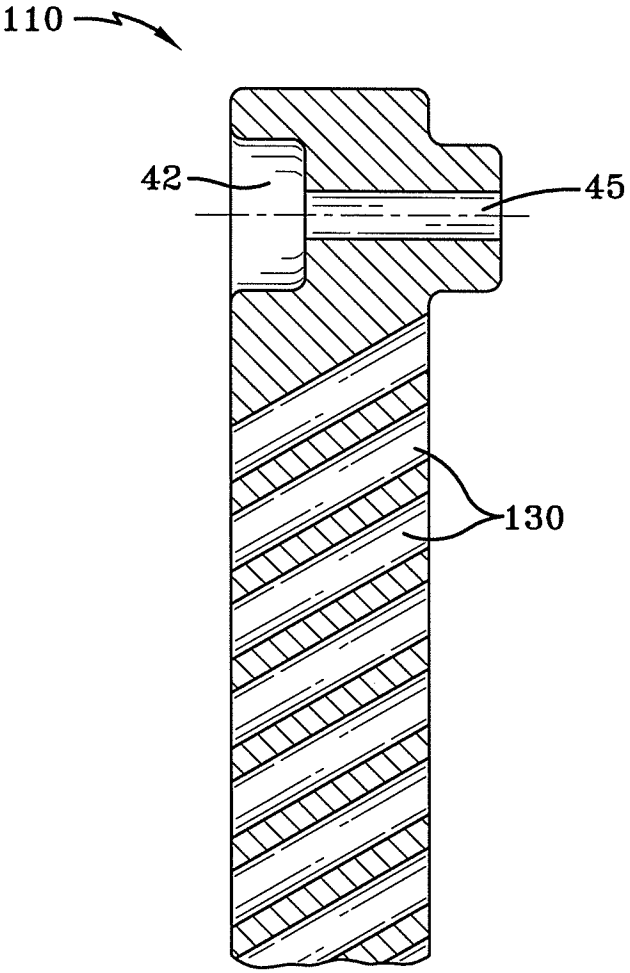
FIG. 6 is a cutaway cross-sectional view of the strike face plate according to one embodiment of the present invention.
Figure 8:
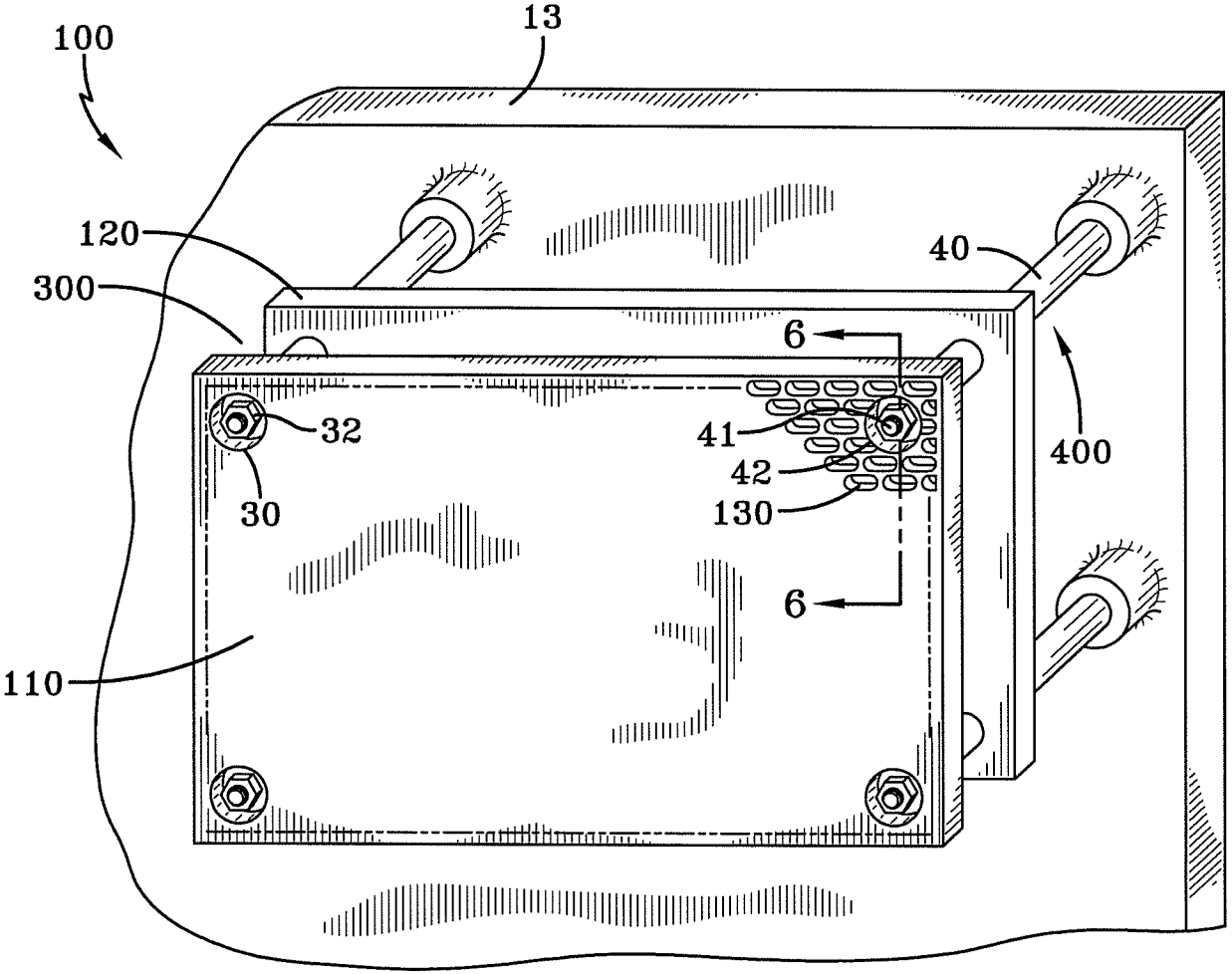
FIG. 8 is a perspective view of the strike face plate according to one embodiment of the present invention.

As shown in FIG. 6, a cutaway cross-sectional view of perforated metal or expanded metal strike face plate 110 is provided along line a-a' of FIG. 8. As depicted in FIG. 6, perforated metal or expanded metal strike face plate 110 comprises a plurality of oblique-angled holes or slots. Still referring to FIGS. 2 and 3, strike face plate 110, 210 comprises a plurality of holes or perforations 130, 230. As shown in FIG. 4, plurality of holes 130 is uniformly distributed along the entire front face of strike face plate 110. Holes 130, 230 may comprise any configuration conventional in the art, such as but not limited to circular, rectangular, oblong, rectangular or of any polygon shape (or different shapes), or any combination thereof, and can be created in the solid plate by any mechanism conventional in the art, such as punching, casting, water jet, laser or plasma cutting. Plurality of holes 130, 230 may be perpendicular to or provided at any angle relative to the front surface of strike face plate 110, 210 and may be oriented upwardly or downwardly, or by any other orientation conventional in the art. Plurality of holes 130, 230 may be arranged in a repetitive manner in two planes that form webs 132 (FIG. 5) whose width and thicknesses can be varied as necessary, but are uniformly distributed throughout. Perforated metal or expanded metal strike face 110, 210 and laminate composite backing 120, 220 may be flat, bent or formed into compound angles. It should also be understood that the plurality of holes or slots are not limited to being oblique, but may alternatively be straight (i.e., non-oblique) in accordance with the present invention. For example, multiple layers of perforated metal may alternatively be employed in accordance with the present invention in a desired embodiment, wherein the plurality of slots or holes are straight (i.e., non-oblique). In this instance, the multiple layers of perforated metal and/or the configuration of the respective plurality of holes or slots may be advantageously offset. For example, multiple layers of perforated metal plates could be simultaneously employed with each having an individual thickness of about in the range of ¼ inch-⅜ inch such that the overall thickness of the multiple layers of perforated metal plates would be consistent with the desired constant overall thickness if a single perforated metal plate had been employed.

Figure 5A:
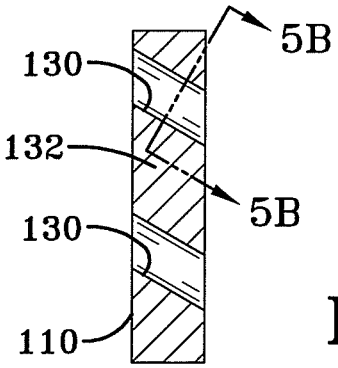
FIG. 5A is a cross-sectional view of a portion of the perforated metal or expanded metal strike face plate in accordance with an embodiment of the present invention taken in the direction 5A-5A in FIG. 5.
Figure 5B:
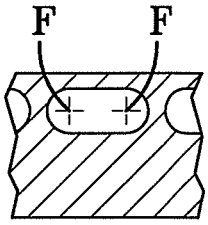
FIG. 5B is a schematic view of a portion of the perforated metal or expanded metal strike face plate in accordance with an embodiment of the present invention taken in the direction B-B in FIG. 5.

The sizes of the openings of the slots which may be advantageously used in embodiments of the present invention range from about 0.15 inch to about 2 inches in length, or even about 0.50 inch to about 2.0 inches in length for an embodiment (i.e., the vertical orientation of the openings of the slots), by about 0.15 inches to about 2 inches, or even about 0.25 inch to about 1.0 inch in width for an embodiment in width (i.e., the horizontal orientation of the openings of the slots). The web 132, defined as the solid material between the plurality of slots or holes 130, 230 can vary in thickness from about 0.10 inches to 1 inch (i.e., the spacing between adjacent slots or holes). It should be understood that the spacing between each hole or slot of the plurality of holes or slots may advantageously be consistent there-between, but need not be consistent there-between. The number of slots, for example, per square foot, may be within the range of about 15 to 680 slots/square foot. This number, however, may be left for the skilled artisan to determine depending on the nature of the particular application with which the present invention is employed. Slots or holes 130, 230 are preferably arranged in a uniformed fashion and are equally spaced apart from each other. Moreover, the slots of the present invention are set in obliquity of up to about 60 degrees, such as from 0 degrees to 50 degrees measured from a vertical orientation or axis. For example, plurality of holes that are designed for use with protecting against 30 caliber bullets would be approximately half the size of the plurality of holes that are designed for use with protecting against 50 caliber bullets. In a particular embodiment in accordance with the present invention in which holes comprise a substantially oval-shaped configuration defined by two opposing arced ends, the distance between the respective focal points (shown by opposing "F's") of the opposing arced ends is about ½ inch and the angle of each opposing arced end is about 0.17-0.19°, in particular about 0.1875° (FIGS. 5A, 5B) with each hole angled at about 20°-30° relative to the vertical orientation of the present invention, and more particularly at about 25° relative to the vertical orientation of the present invention. It should also be appreciated that the number, size, arrangement, angle, and the like of the holes employed in accordance with the present invention may depend on the use of perforated metal or expanded metal for the strike face plate, and which may be left for the skilled artisan to determine depending on the nature of the particular application with which the present invention is employed.

Example

The armor of an embodiment of the present invention may be produced and represented by the following: Styrofoam master sheets having a thickness of about 0.50 inches and dimensions of about 14 inches by about 30 inches are used. The styrofoam sheets have slots in a regular pattern produced from a die and the slots have the dimensions of 0.625 inches by 1.625 inches on 0.625 inch vertical centers and 1.625 inch horizontal centers. These slots are set at an obliquity of 30 degrees relative to a vertical orientation or axis. The web, defined as the solid material between the slots, is about 0.150 inches in thickness.

As shown in FIGS. 2 and 3, plurality of holes 130, 230 are provided in a pattern referred to as the "historic" pattern. It should be appreciated that any pattern of plurality of holes 130, 230 conventional in the art may be employed in accordance with the present invention. For example, in a particular embodiment of the present invention, plurality of holes 130, 230 can be provided in a non-homogenous cross-sectional pattern.

Figure 7:
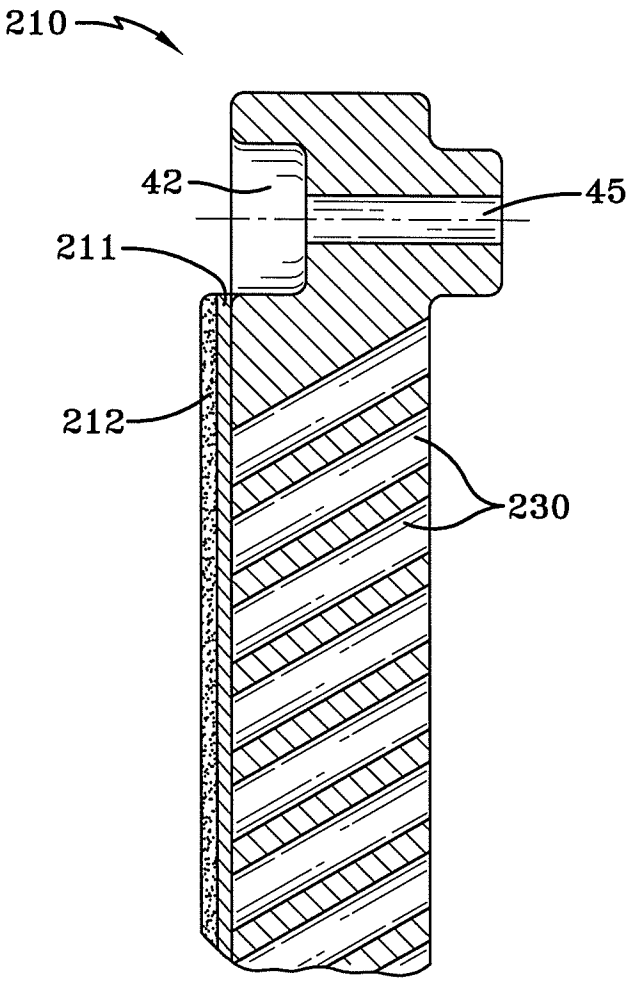
FIG. 7 is a cutaway cross-sectional view of the strike face plate according to an alternative embodiment of the present invention.

With specific reference to FIG. 7, an alternative embodiment of the perforated metal or expanded metal strike face plate 210 of the present invention having thin metal skin 211 over the facing of perforated metal or expanded metal strike face plate 210 is provided. Plurality of holes 230 is shown having an oblique-angled configuration relative to a vertical orientation or axis. In particular, plurality of holes 230 may comprise an oblique-angle configuration of about between 20°-60° relative to the vertical orientation of the strike face plate 210. More particularly, plurality of holes 230 may comprise an oblique-angle configuration of about 25° relative to the vertical orientation of the strike face plate 210. Of course, plurality of holes 230 may even be straight. Onto composite layer or metal skin layer 211, a further optional hard surface material 212 can be placed. The additional hard faced material 212 may be composed of carbon cloth, tungsten carbide particles, FeCr coating, FeCr—/Mo/V surfacing, 1642 CrC surfacing or Ceramo $Cr_7Cr_3$ surfacing and can be employed to provide an additional protective layer. The hard faced material may be sintered to the thin composite layer or metal skin layer 211 during the casting process and aids in the breakup of a high caliber projectile.

With reference to FIGS. 2 and 3, armor system 100, 200 further comprises laminate composite backing 120 (220 in FIG. 3). Laminate composite backing 120, 220 can comprise a cross-sectional composition of fibers such as, but not limited to, at least one of a synthetic aramid fibers or para-aramid fibers known as KEVLAR® fibers, E-glass, S-Glass, polypropylene, Ultrahigh Molecular Weight Polyethylene (UHMWPE), including fibrous UHMWPE such as a pressed SPECTRA SHIELD II® SR-3130 ballistic composite material from Honeywell Advanced Fibers and Composites, Colonial Heights, Va., and integrally combined with polymer resin-based binders such as, but not limited to, at least one of silicones, epoxies, urethanes, polyethylenes, polyurethanes, and polyureas, such as those disclosed in U.S. Pat. Nos. 6,638,572 and 7,098,275 (both to Inglefield and commented on earlier), incorporated herein by reference in their entireties. In accordance with the present invention, polymer resin-based binders such as, but not limited to, at least one of silicones, epoxies, urethanes, polyethylenes, polyurethanes, and polyureas may be those sold under the trademark HOTBLOX® which may be readily obtained from American Technical Coatings, Inc. located in Cleveland, Ohio. In accordance with the embodiments of the present invention, laminate composite backing 120, 220 comprises a thickness in the range of about ¼ inch to about 5 inches, and in particular in the range of about 1-4 inches, or even about 0.25-4 inches. More particularly, laminate composite backing 200 comprises a thickness of about 0.5-3 inches, or even about 2.5 inches, in accordance with the embodiments of the present invention. It should be appreciated, however, that the particular thickness of the laminate composite backing depends on the particular type of application with which the present invention is used. For example, use of the laminate composite backing in an armor system according to the present invention would be comparatively thinner for use with body armor than for use with, for example, an armor system for protecting vehicles or missile transport canisters.

In accordance with the embodiments of the present invention, laminate composite backing 120, 220 can comprise a layered configuration of cross-sectional composition of fibers such as, but not limited to, at least one of synthetic aramid fibers or para-aramid fibers known as KEVLAR® fibers, E-glass, S-Glass, polypropylene, Ultrahigh Molecular Weight Polyethylene (UHMWPE), such as a plurality of layers of standard ballistic cloth based on a UHMWPE known under the trademark DYNEEMA®, and integrally combined with polymer resin-based binders such as, but not limited to, at least one of silicones, epoxies, urethanes, polyethylenes, polyurethanes, and polyureas, such as those disclosed in U.S. Pat. Nos. 6,638,572 and 7,098,275 (both to Inglefield and commented on earlier), incorporated herein by reference in their entireties. In accordance with the present invention, polymer resin-based binders such as silicones, epoxies, urethanes, polyethylenes, polyurethanes, and polyureas may be those sold under the trademark HOTBLOX® which may be readily obtained from American Technical Coatings, Inc. located in Cleveland, Ohio as discussed above. A bottom layer, side layers and a top layer of a polymer resin-based binder material such as a silicone, epoxy, polyurethane, urethane and/or polyurea, such as those sold under the trademark HOTBLOX® readily obtained from American Technical Coatings, Inc. located in Cleveland, Ohio, are provided for encasing the layered configuration comprising the laminate composite backing 120, 220. The layered configuration comprising the laminate composite backing 120, 220 is treated under pressure, such as in the range of about 2,000 psi-3,500 psi for a period of time as needed, such as in the range of between ½ hour-10 hours, and preferably in the range between 1-5 hours, to arrive at an appropriate laminate composite backing for use with the protective system of the present invention.

Figure 35:
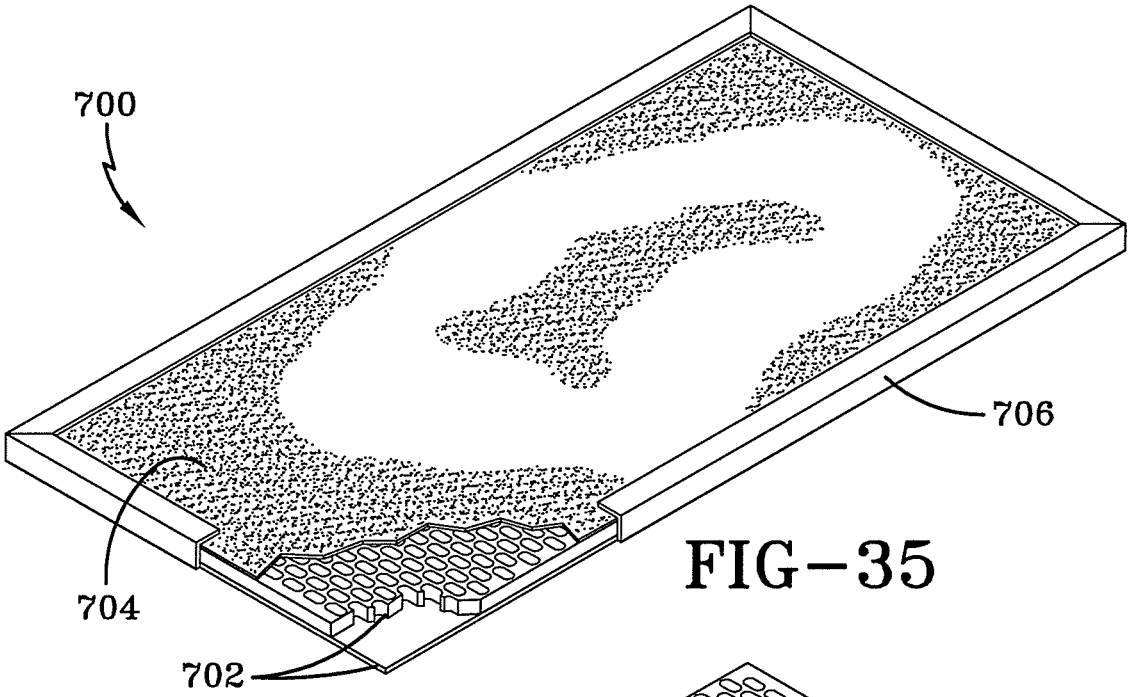
FIG. 35 is a perspective view of another alternative embodiment in accordance with the present invention.

Alternatively, the optional encasing or encapsulation in accordance with the present invention discussed above may be replaced by employing an environmentally insensitive layer or wrap, such as a polymer layer, sheet, or encasing (e.g., polypropylene) or a metal layer, sheet, or encasing (e.g., aluminum, titanium, and the like). One such alternative embodiment armor system is shown generally at numeral 700 in FIG. 35. As shown in FIG. 35, armor system 700 includes a layered configuration of perforated metal and composite backing 702, shown as adjacent to each other. An environmentally insensitive sheet or layer 704, comprising an appropriate material such as but not limited to a polymer (e.g., polypropylene) or a metal (e.g., aluminum, titanium, and the like) is applied directly onto at least one surface, such as the outwardly facing surface of layered configuration 702 exposed to external environmental conditions, or even all surfaces thereof (e.g., entirely wrapped). Environmentally insensitive sheet or layer 704 may be advantageously bonded or otherwise secured to layered configuration 702 by conventional methods known in the art, such as heat, pressure or bonding materials. It should also be understood that environmentally insensitive sheet or layer 704 could alternatively comprise an encasing to fully encase or enclose layered configuration. As shown in FIG. 35, an optional molding, edging or frame 706 comprising a material such as but not limited to a glass epoxy composite (or a comparable conventional protective material) may advantageously be provided around the outside edges of layered configuration 702 having sheet or layer 704 bonded or secured thereon for reinforcing layer 704 onto layered configuration 702. Of course, frame 706 may also be employed in the case of an environmentally insensitive material fully encases or wraps layered configuration 702. It should be appreciated that frame 706 is optional for providing additional reinforcement and/or ballistic characteristics to armor system 700.

Figure 36:
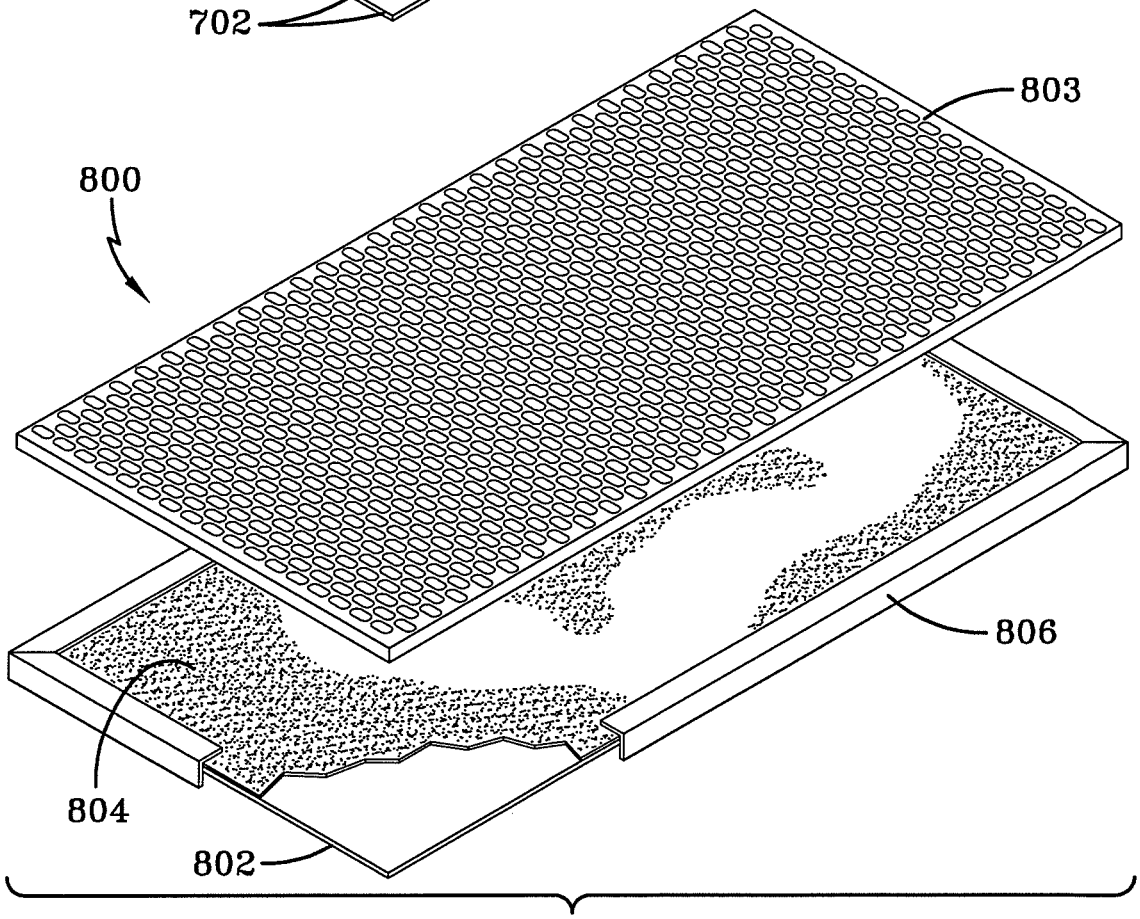
FIG. 36 is a perspective view of yet another alternative embodiment in accordance with the present invention.

Turning now to FIG. 36, yet another alternative embodiment is shown and described. As discussed above, the optional encasing or encapsulation in accordance with the present invention may optionally be replaced by employing an environmentally insensitive layer or wrap, such as a polymer layer, sheet, or encasing (e.g., polypropylene) or a metal layer, sheet, or encasing (e.g., aluminum, titanium, and the like). One such additional alternative embodiment armor system is shown generally at numeral 800 in FIG. 36. As shown in FIG. 36, armor system 800 includes a composite backing 802 having an environmentally insensitive sheet or layer 804, comprising an appropriate material such as but not limited to a polymer (e.g., polypropylene) or a metal (e.g., aluminum, titanium, and the like) applied directly onto at least one surface, such as the outwardly facing surface of layered configuration 802 exposed to external environmental conditions, or even all surfaces thereof (e.g., entirely wrapped). Environmentally insensitive sheet or layer 804 may be advantageously bonded or otherwise secured to composite backing 802 by conventional methods known in the art, such as heat, pressure or bonding materials. It should also be understood that environmentally insensitive sheet or layer 804 may comprise an encasing to fully encase or enclose composite backing 802. As shown in FIG. 36, an optional molding, edging or frame 806 comprising a material such as but not limited to a glass epoxy composite (or a comparable conventional protective material) may advantageously be provided around the outside edges of composite backing 802 having sheet or layer 804 bonded or secured thereon for reinforcing layer 804 onto composite backing 802. Of course, frame 806 may also be employed in the case of an environmentally insensitive material fully encases or wraps composite backing 802. It should be appreciated that frame 806 is optional for providing additional reinforcement and/or ballistic characteristics to armor system 800. As also shown in FIG. 36, armor system 800 also includes at least one layer of perforated metal 803 adjacent to composite backing 802 relative to the external environment at a distance as described above.

It should be appreciated that a process for encapsulating the laminate composite backing layer in accordance with the present invention can be as follows. It should also be appreciated that the process for forming the laminate composite backing layer in accordance with the present invention would envision any alternative or modifications that would be apparent to one skilled in the art. In particular, a material in a liquid form is encapsulated around a fibrous bundle core in a manner conventional in the art. The liquid is solidified to form an encapsulating skin. The transformation from liquid may occur, for example, via solvent evaporation, chemical reaction, or cooling from a molten state or by any alternative comparable manner conventional in the art. For example, a two-component system which is liquid under normal ambient conditions without the addition of a solvent can be poured over the fibrous bundle core and the components solidify by a chemical reaction. Alternatively, a thermoplastic material can be melted and molded around the fibrous bundle core, i.e., by insert injection molding.

Regardless of the actual chemistry of the resin material, the preferred material properties of the resultant solidified optional encapsulating skin for the laminate composite backing in accordance with the present invention can be the following. In particular, thermoset elastomeric resins may be employed in accordance with the present invention as follows.

- Hardness, via ASTM D 2240: Shore 60A-60D, preferably 75A-55D;
- Ultimate Tensile Strength (psi), via ASTM D 412: 1200-9000 psi, preferably 3000-8000 psi;
- Modulus at 100% elongation (psi), via ASTM D412: 400-2200 psi, preferably 700-1500 psi;
- Modulus at 300% elongation (psi), via ASTM D412: 700-5000 psi, preferably 900-4000;
- Elongation-to-break (%), via ASTM D412: 150-1000, preferably 300-800.

Example

An example of the formulation in accordance with the present invention can be as follows. It should be appreciated that the formation of the present invention is not limited to this example, but would envisions any alternatives or modifications that would be understood by one skilled in the art. A polyurethane that is made by the reaction of a multifunctional amine and a multifunctional isocyanate without the addition of a solvent is provided. More specifically, an oligomeric ether or ester with diamine functionality reacted with a diisocyanate is provided.

As discussed above, alternatively the bundle or layered composite configuration may be environmentally protected by pressing or wrapping protective layers of polypropylene or other comparable materials, such as metal, Kevlar, S-glass, and the like, around the bundle or layered composite configuration. Edges may be reinforced with glass epoxy composites or other comparable protective and/or reinforcement materials as shown in FIG. 36. It should therefore be understood that in accordance with the embodiments of the present invention, embodiments for lower weight systems of the present invention may be advantageously used for example in connection with "on canister" ballistic systems for protecting missile canisters. In that case, it should be understood that such embodiments may include at least one strike face plate against a corresponding composite backing with or without a polypropylene or other protection layer and with or without a corresponding frame for reinforcing.

In an alternative embodiment, as discussed in greater detail below, a layer, sheet or board of a high tensile strength material, such as a high tensile strength polymer board, may be employed adjacent to laminate composite backing 200 at a thickness in the range of about 1/32 inch-4 inches, or about 1/8 inch to about 4 inches, or about 1/4 inch to about 4 inches, or even about 1/16 inch-4 inches and more particularly at a thickness in the range of about 1/32 inch-2 inches. It should be appreciated that the thickness of the high tensile strength polymer board would depend on the specific requirements of the particular application with which the present invention is employed. High tensile strength polymer board may supplement the laminate composite backing 200, or replace at least a portion of the cross-sectional composition of the laminate composite backing 200.

As shown in an embodiment of the present invention in FIG. 2, armor system 100 is provided with the strike face plate 110 and laminate composite backing 120 bonded together by bonding methods conventional in the art, such as by a urethane or polyurethane bonding. As shown in FIG. 2, strike face plate 110 and composite backing 120 are bonded directly together with no air space there between. It should be appreciated that strike face plate 110 and laminate composite backing 120 could also be secured together via mechanical means conventional in the art, as discussed further below. Such a configuration may be employed, for example, for use of the present invention in a body armor type of application.

Figure 3B:
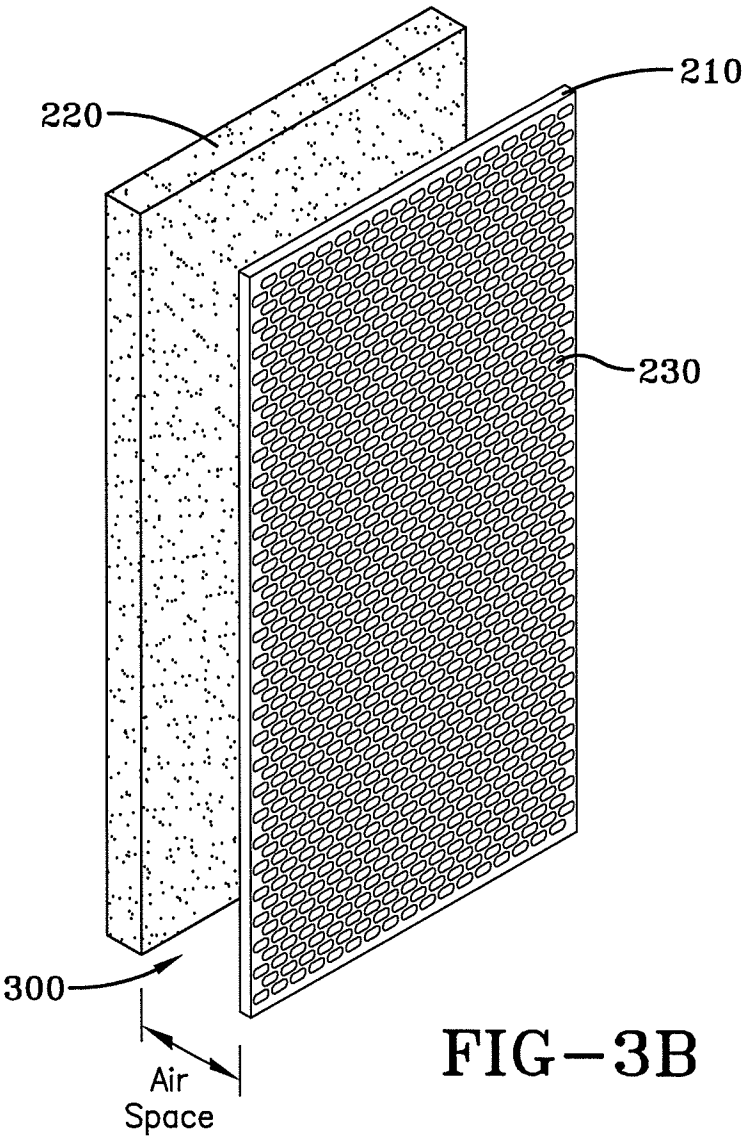
FIG. 3B is a perspective view of the second embodiment of the armor system as shown in FIGS. 3 and 3A.
Figure 3A:
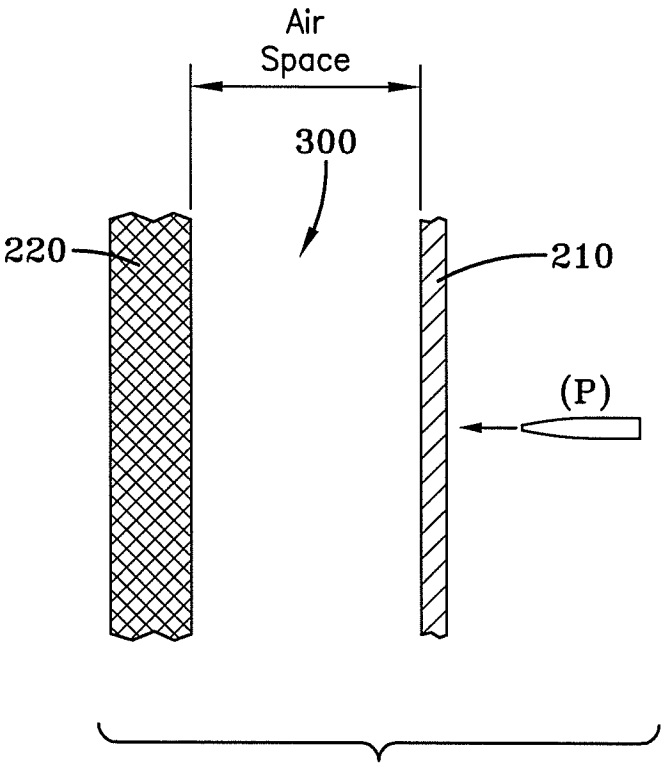
FIG. 3A is a cross-sectional view of the second embodiment of the armor system as shown in FIG. 3.

As shown in an embodiment of the present invention of FIGS. 3, 3A and 3B, armor system 200 is provided with an air space 300 between strike face plate 210 and laminate composite backing 220. According to the embodiments of the present invention, air space 300 may be provided at a distance or depth in the range of about 0.25 to 5 or 6 inches. More particularly, air space 300 may be provided at a distance or depth of about 0.25 inches to 2 inches, or even about 5⅛ inches to about 5½ inches. It should be appreciated that the particular depth of the air space would depend on the particular type of application with which the present invention is employed, including no air space at all, i.e., air space having zero inches depth. In other words, armor system 200 may be devoid of air space 300 in an embodiment of the invention. Air space 300 may be optionally filled with a foam energy absorbing material, such as low density foam, or other comparable energy absorbing material as conventional in the art.

Figure 9A:
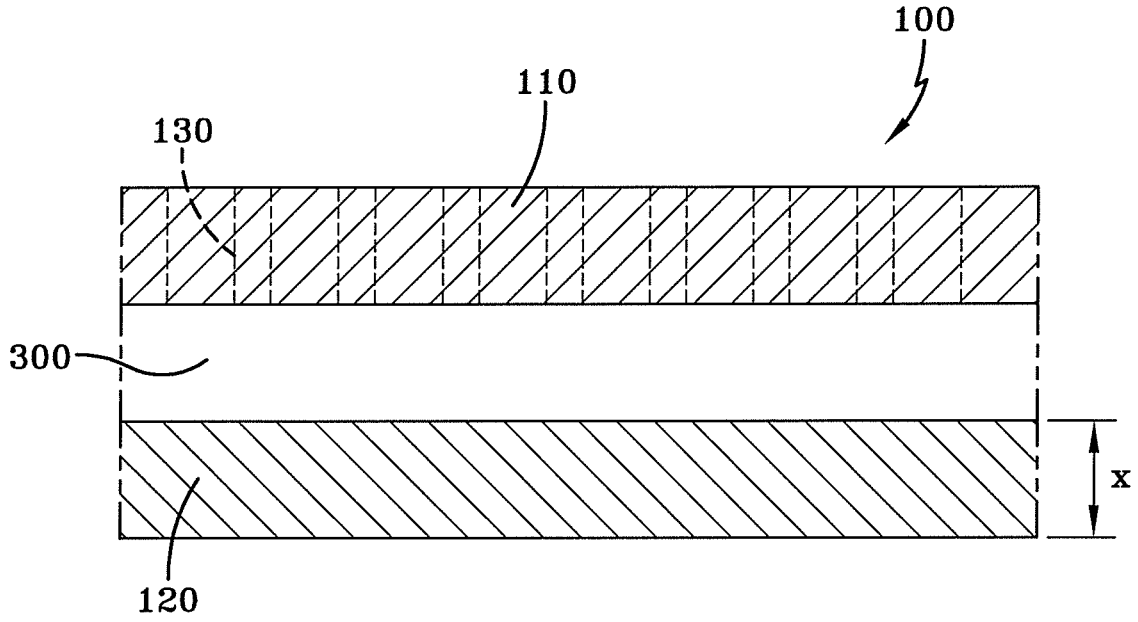
FIG. 9A is a cross-sectional view of an embodiment of the layers of the armor system according to the present invention.
Figure 9B:
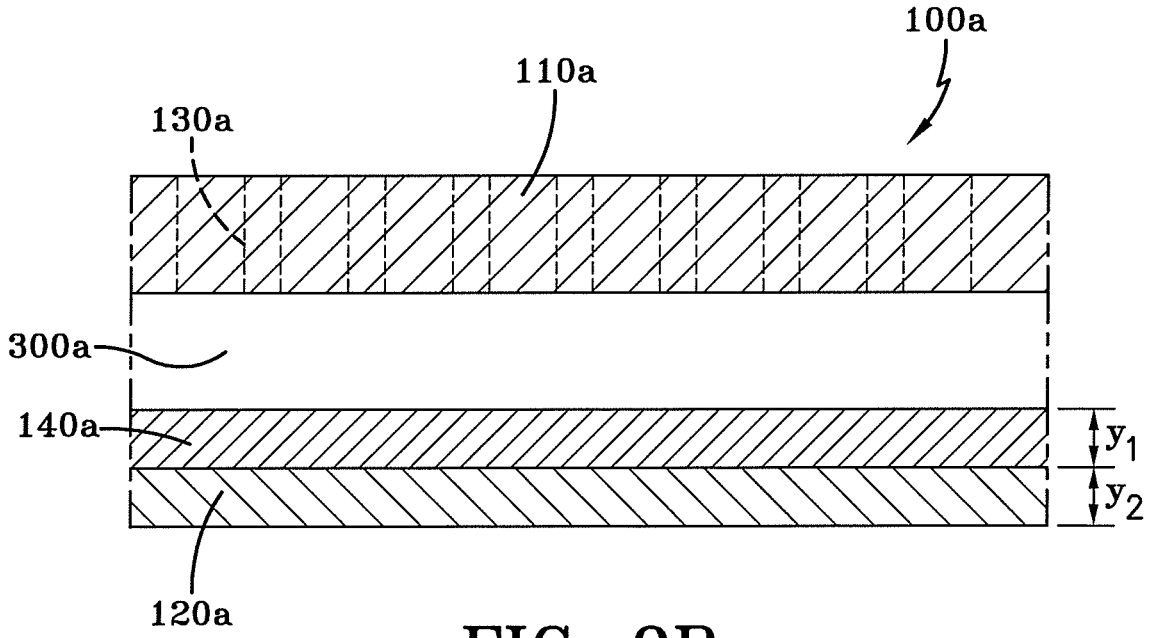
FIG. 9B is a cross-sectional view of an alternative embodiment of the layers of the armor system according to the present invention.

Turning now to FIGS. 9A and 9B, cross-sectional schematic diagrams of the present invention are shown and described. As shown in FIGS. 9A and 9B, the armor system according to the present invention may be employed for use as an armor system for missile transport canisters, for body armor, for the missile canisters, or for vehicles including for incorporation into the body of the vehicle or portion(s) of the vehicle body. With reference to FIG. 9A, armor system is shown at numeral 100 comprising perforated metal or expanded metal plate 110 having plurality of holes 130, laminate composite backing 120 and air space 300 between perforated metal or expanded metal strike face plate 110 having plurality of holes 130 and laminate composite backing 120. Laminate composite backing comprises a thickness defined as thickness X, which may be for example about 0.25-5 inches, or 0.25-4 inches, or even about 2.5 inches. With reference to FIG. 9B, an alternative embodiment of armor system is shown at numeral 100*a* comprising perforated metal or expanded metal plate 110*a* having plurality of holes 130*a*, laminate composite backing 120*a* and air space 300*a* between perforated metal or expanded metal plate 110*a* having plurality of holes 130*a* and laminate composite backing 120*a*. A sheet of material or board, shown at numeral 140*a*, may be provided on top of and adjacent to laminate composite backing 120*a*. Sheet of material or board 140*a* may be, but is not limited to, a high tensile strength urethane board having a defined thickness of y1. The defined thickness of laminate composite backing 120*a* is thus reduced as compared to the laminate composite backing 120 of FIG. 9A and is shown at numeral y2. It should be appreciated that the defined thicknesses of sheet of material or board 140*a* and laminate composite backing 120*a* (FIG. 9B) is substantially equal to the thickness of laminate composite back 120 (FIG. 9A). In other words, the defined thicknesses of y1+y2=x depending on the particular application with which the present invention is employed. It should be appreciated that sheet of material or board 140*a* may be employed for partially replacing a desired thickness or amount of laminate composite backing 120*a* for reducing overall production costs while maintaining overall system strength, thickness and integrity. It should also be understood that multiple layers of perforated metal sheet may be employed, as discussed above, depending on a particular desirable application for the present invention with the overall thickness of the metal layer(s) being constant as desired for a particular embodiment regardless of whether a single-layer of perforated metal or multiple layers of perforated metal is/are employed.

In accordance with the embodiments of the present invention, the armor system of the present invention meets the appropriate military weight specifications and requirements for defeating high velocity and high caliber projectiles, or alternatively for disrupting/deflecting/dissipating the energy of small arms impact (i.e., a reduction of the energy of the small arms threat). In particular, the armor system of the present invention meets the appropriate military weight specifications and requirements as defined by NATO Standardization Agreement (STANAG) Bullet Impact, Munitions Test Procedures promulgated on Apr. 15, 2003 and NATO Standardization Agreement (STANAG) Fragment Impact, Munitions Test Procedures promulgated on Dec. 13, 2006, both of which are incorporated herein by reference in their entireties. For example, the present invention meets the appropriate test of stopping, or alternatively slowing down (i.e., deflecting, disrupting, dissipating the energy of) three (3) 50-caliber bullets shot within a 2-inch diameter area and shot in a time interval of 1/10 second apart.

In accordance with an embodiment of the present invention, the armor system of the present invention comprises a weight in the range of about 18-35 psf for use with missile canister protection systems. More particularly, in accordance with the present invention, the armor system comprises a weight of no greater than about 29 psf in the embodiment in which the present invention is employed for use with a missile canister armor system. Even more particularly, in accordance with the present invention, the armor system comprises a weight of about 23 psf in the embodiment in which the present invention is employed for use with a missile canister armor system. In accordance with the present invention, the respective weights meet those that are needed by the particular application of use with which the present invention is employed.

In an alternative embodiment, the lightweight armor system of the present invention comprises a weight of about 3-15 psf, including about 6-11 psf. More particularly, the lightweight armor system of the present invention comprises a weight in the range of about 7-11 psf, or even 7.1-10.8 psf, when employed with a metal strike plate, such as steel or titanium, for defeating, for example, 30 caliber armor piercing threats. In accordance with the present invention, the respective weights meet those that are needed by the particular application of use with which the present invention is employed.

In another alternative embodiment, the lightweight armor system of the present invention comprises a weight in the range of about 4-8 psf, or even about 5-6 psf, or more particularly about 5.6 psf, when employed with a hardened steel plate for defeating threats such as 5.56 X 45 M193 and SS 109 (M855 equivalent). In this instance, the embodiment of the present invention may be employed for use with vehicles, such as a material for forming at least a portion of the vehicle body, such as a police vehicle or military vehicle. In this embodiment of the present invention, Ultrahigh Molecular Weight Polyethylene (UHMWPE) may be advantageously employed as the component of the composite backing.

In another alternative embodiment, the lightweight armor system of the present invention comprises a weight in the range of about 4-9 psf, or even about 4-7.7 psf, or more particularly about 4.0-6.7 psf, or even more particularly in the range of about 4.3-6.3 psf or still even more particularly about 4.0-5.5 psf, when employed for use as a missile canister for encasing and protecting missiles during transport. In this embodiment of the present invention, S-Glass may be advantageously employed as the component of the composite backing, such as for lowering flammability properties. As also discussed above, the fibers or composite material may be advantageously used to wrap the perforated metal plate directly. For use on a missile canister, it should be appreciated that, for example, the wrapped perforated strike plate can be used as a singular item for improving ballistic and/or environmental properties.

Figure 37:
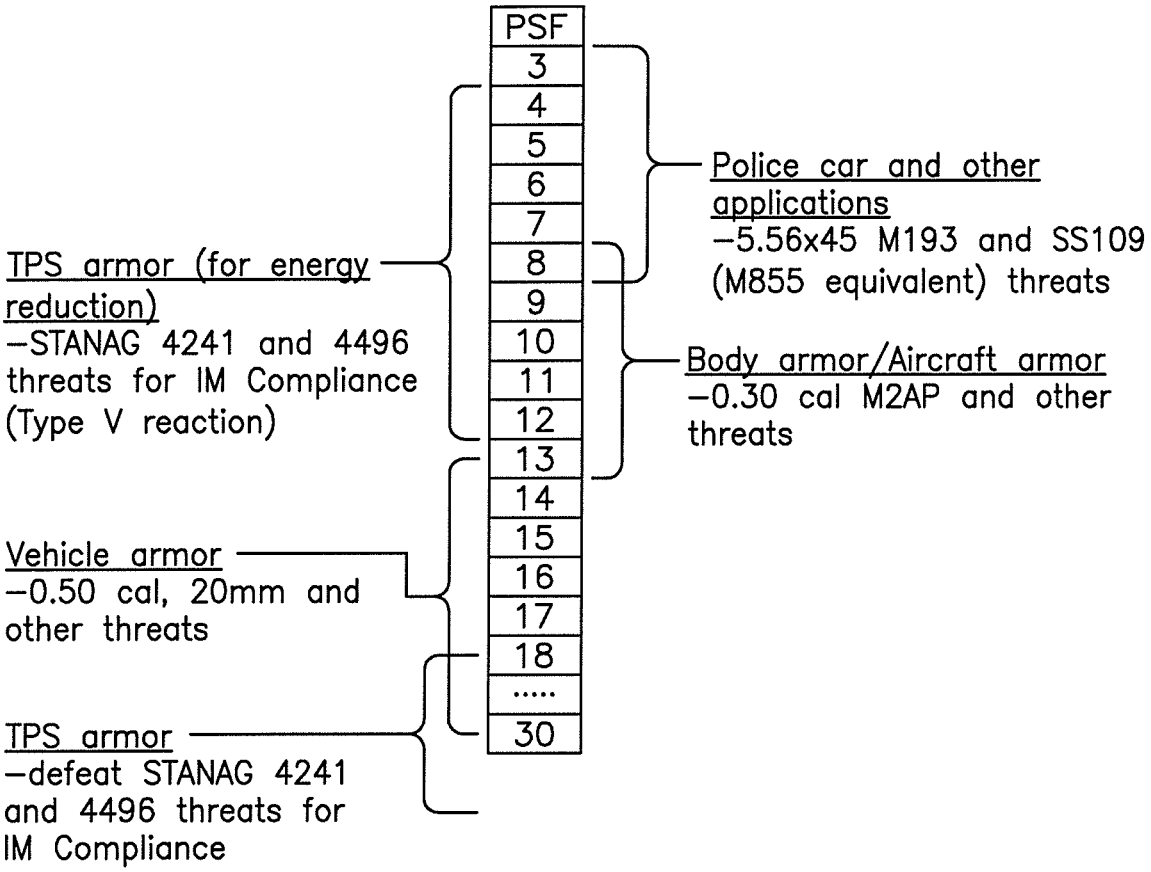
FIG. 37 is a chart showing varying total weights of the inventive system relative to a respective type of application of use.

FIG. 37 shows embodiments of different applications in accordance with the present invention, and "TPS" means "transportation protection system". As shown in FIG. 37, the overall weight of the perforated metal and composite backing (pounds per square foot) may vary with respect to the particular and specific desired need and application in accordance with the present invention.

As shown in FIG. 3, a mechanical attachment mechanism 400 can be fabricated into the components 110 and 120 for attaching components 110 and 120 to each other and/or for attaching an armor system to another object to be protected, such as a vehicle, and which is employed with the specific application of use. For example, referring to FIGS. 6-8, strike face plate 110 comprises recessed pockets 42 through which tubular spacers 40, each having a threaded end 41 passes through. Strike face plate 110 is attached to a structure 13 to be protected (e.g., a vehicle) (FIG. 8) through tubular spacers 40 by a washer 30 and nut 32. As shown in FIG. 6, strike face plate 110 comprises an opening 45 through which tubular spacer 40 may be accommodated. In a preferred embodiment, mechanical attachment mechanism 400 may be a conventional threaded screw and nut engagement mechanism as known in the art.

Turning now to FIGS. 10-14, an exemplary use of the armor system in accordance with the present invention in connection with a particular type of application will be shown and described, namely for use with an armor system for the transport of missile canisters. It should be appreciated, however, that the specific application of the present invention shown in FIGS. 10-14 is for illustrative purposes only and the armor system of the present invention should not be considered limited or exclusive to such an application or use. As indicated above, the present invention may alternatively and advantageously be employed for use with body armor, missile canisters, or the vehicle body itself or a portion or portions of the vehicle body as within the scope of the present invention.

Figure 10:
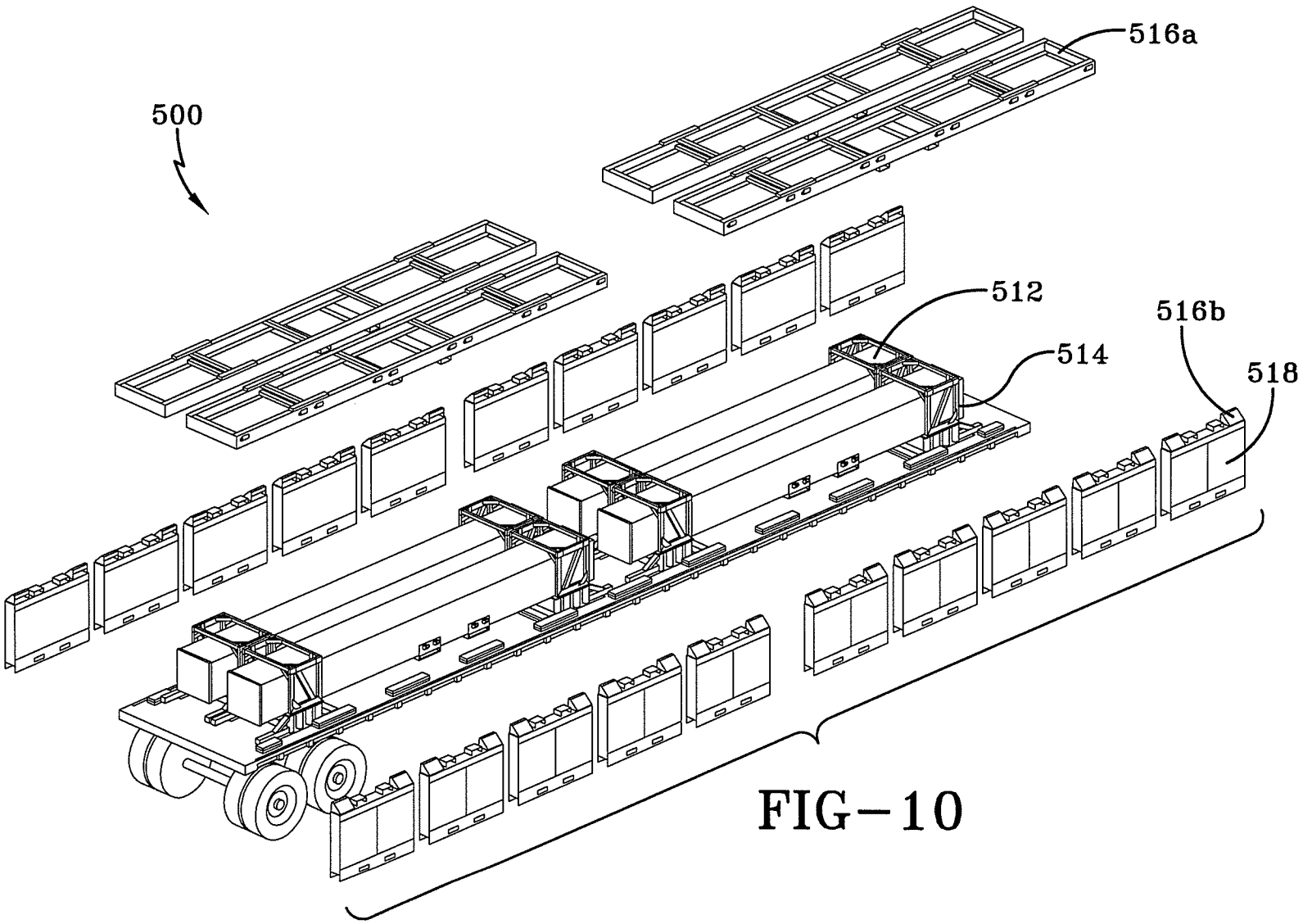
FIG. 10 is an exploded perspective view of the armor system according to an embodiment of the present invention in an exemplary application of use thereof being a missile transport system.
Figure 11:
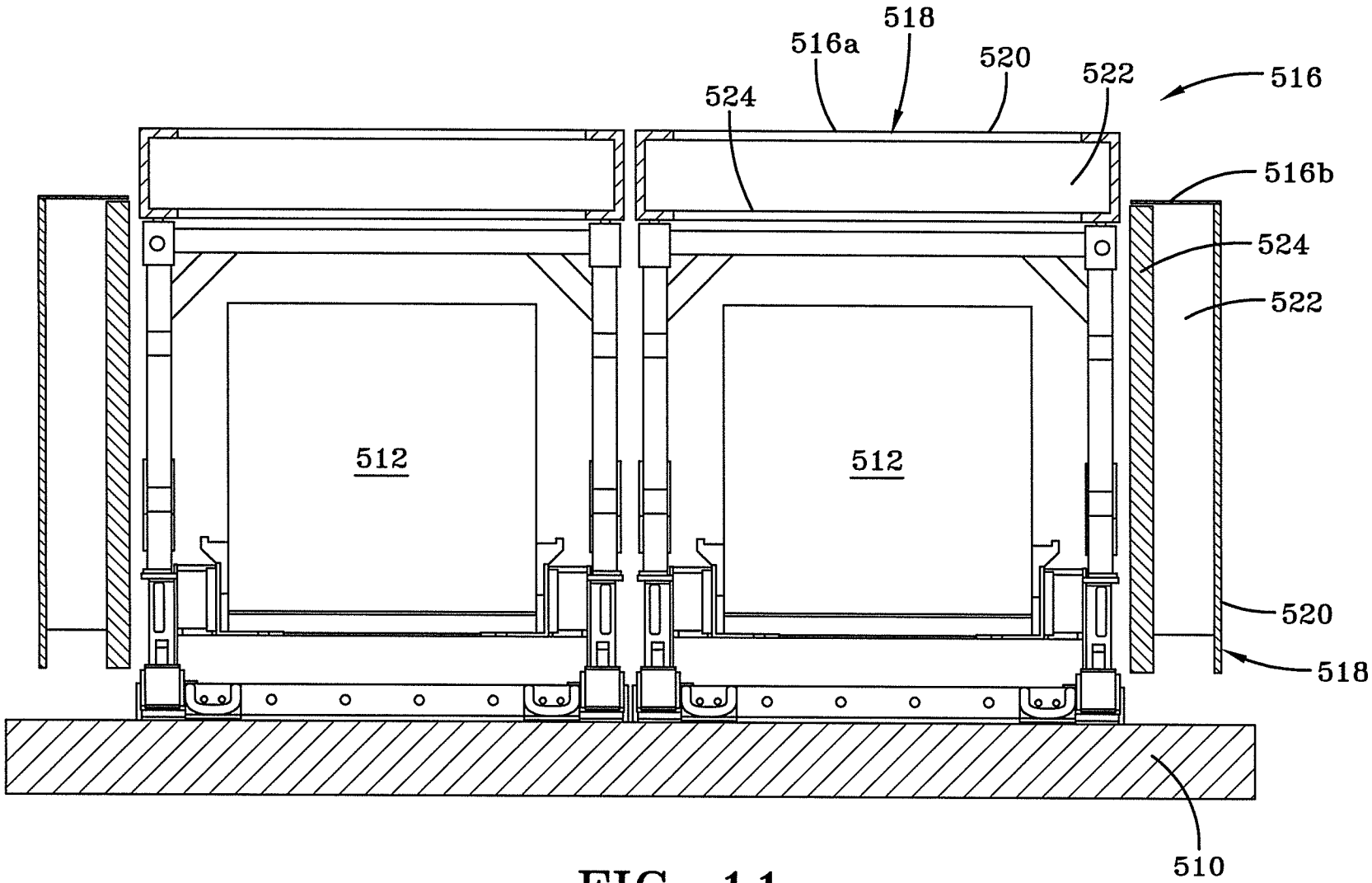
FIG. 11 is a rear view of the armor system according to the present invention in an example application of use as shown in FIG. 10.
Figure 13:
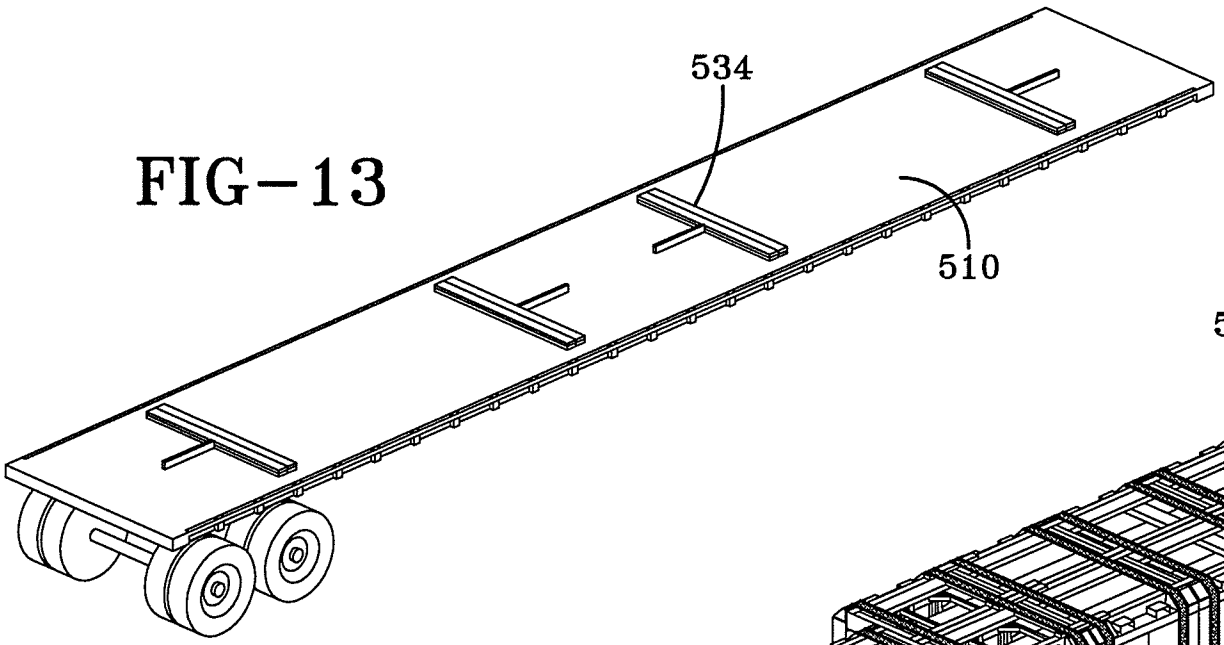
FIG. 13 is a perspective view of a flatbed truck trailer for use with the armor system according to the present invention in an example application of use as shown in FIG. 10.
Figure 14:
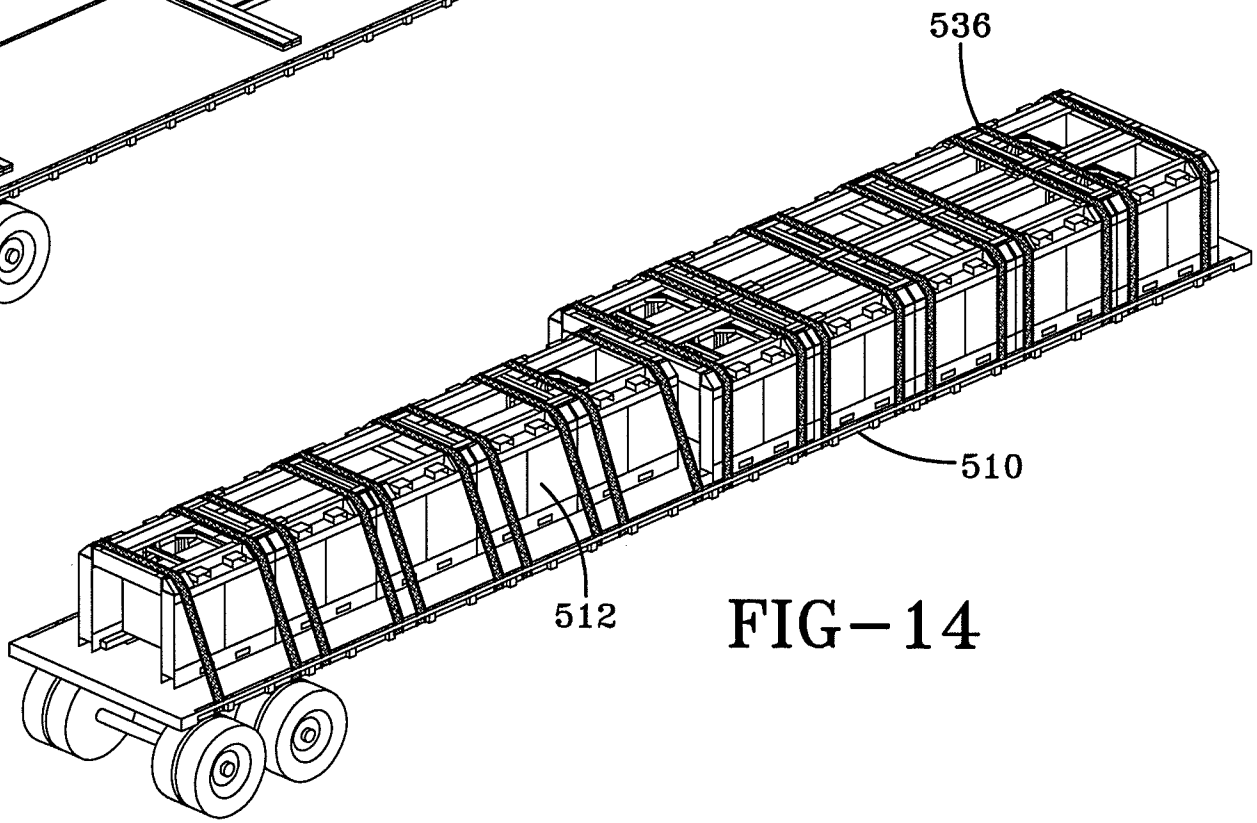
FIG. 14 is a perspective view of the armor system according to the present invention in an alternative example application of use.

As shown in FIG. 10, the armor system is shown generally at numeral 500. A flatbed truck trailer 510 is provided for carrying at least one missile canister 512. As shown in FIG. 10, four missile canisters 512 are provided on flatbed truck trailer 510. A frame 514, such as a wooden or metal frame as known in the art, is provided for securing each individual canister 512 to flatbed truck trailer 510. Spacers 534, such as wood spacers or metal spacers, are provided on the floor of the flatbed truck trailer 510 to further ensure stability of canisters 512 (FIG. 13). An additional frame system 516, such as an aluminum frame system (FIG. 11) having a top frame 516*a* and side frames 516*b*, is provided for securing the armor system panels 518 to the side of the flatbed truck trailer 510 and totally surrounding the canisters 512 secured by frame 514. It should be appreciated that any comparable material to aluminum may be employed for frame system 516. As shown in FIG. 11, each segment of frame system 516 contains or houses strike face plate 520 and laminate composite backing 524, with air space 522 therebetween, and regardless of whether the respective segment of frame system 516 is employed on a side, front, top or back of the trailer bed 510. Each segment of frame system 516 is employed in series so as to directly and securely abut the respective adjacent segment of frame system 516 to form a secure protective system in all directions surrounding the canisters 512, including top and all sides.

Figure 12:
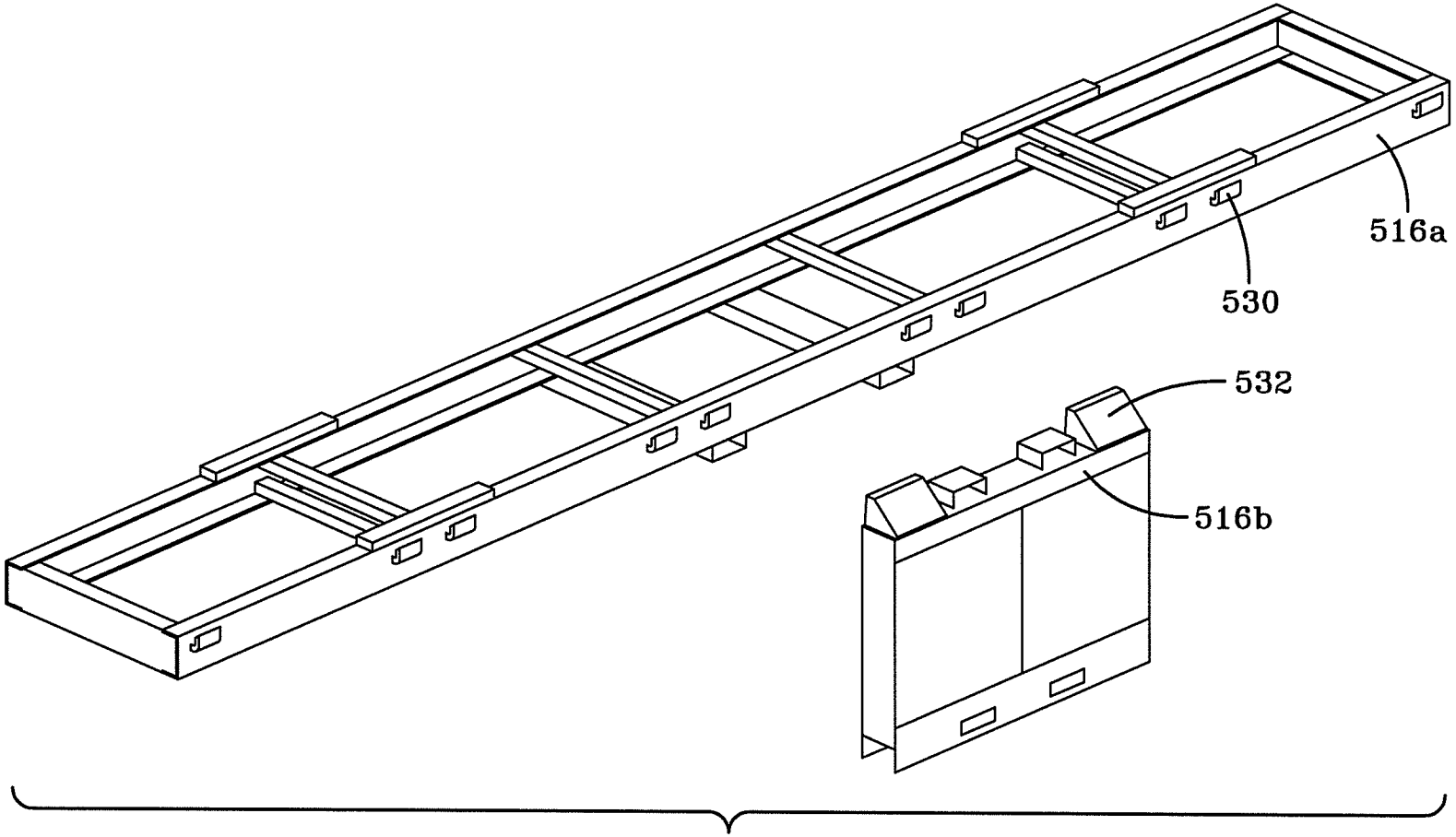
FIG. 12 is an exploded perspective view of a frame system for use with the armor system according to the present invention in an example application of use as shown in FIG. 10.

Referring to FIG. 12, top frame 516*a* and side frames 516*b* of frame system 516 are secured to together via a mechanical locking mechanism. The mechanical locking mechanism comprises a plurality of upwardly angled hooks, forks or the like 530 on top frame 516*a* which secure into and lock with corresponding grooves, holes, pockets or the like on side frames 516*b*. Side frames 516*b* are directly secured to each armor system panel 518, such as via conventional threaded bolt and nut securing mechanism or any other comparable mechanism conventional in the art. Straps 536 (FIG. 14) may be employed to further stabilize canisters 512 in place on flatbed truck trailer 510.

Examples

Ballistic Testing

The Ballistic Barrier Test was conducted in order to test ballistic armored panels in accordance with the present invention.

STANAG 4241-50 Caliber Bullet Impact Test

The objective of the test was to impact each candidate plate in a specified quadrant with a volley of three 50-caliber armor-piercing (AP) projectiles, fired at 100+/−8 msec intervals from 50 caliber Mann barrel devices. The projectiles were required to have velocities of 2788+/−66 ft./sec. These projectiles were to impact the specified plate quadrant within a 2-in circle, without key-holing or overlapping.

Test Item Configuration

Figure 15:
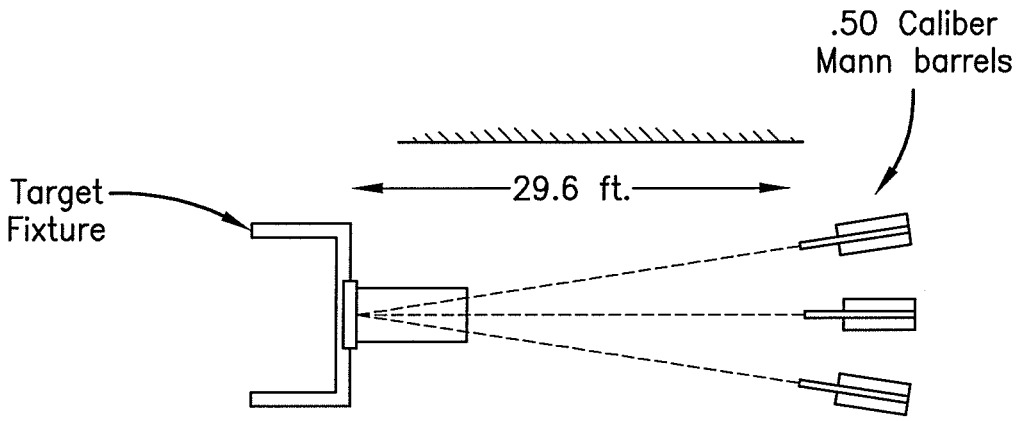
FIG. 15 is a schematic drawing of a test configuration of the present invention.

The overall general test configuration is shown in FIG. 15 and is discussed in greater detail below.

Figure 16:
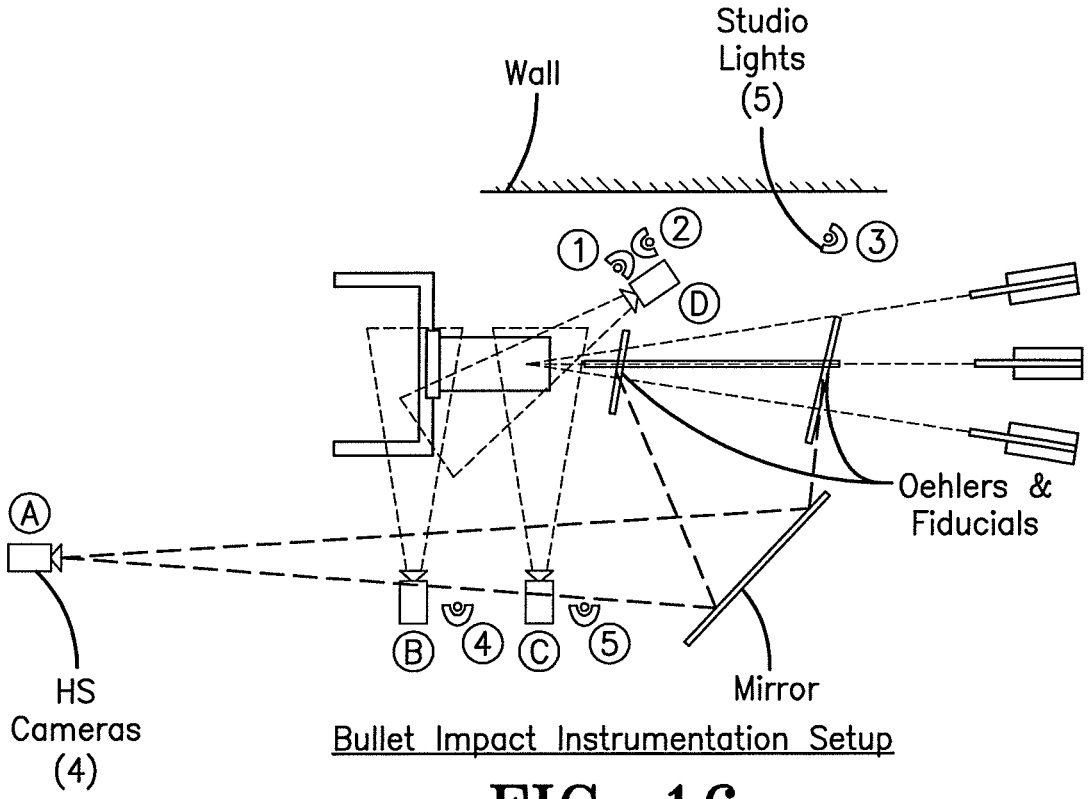
FIG. 16 is a schematic drawing of a bullet impact instrumentation configuration of the present invention.

The instrumentation setup was as shown in FIG. 16. A total of four Phantom cameras were used, and are described in Table 1 below.

TABLE 1

BULLET IMPACT TEST CAMERA SPECIFICATIONS

| Camera | Type | Frame Rate | Resolution | Exposure Time | Purpose |
|---|---|---|---|---|---|
| A | Phantom 710 | 5,000 frames/s | 1280 × 308 | 20 μs | Projectile Velocity |
| B | Phantom 7.3 | 6,400 frames/s | 800 × 600 | 3-10 μs* | Witness Plate |
| C | Phantom 7.3 | 6,400 frames/s | 800 × 600 | 3-10 μs* | Target Front/ Rear Face |
| D | Phantom 7.3 | 6,400 frames/s | 800 × 600 | 3-10 μs* | Target Front Face |

*Adjusted for lighting conditions

Figure 17:
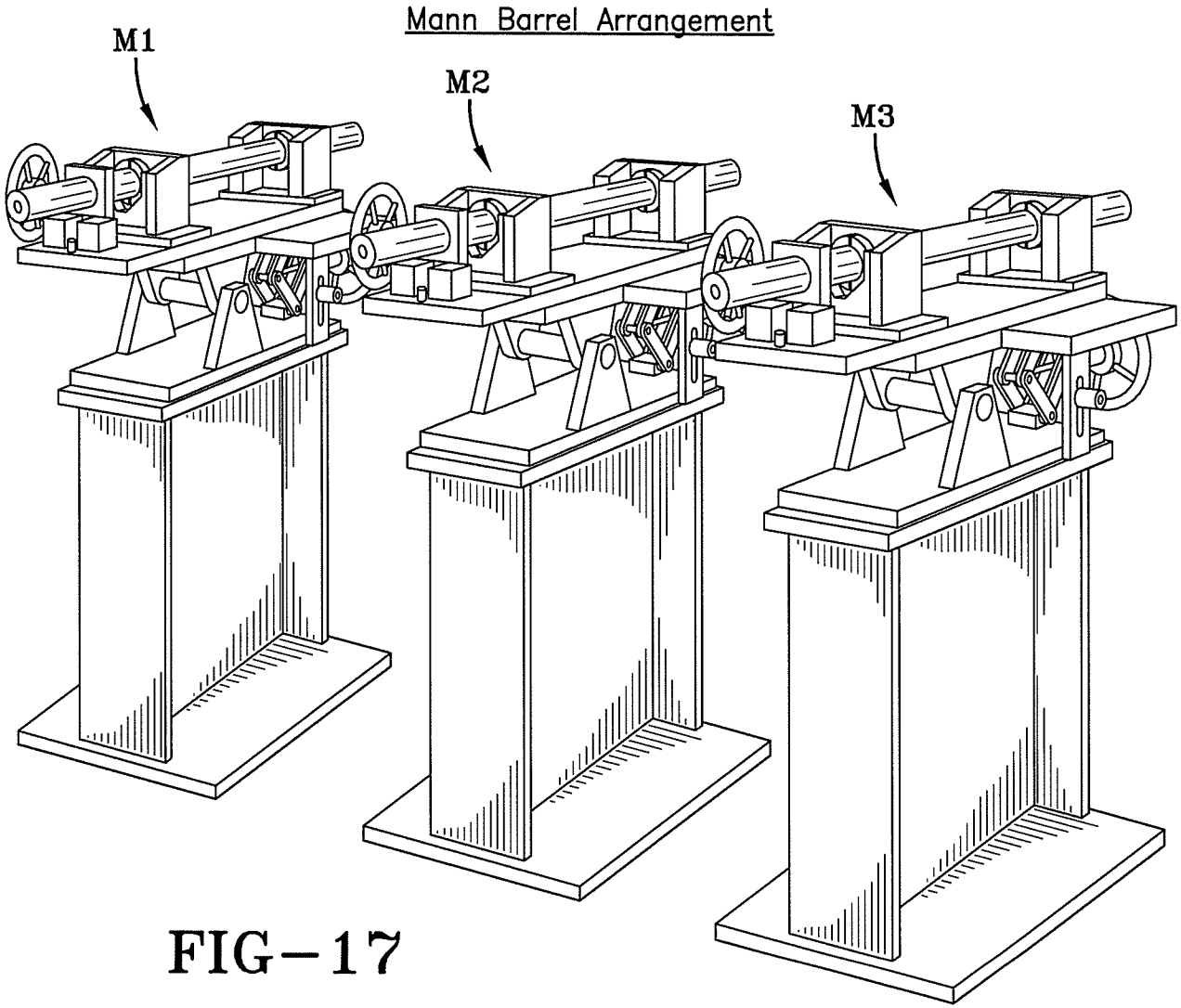
FIG. 17 is a schematic drawing of the gun barrel arrangement of the test configuration of the present invention.

FIG. 17 depicts the three Mann barrels (M1, M2 and M3) used in the testing of the present invention. The center muzzle distance to the target plate was approximately 29.6 feet. The guns were sequenced to fire at 100 msec intervals.

Figure 18:
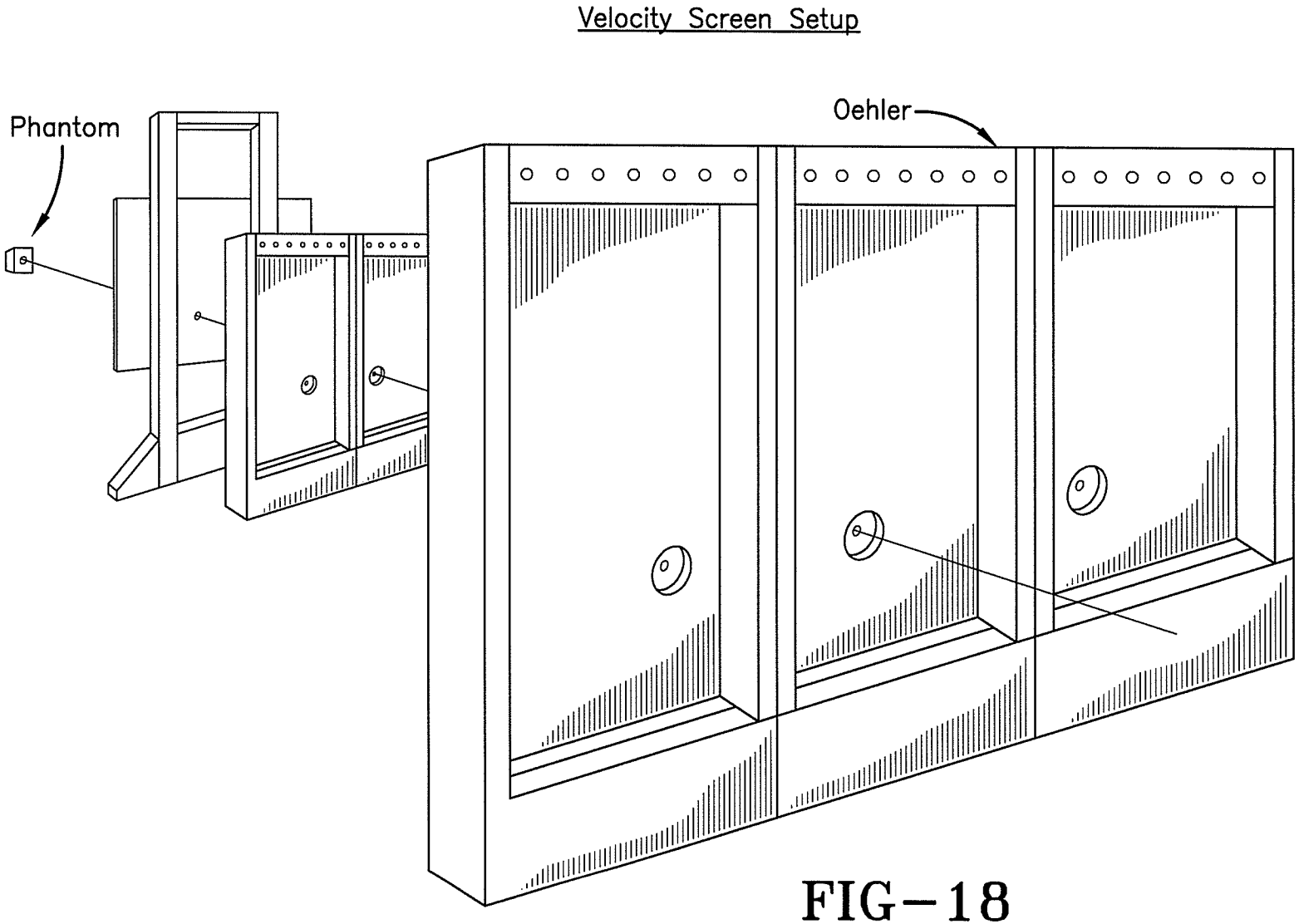
FIG. 18 is a schematic drawing of the velocity screen arrangement of the test configuration of the present invention.

Projectile velocities were measured using Oehler infrared screens and high-speed video. The Oehler screen and Phantom high-speed camera setup was as shown in FIG. 18.

Test Execution

Figure 19:
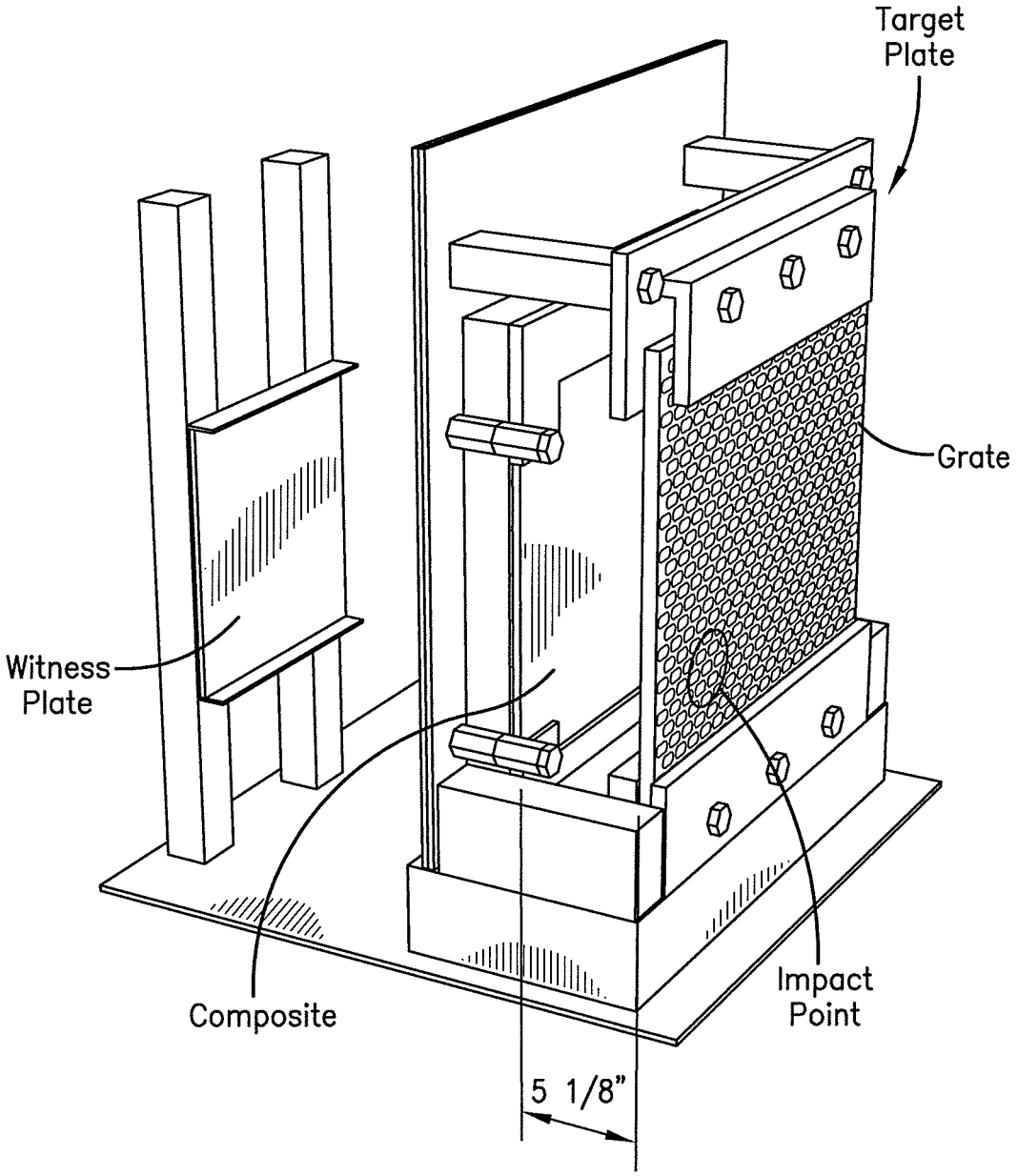
FIG. 19 is a perspective schematic drawing of the plate arrangement of the test configuration of the present invention.

Once the equipment was verified to be fully functional, and the projectile grouping was within a 2-inch circle, the target plate was secured to the test stand. The target plate consisted of a ⅝-inch perforated grate up-range and a 2.5-inch thick piece of composite downrange. The target panels were bolted to the test stand as shown in FIG. 19. The distance from the perforated plate to the composite plate was approximately 5⅛-inches.

Three laser bore-sights were used to give an approximate visual reference as to where the Mann barrels were aimed. The point of impact was on the face of the perforated metal grate at the center of the lower-left quadrant as demonstrated in FIG. 19.

Figure 20:
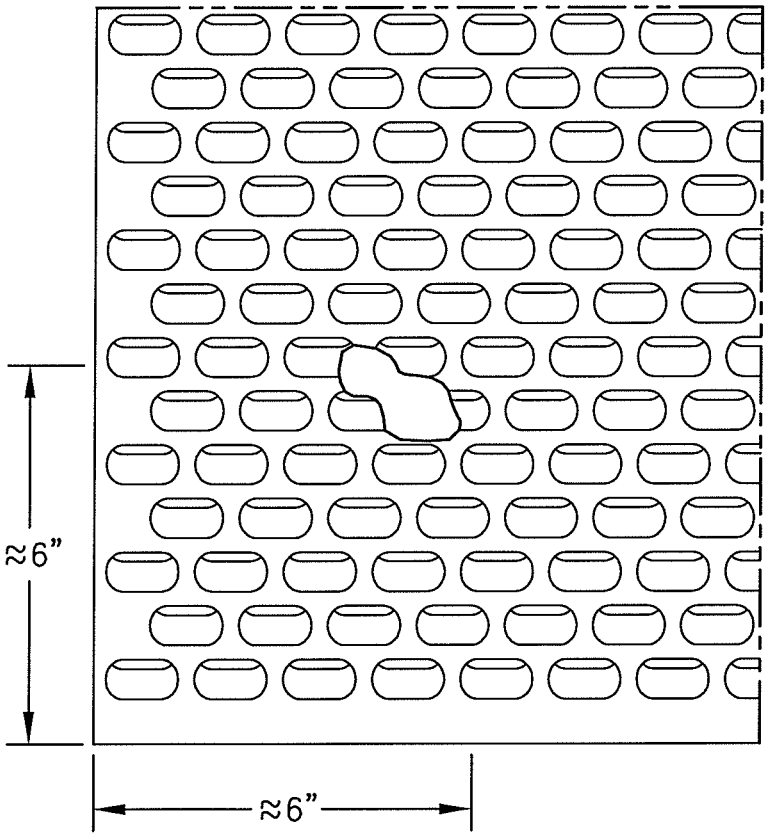
FIG. 20 is a schematic drawing of the plate projectile impact locations of the test configuration of the present invention.

Once the instrumentation was reset and shown to be ready, a volley of three 50 caliber armor-piercing projectiles was fired at the target. The projectiles impacted the plate within a 2-inch circle as shown in FIG. 20. The aim point was approximately 6 inches from the left side of the grate and approximately 6 inches from the bottom of the grate.

Figure 21:
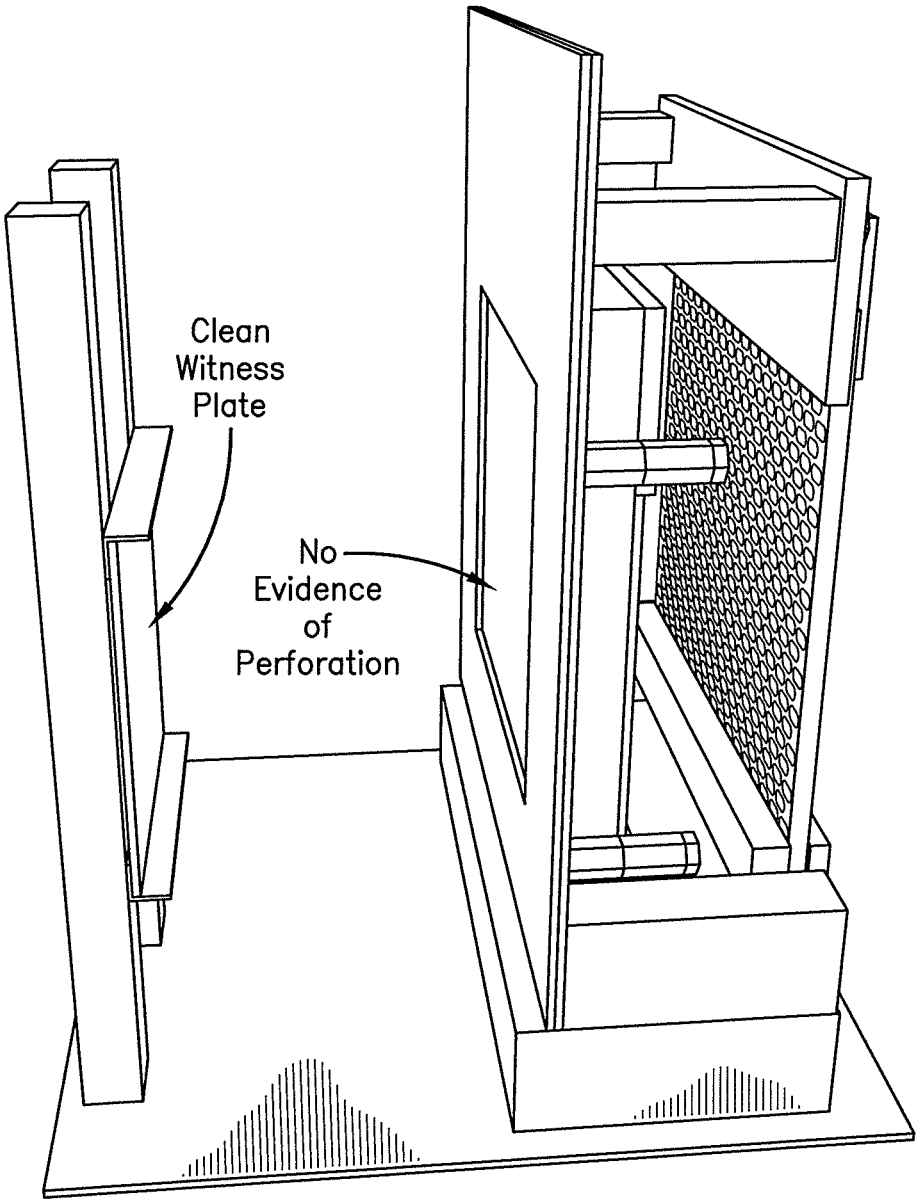
FIG. 21 is a schematic drawing of the post-test plate condition of the test configuration of the present invention.

As shown in FIG. 21, the test panel according to the present invention prevented all three projectiles from impacting the witness plate.

Velocity data for this volley is shown in Table 2 below.

TABLE 2

PROJECTILE VELOCITY & INTERVAL DATA

| | Oehler [ft/s] | Phantom [ft/s] | Projectile Weight [grains] | ΔTime from HS video [ms] |
|---|---|---|---|---|
| 1 | 2812 | 2826 | 693 | N/A |
| 2 | 2797 | 2811 | 693 | 101 |
| 3 | 2786 | 2791 | 693 | 98 |

Additional Test Plate

Figure 22:
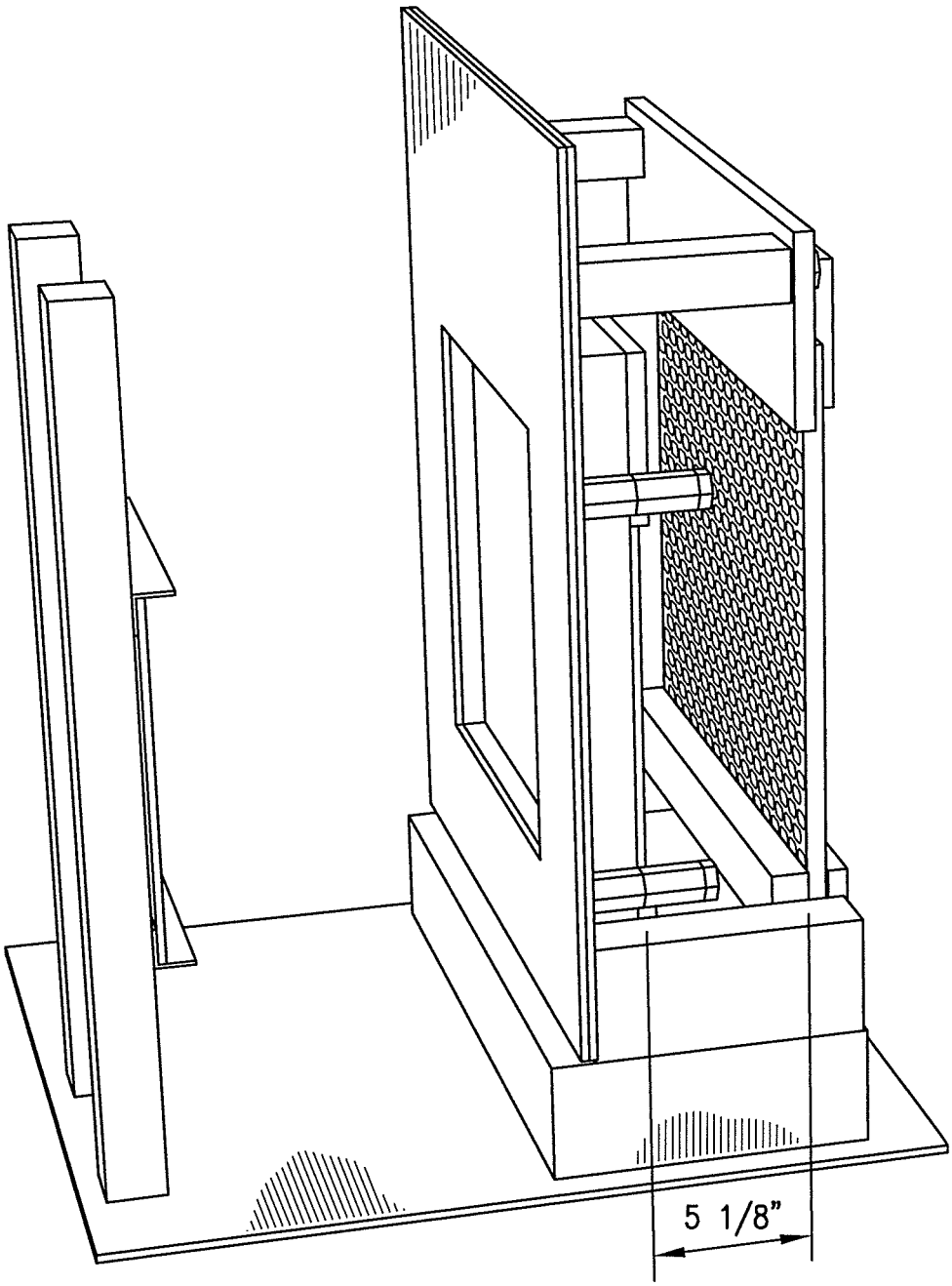
FIG. 22 is a schematic drawing of the test plate shown secured to the target stand of the test configuration of the present invention.

Another target test plate in accordance with the present invention was secured in a similar fashion as the first test plate. In this additional test, the difference between the respective plates was that the former had a composite plate thickness of 1.75 inches. This required the use of a ¾-inch standoff directly behind and downrange of the composite plate in order to maintain a plate separation of 5⅛-inches as shown in FIG. 22.

Figure 23:
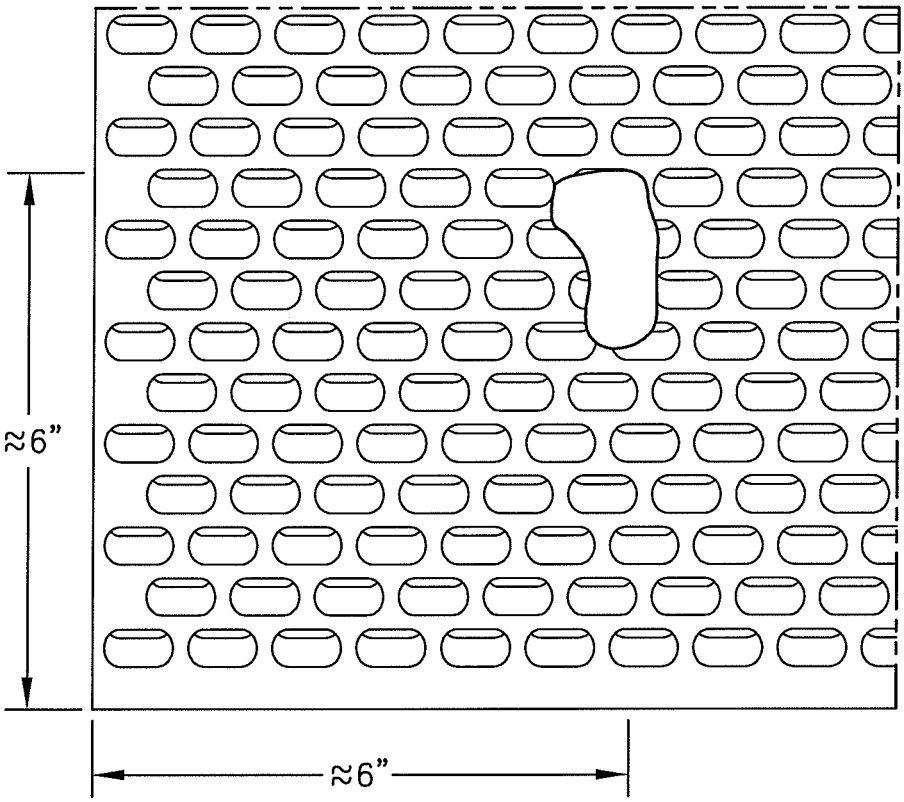
FIG. 23 is a schematic drawing of the projectile impact locations of the test configuration of the present invention.

A volley of three 50 caliber AP projectiles was fired at the target. Upon post-test inspection it was observed that projectile grouping and impact locations were similar to the initial test results as shown in FIG. 23.

Figure 24:
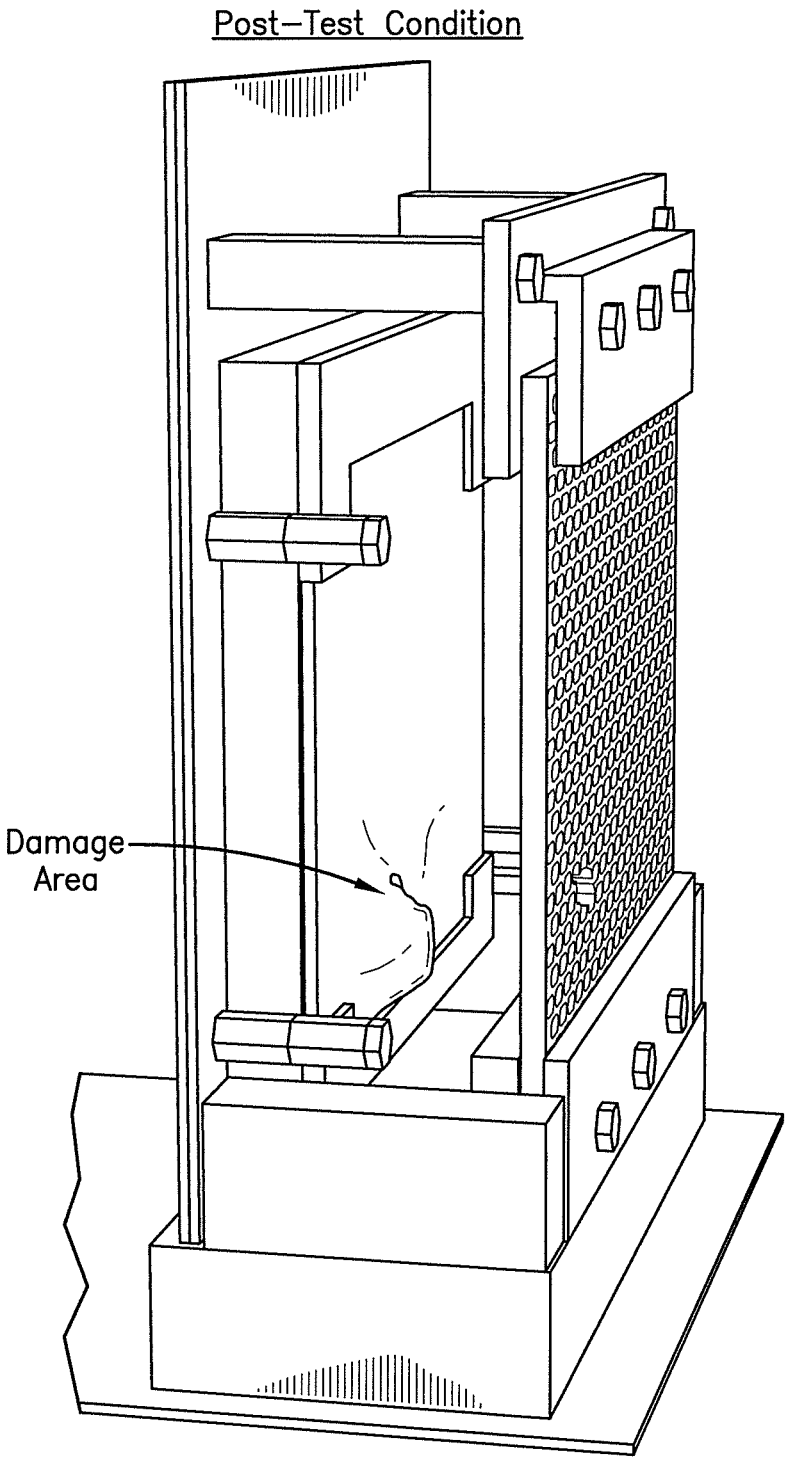
FIG. 24 is a schematic drawing of the post-test plate condition of the test configuration of the present invention.
Figure 25:
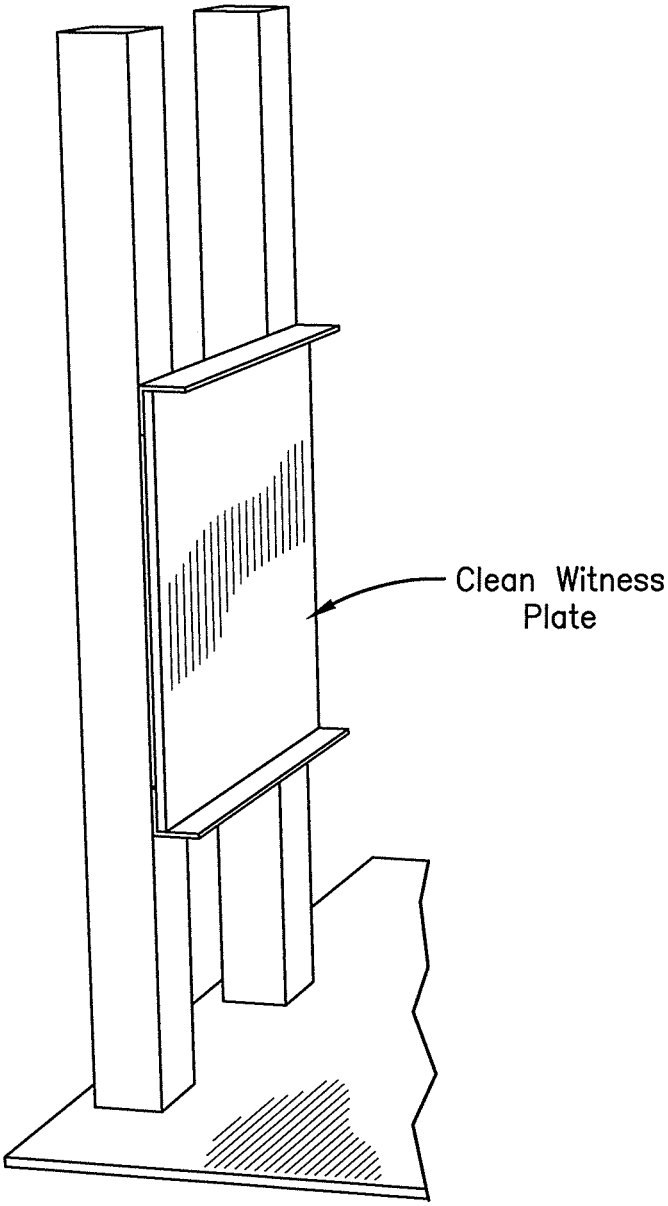
FIG. 25 is a schematic drawing of the witness plate of the test configuration of the present invention.

As shown in FIGS. 24 and 25, extensive damage was witnessed on the front side of the composite portion of the barrier (FIG. 24). However, no damage was observed on the witness plate (FIG. 25).

The velocity and firing interval data for the additional test plate armor system in accordance with the present invention is presented in Table 3.

TABLE 3

PROJECTILE VELOCITY AND INTERVAL DATA

| | Oehler [ft/s] | Phantom [ft/s] | Projectile Weight [grains] | ΔTime from HS video [ms] |
|---|---|---|---|---|
| 1 | 2787 | 2796 | 693 | N/A |
| 2 | 2792 | 2810 | 693 | 101 |
| 3 | 2782 | 2797 | 692 | 98 |

STANAG (NATO Standardization Agreement) 4496—Fragment Impact Test

The objective of the test was to impact each candidate plate in a specified quadrant with a single North Atlantic Treaty Organization (NATO) standardized fragment with a nominal mass of 18.6 grams, traveling at a velocity of 8300+/−300 ft/s.

Figure 26:
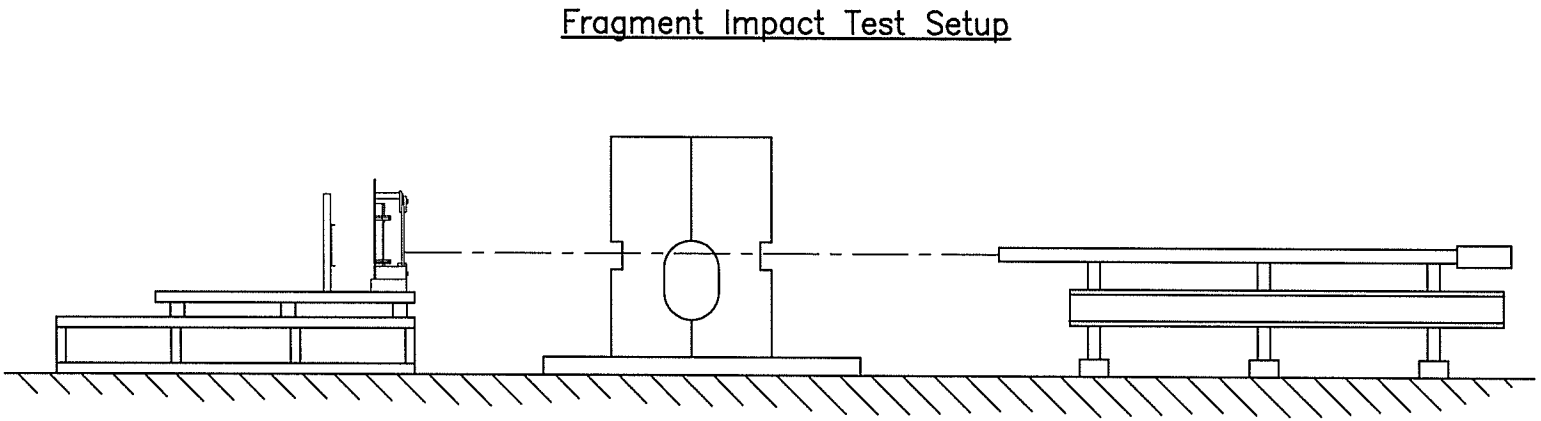
FIG. 26 is a schematic drawing of a fragment impact test configuration of the present invention.

The fragment was fired from a 40 mm High-Performance Powder Gun, which is an electrically-actuated, mechanically-fired cannon. A schematic depiction of the test site is shown in FIG. 26.

Figure 27:
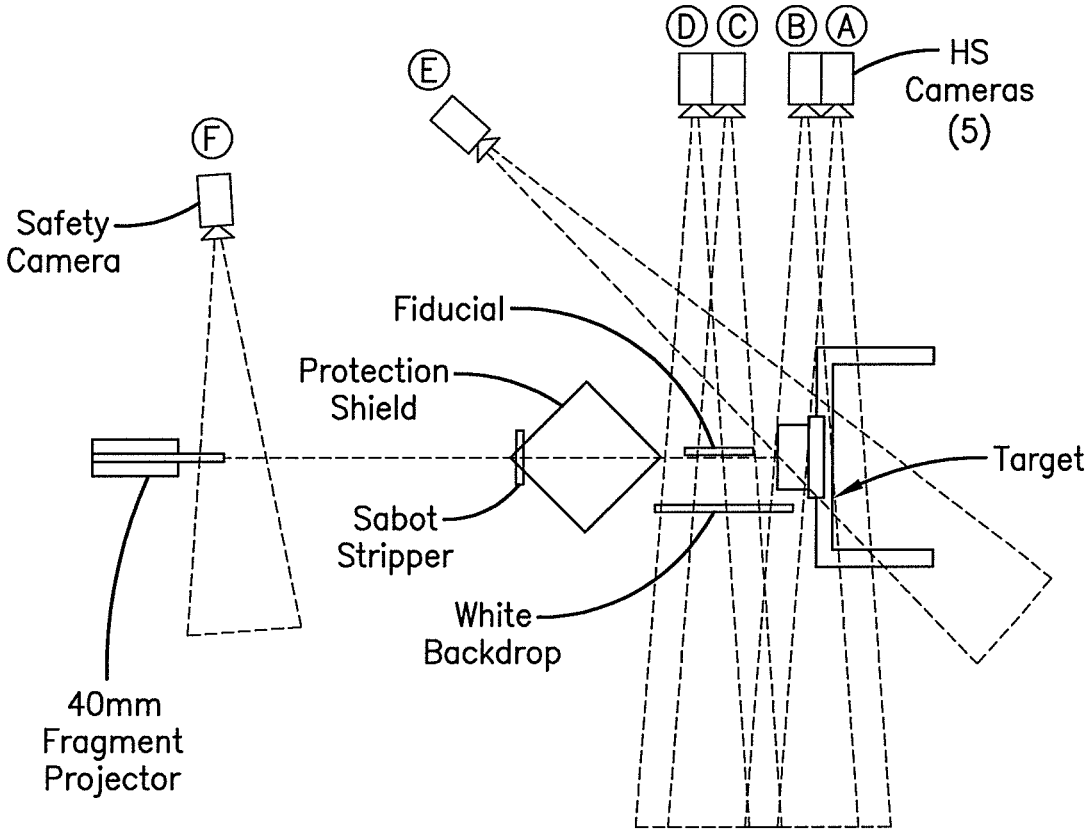
FIG. 27 is a schematic drawing of the fragment impact test instrumentation configuration of the present invention.

The instrumentation setup was as set forth as shown in FIG. 27.

Multiple cameras were used and their types and settings are described in the following Table 4. Cameras C and D were redundant units for each other.

TABLE 4

40 MM CANNON CAMERA SPECIFICATIONS

| Camera | Type | Frame Rate | Resolution | Exposure Time | Purpose |
|---|---|---|---|---|---|
| A | Phantom 7.3 | 6,400 frames/s | 800 × 600 | 3-10 μs* | Target Front/ Rear Face |
| B | Phantom 7.3 | 6,400 frames/s | 800 × 600 | 3-10 μs* | Target Front/ Rear Face |
| C | Phantom 710 | 12,000 frames/s | 1280 × 224 | 2 μs | Fragment Velocity |
| D | Phantom 710 | 12,000 frames/s | 1280 × 224 | 2 μs | Fragment Velocity |
| E | Phantom 7.3 | 6,400 frames/s | 800 × 600 | 3-10 μs* | Target Front Face |
| F | Video | 28 frames/s | standard | N/A | Muzzle safety |

*Adjusted for lighting conditions

Test Execution

Figure 28:
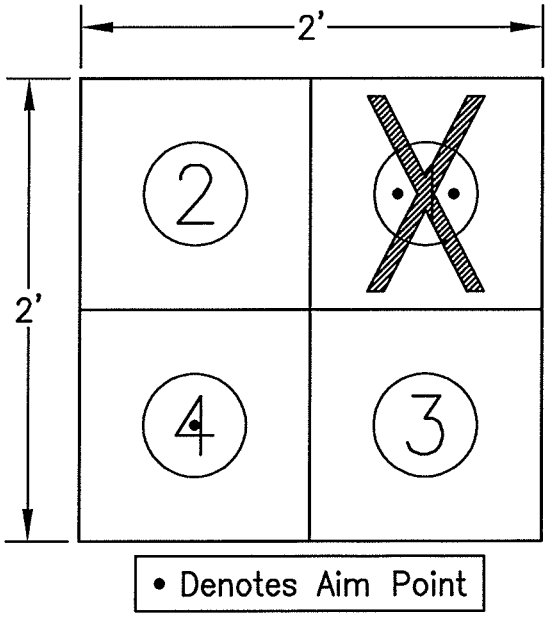
FIG. 28 is a schematic drawing of the fragment impact target points.

The same target fixture was utilized for both the bullet impact and fragment impact portions of the test. Mounting arrangements were identical, and a clean quadrant diagonally opposite of the previously targeted quadrant was used as illustrated in FIG. 28.

Test Plate

Figure 29:
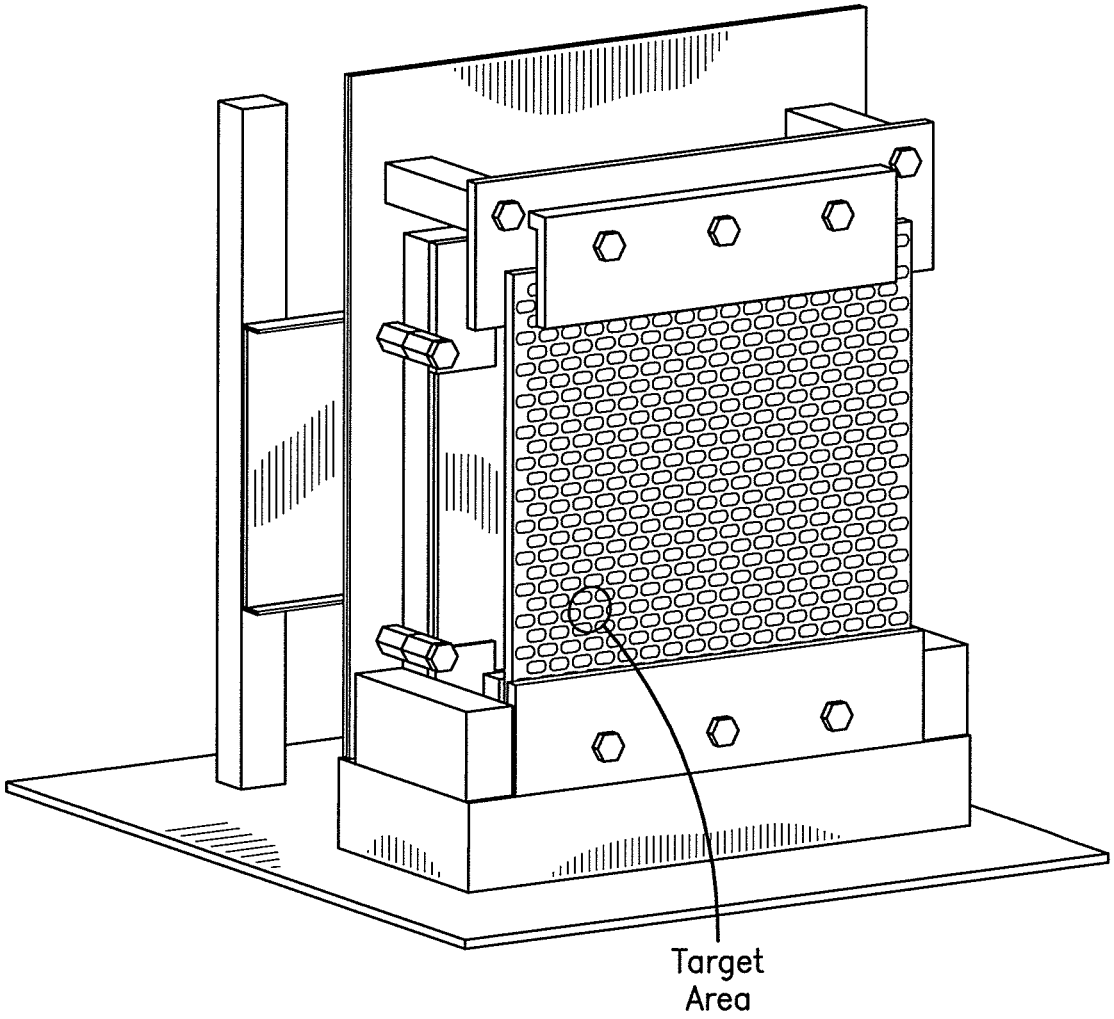
FIG. 29 is a schematic drawing of the test plate configuration pre-fragment impact test of the present invention.

The test plate was secured to the target test stand as shown in FIG. 29.

Figure 30:
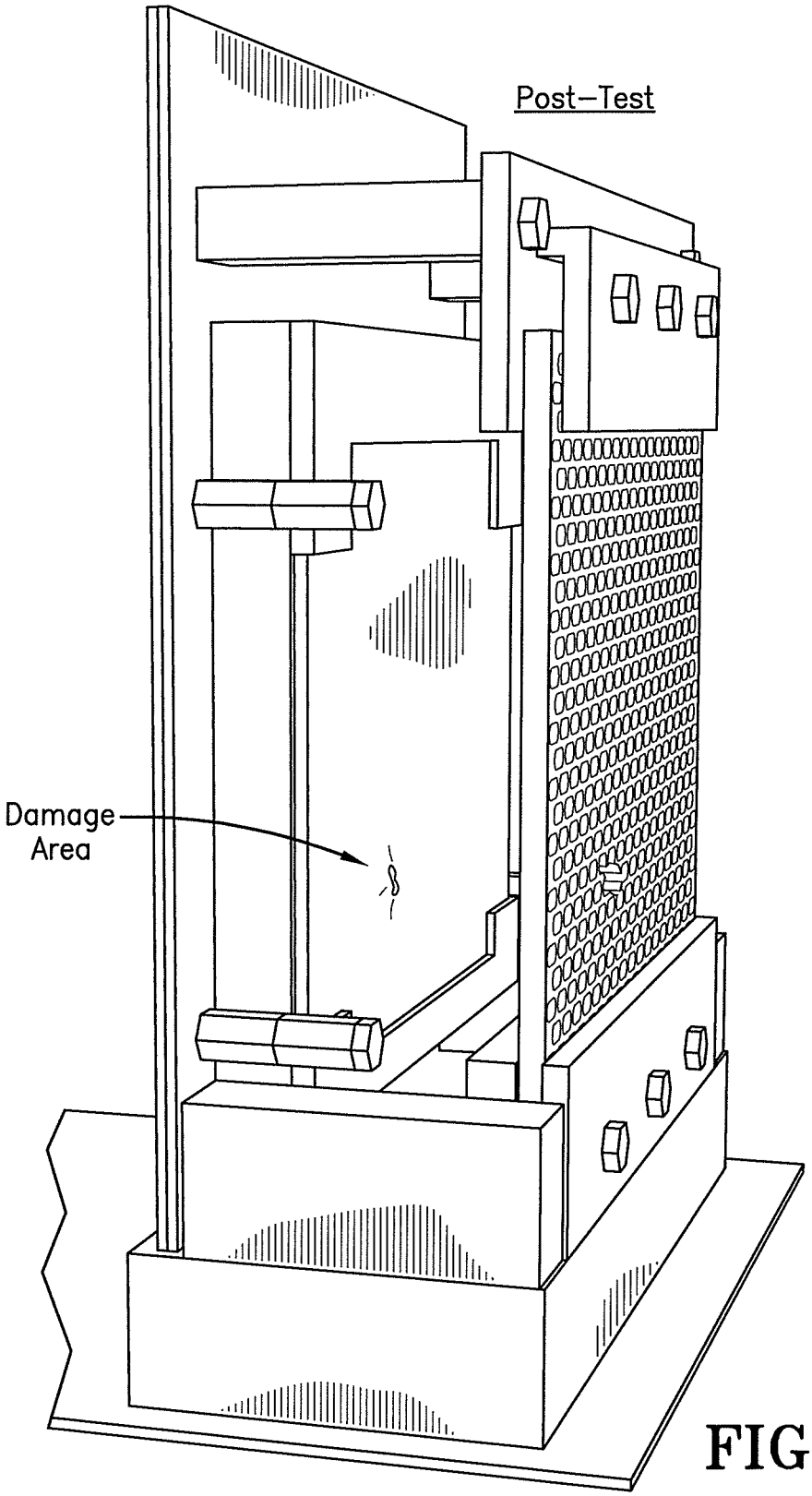
FIG. 30 is a schematic drawing of the test plate post-fragment impact test of the present invention.

A post-test inspection revealed that the fragment impacted at the intended aim point as shown in FIG. 30.

Figure 38A:
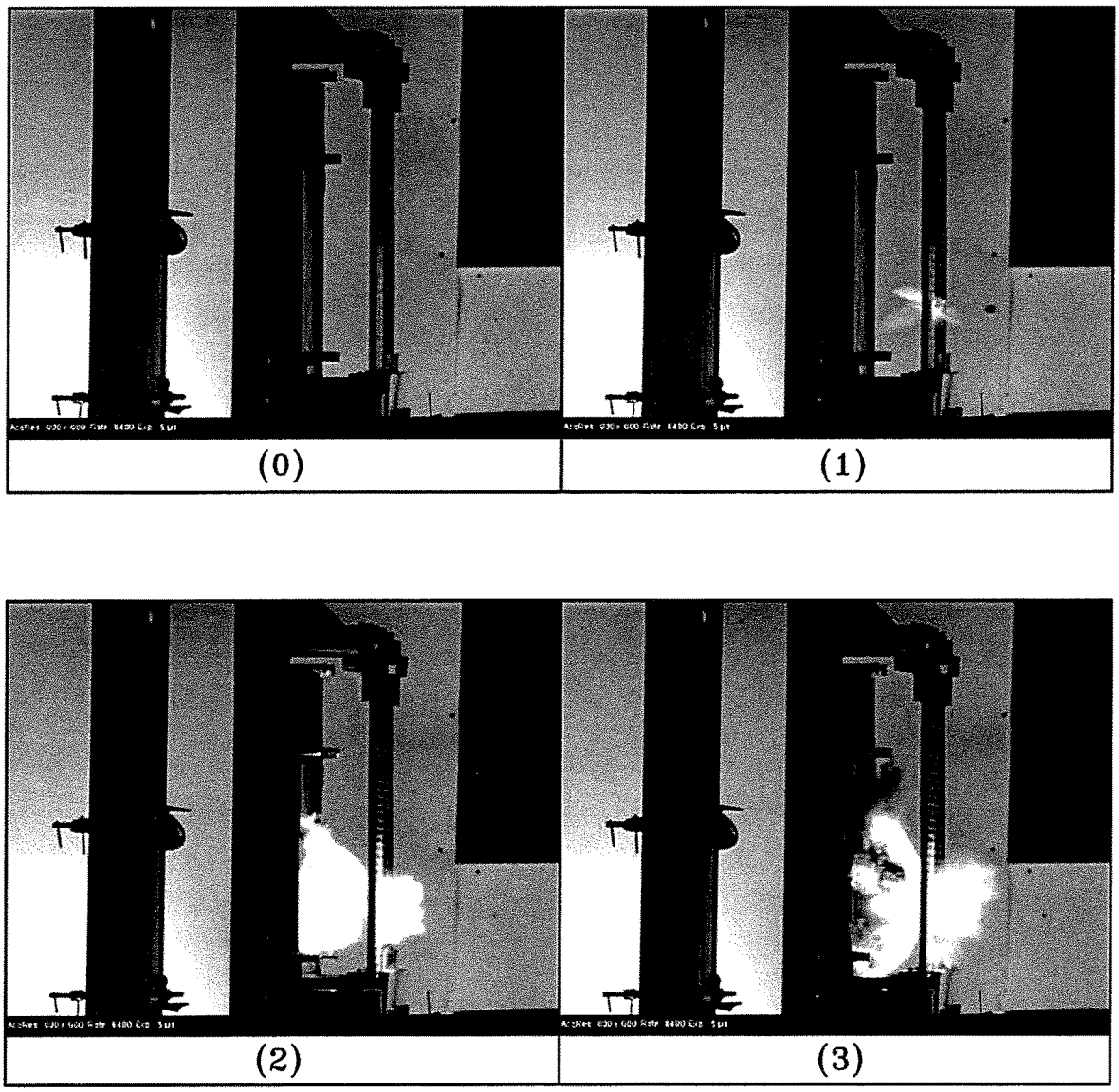
FIGS. 38A and 38B together show the test plate reactions during the fragment impact as Table 5.
Figure 38B:
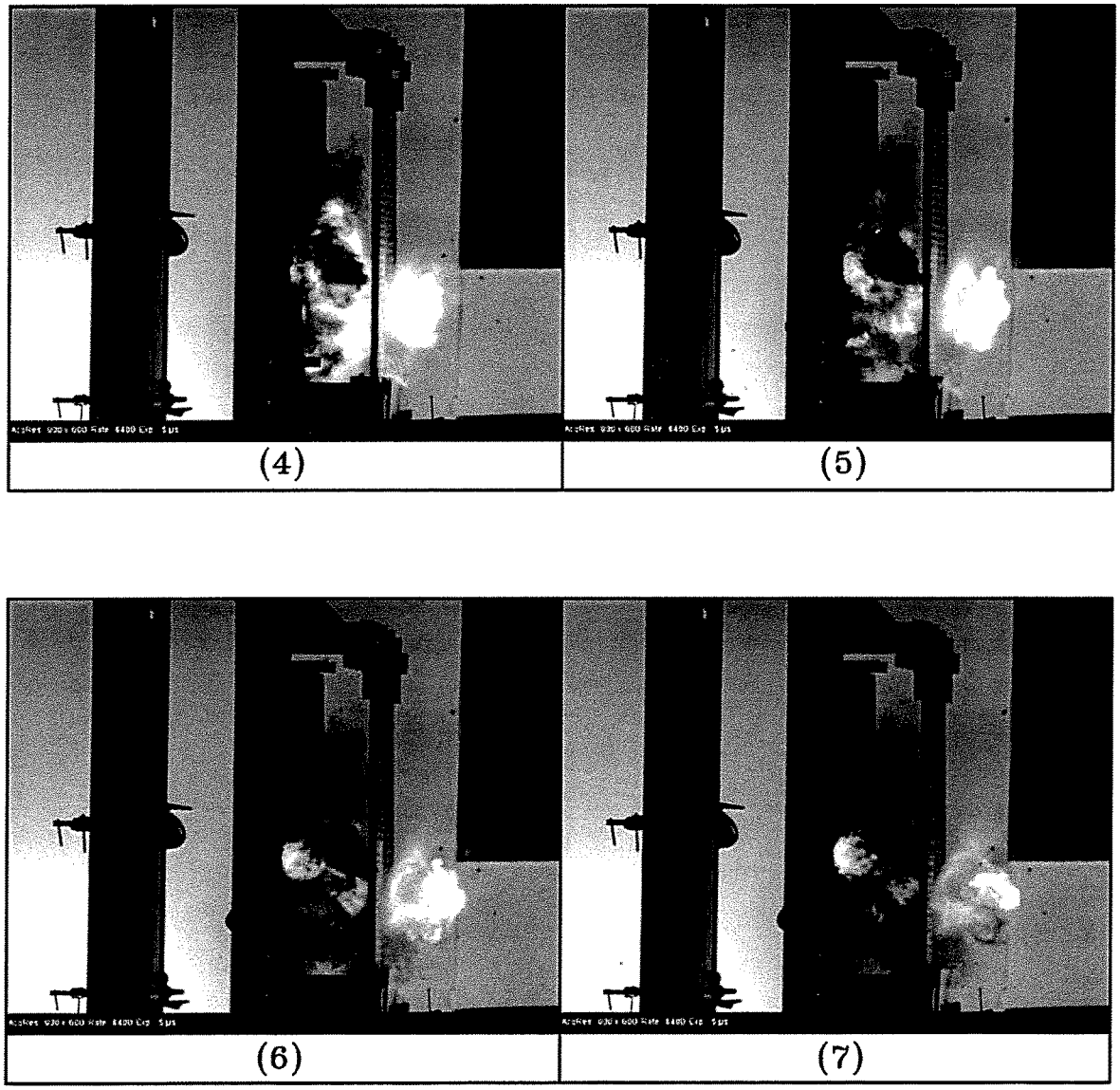

The test plate reactions during the fragment impact are shown in Table 5 (FIGS. 38A and 38B together) along with the associated frame number.

Figure 31:
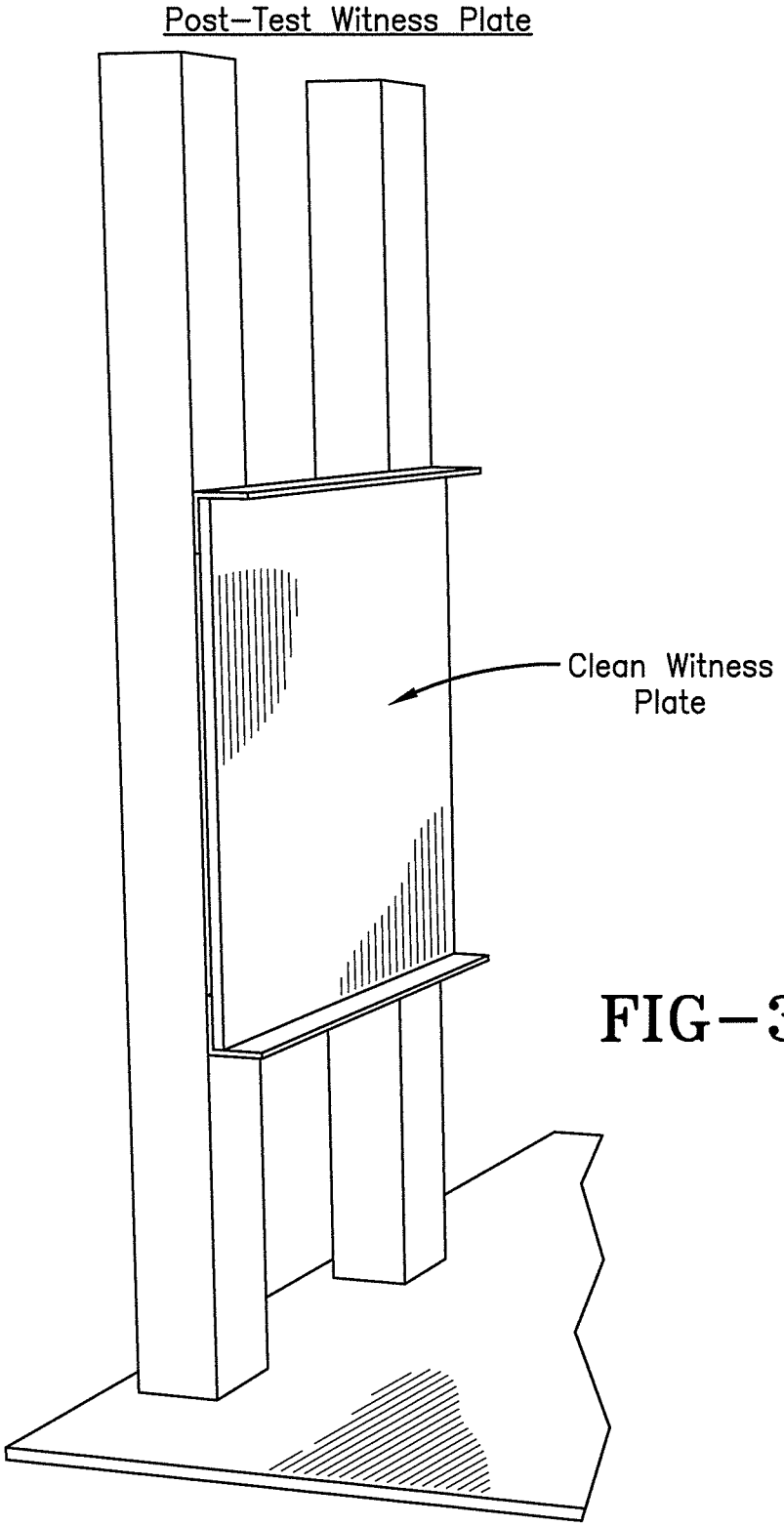
FIG. 31 is a schematic drawing of the witness plate post-fragment impact test of the present invention.

As shown in FIG. 31, the witness plate showed no evidence of fragment penetration.

The fragment velocity was measured using one primary and one redundant Phantom camera. The fragment velocity data is presented in the following Table 5.

TABLE 5

FRAGMENT PROPERTIES

| Shot Number | Phantom [ft/s] | Projectile Weight [grams] |
|---|---|---|
| 1 | 8231 | 18.5 |

Additional Test Plate

Figure 32:
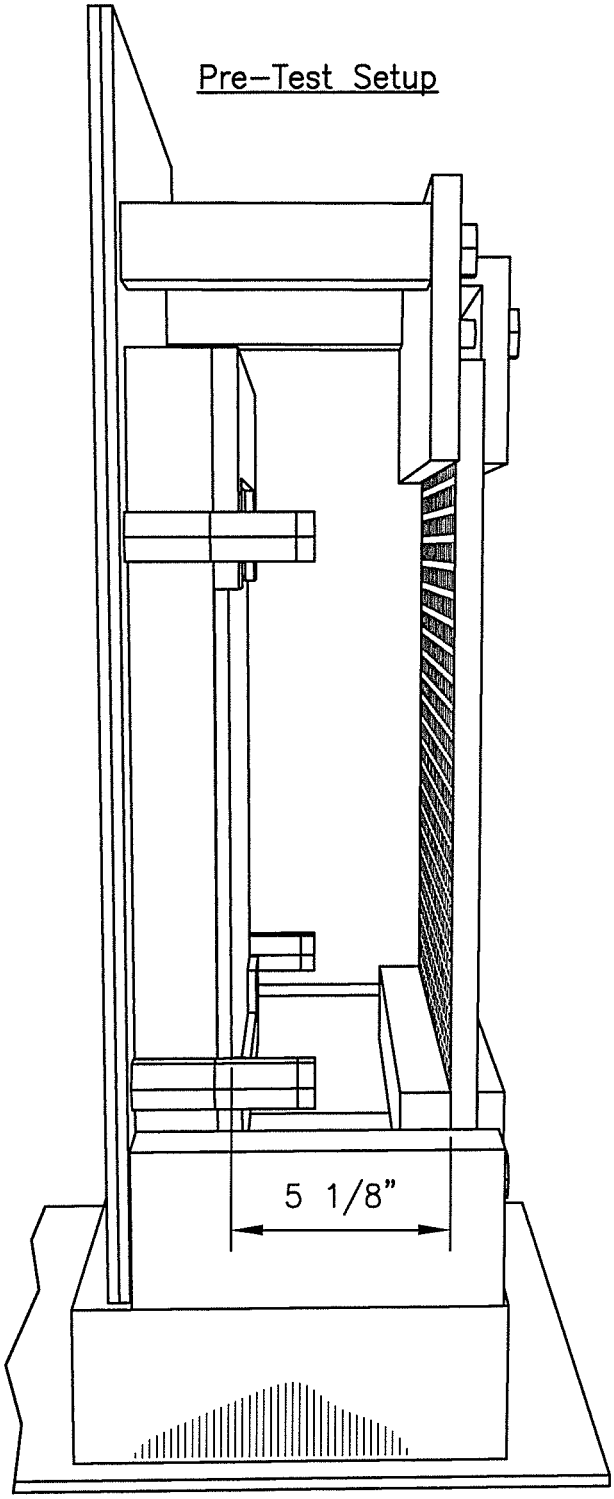
FIG. 32 is a schematic side view of the plate configuration during the fragment impact test of the present invention.

The additional test plate in accordance with the present invention was installed with the same standoff used for the bullet impact portion of the test. A distance of 5⅛-inches was measured from the back side of the grate to the face of the composite plate as shown in FIG. 32.

Figure 33A:
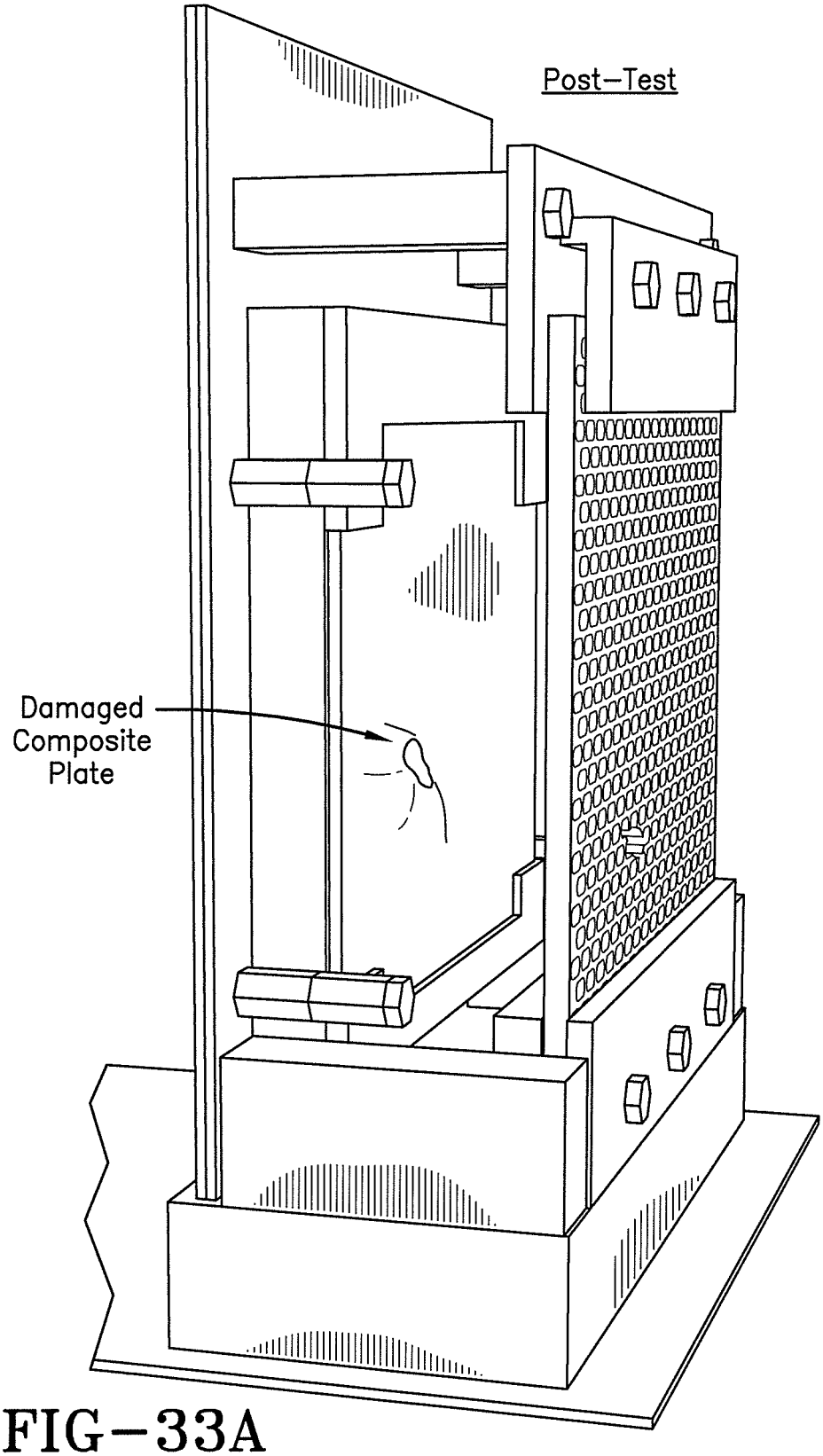
FIG. 33A is a schematic side view of the plate configuration post-fragment impact test of the present invention.
Figure 33B:
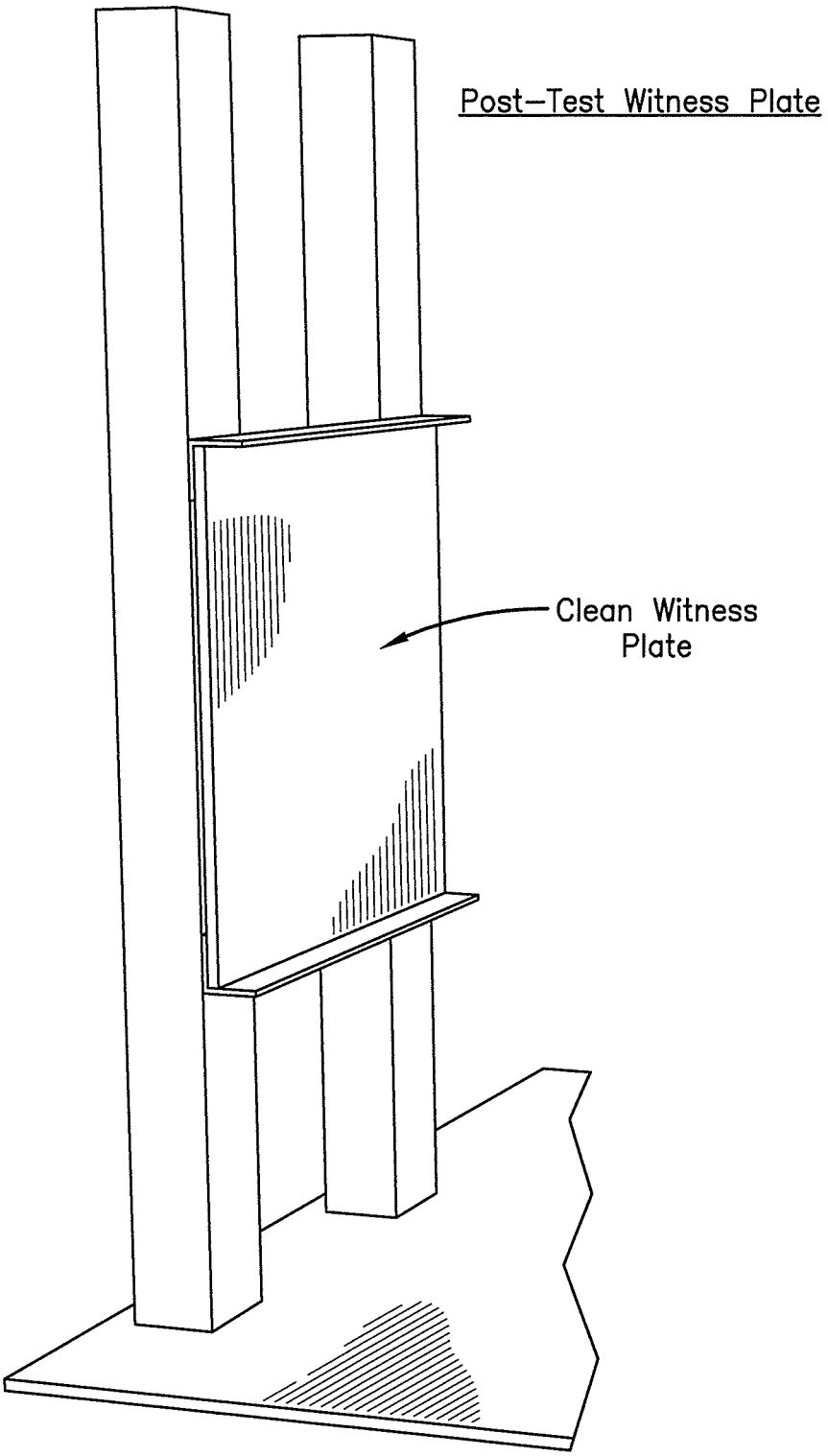
FIG. 33B is a schematic side view of the witness plate post-fragment impact test of the present invention.

The post-test inspection revealed a large amount of damage to the front of the composite plate and no damage to the witness plate, as shown in FIGS. 33A and 33B.

Figure 39A:
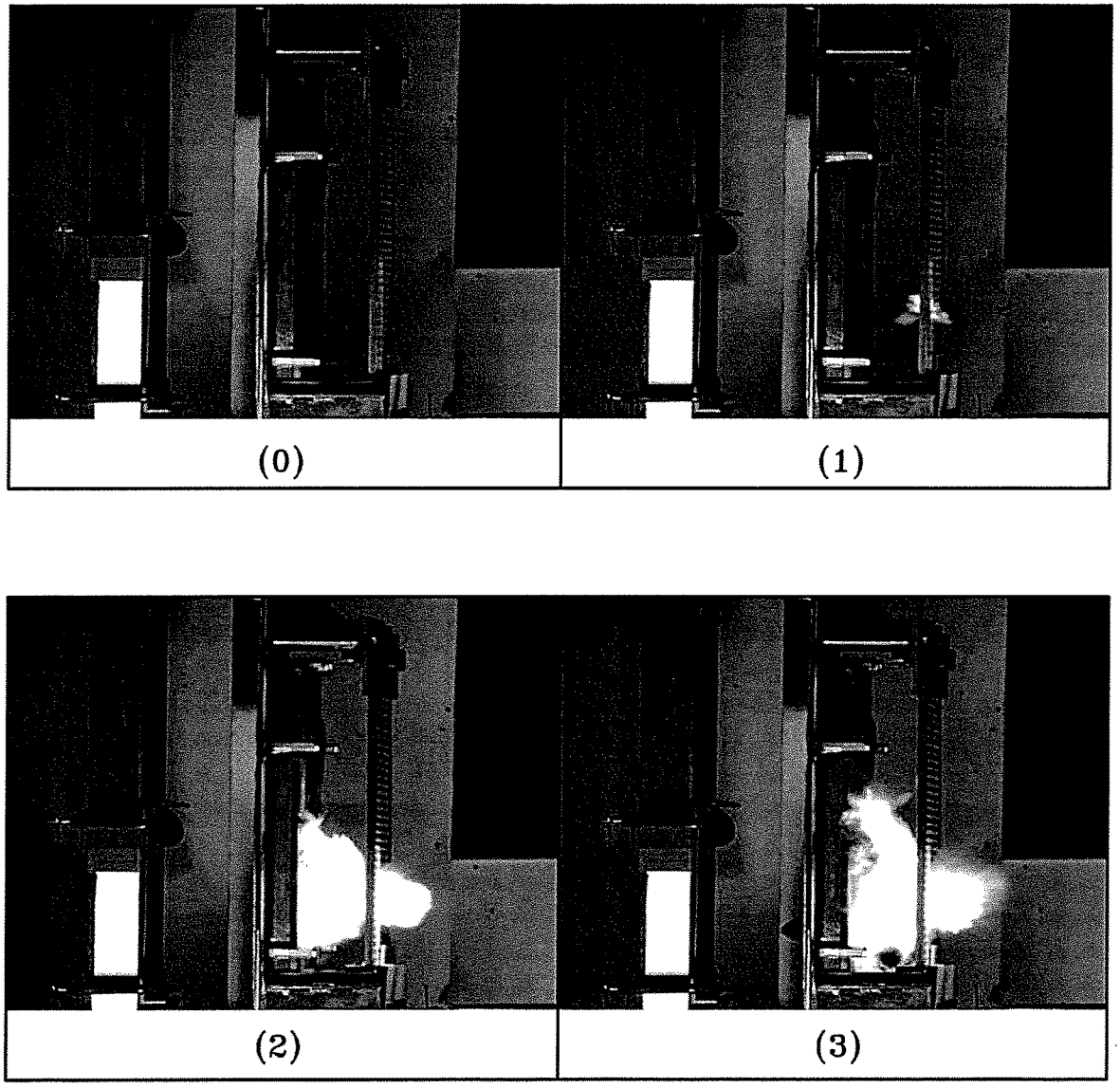
FIGS. 39A and 39B together show the reactions during the fragment impact as Table 6.
Figure 39B:
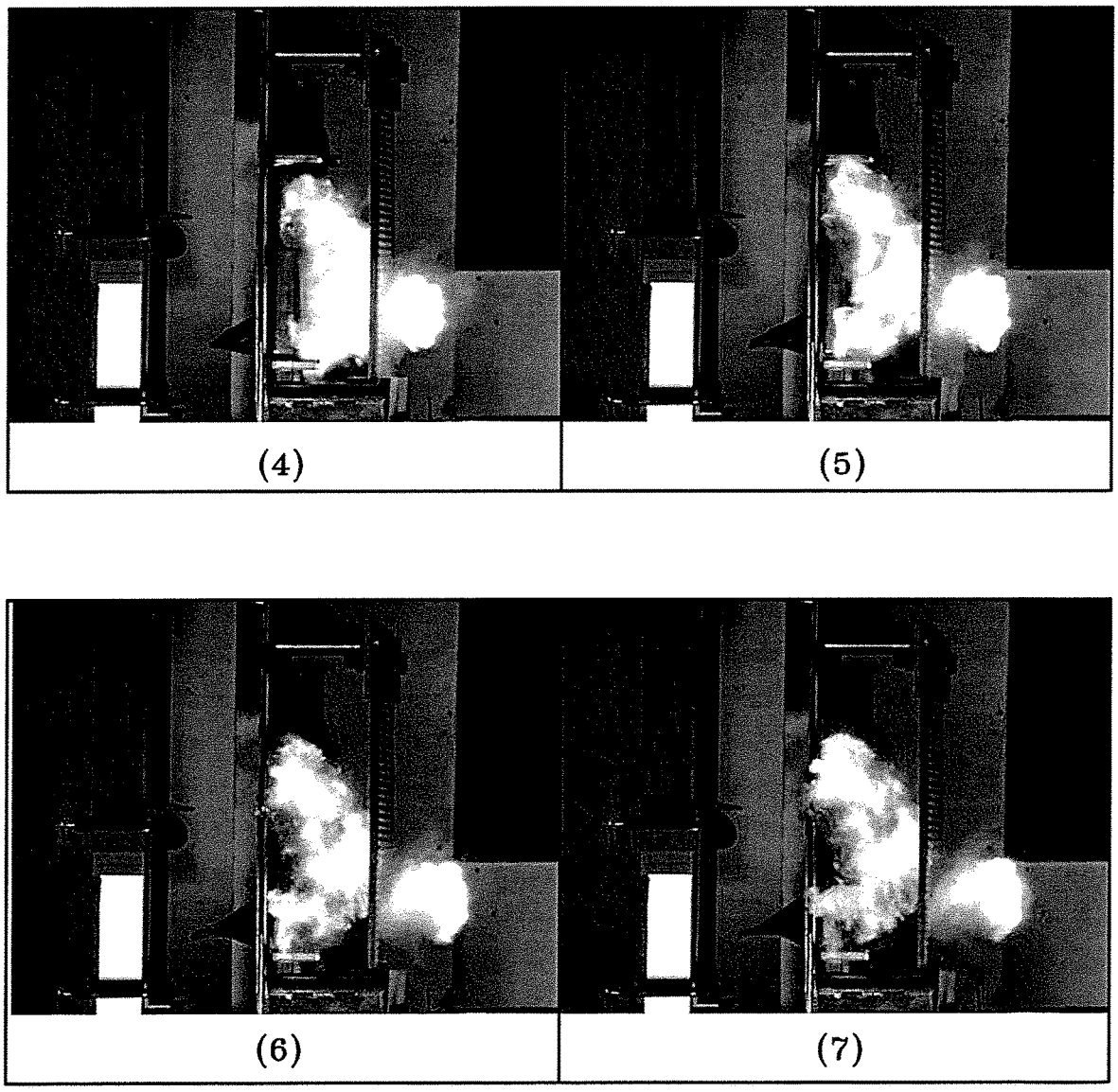

The reactions during the fragment impact are shown in Table 6 (FIGS. 39A and 39B together) along with associated frame number.

The velocity was measured using one primary and one redundant Phantom camera. The fragment velocity data is presented in the following Table 7.

TABLE 7

FRAGMENT PROPERTIES

| Shot Number | Phantom [ft/s] | Projectile Weight [grams] |
|---|---|---|
| 1 | 8207 | 18.6 |

The tests were conducted in accordance with the approved test parameters. The projectile velocities and firing intervals for the bullet impact test were in accordance with STANAG 4241. The projectile velocity for the fragment impact test was in accordance with STANAG 4496.

It should be appreciated that the armor system in accordance with the present invention may be employed in any type of appropriate application for protection against high velocity and high caliber projectiles. Such applications for employment may include, but is not limited to, individual protective systems, i.e., body armor, armor for tanks, armor for ships or boats, armor for trucks, armor for vehicles, armor for aircraft including airplanes, jets and helicopters, armor for barriers, armor for protective structures, i.e., blast panels and armor for missile containers for storage or transport.

Figure 34:
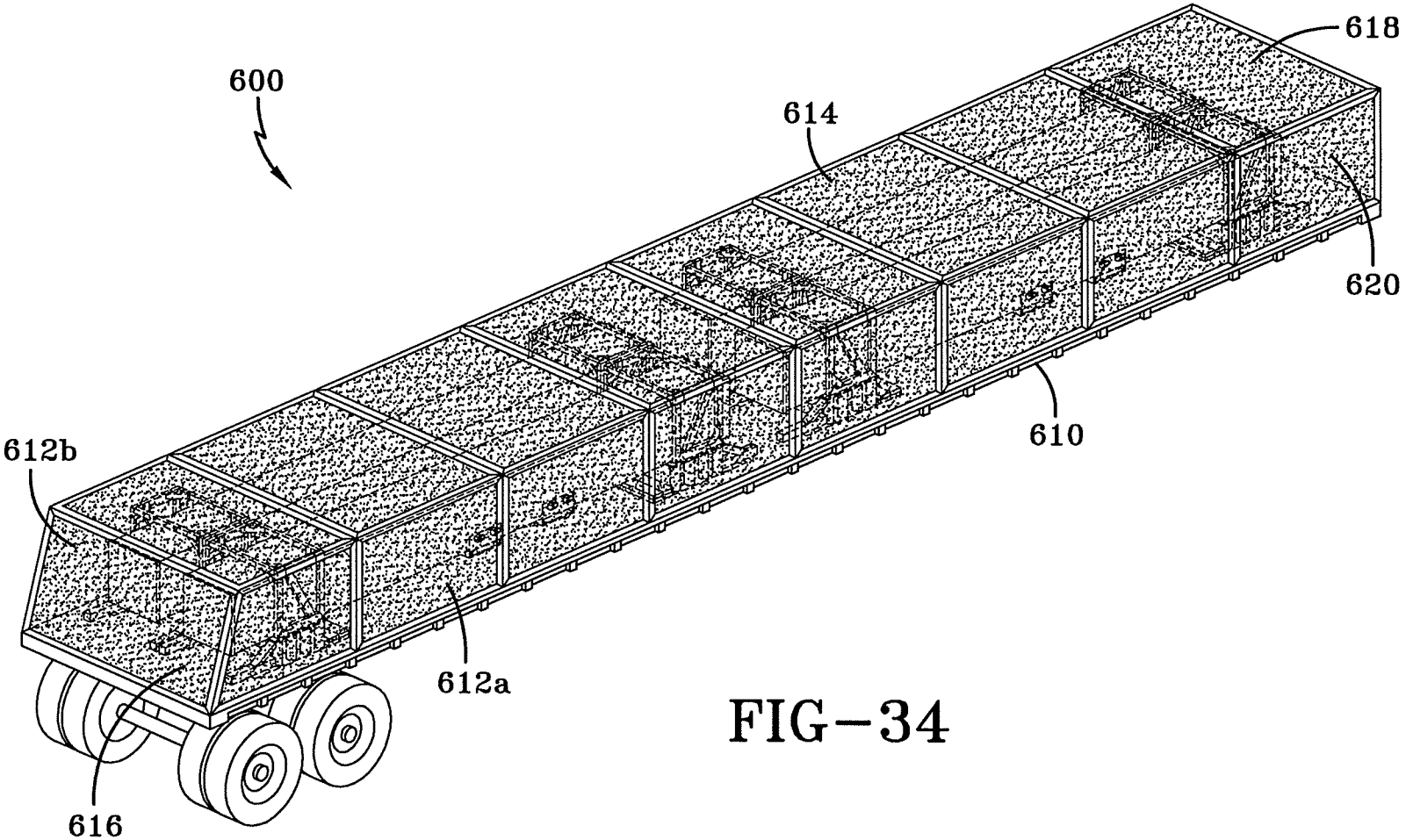
FIG. 34 is a perspective view of a semi-truck trailer for use with the armor system according to another alternative embodiment of the present invention wherein the armor system is integrally formed within the parameters of the flatbed truck trailer and as an alternative exemplary use in accordance with the present invention.

Turning now to FIG. 34, an alternative embodiment of the armor system in accordance with the present invention will be shown and described, namely for use with an armored structure, such as an armored trailer or armored shipping container and the like in which the armor system is integrally built into the respective walls, floors and ceiling of the armored structure, such as an armored trailer or armored shipping container. For purposes of illustration, the armored structure as depicted in FIG. 34 is an armored trailer. However, it should be appreciated that the armored structure is not limited to an armored trailer but can include other types of structures requiring an integral armor system including but not limited to an armored shipping container. It should be appreciated, however, that the specific application of the present invention shown in FIG. 34 is for illustrative purposes only and the armor system of the present invention should not be considered limited or exclusive to such an embodiment, application or use. Moreover, it should be further understood that the incorporation of an armor system in accordance with the present invention into the parameters of an armored trailer is not limited in such a manner, but that incorporation of such an armored system into the parameters of other types of vehicles and/or structures are within the scope of the present invention.

As shown in FIG. 34, the armored trailer system is shown generally at numeral 600. A flatbed semi-truck trailer 610 is provided and comprises a conventional configuration including two opposing walls 612*a*, 612*b*, a ceiling or roof 614, a rear end 616, a front end 618 and a floor 620 of the armored trailer system 600. It should be understood that armored trailer system 600 as shown includes a conventional rear end 616 that is configured for loading and unloading of cargo into and from armored trailer 610 in known conventional mechanisms. However, it should be understood that the armored trailer system 600 is not limited to such armored trailers for exclusive rear loading and unloading, but can also be employed with modified armored trailer systems which employ alternative methods for loading or unloading cargo conventional in the art including side loading and unloading systems or top loading and unloading systems or even combinations of the foregoing loading and unloading systems.

As shown in FIG. 34, all of opposing walls 612*a*, 612*b*, ceiling or roof 614, rear end 616, front end 618 and, optionally, floor 620 comprise the armor system of the present invention discussed herewith integrally foamed within the parameters of flatbed semi-truck trailer 610. In other words, the aforementioned described framework system is omitted in the instant alternative embodiment and the ballistic armor system is employed directly and integrally into each of opposing walls 612*a*, 612*b*, ceiling or roof 614, rear end 616, front end 618 and, optionally, floor 620 thereby forming a singular and unitary armored trailer system 600 having the ballistic armor system of the present invention integrally formed into armored trailer system 600. It should be understood that in accordance with the embodiment shown in FIG. 34, alternative comparable structures may be employed in accordance with and in the spirit of the present invention such as but not limited to armored shipping containers, armored boxes, armored rooms, armored shelters and the like.

It should be understood that the armored trailer system 600 need not be limited to the particular application described herein of carrying cargo in the nature of missiles, but rather can be modified for protection of alternative types of cargo that might be less sensitive or less vulnerable. For example, the threats against an armored trailer for transport can be defined by the particular classes of weapons that are mobile, can be fired by an individual or individuals can engage a moving type target at a given range, including small arms to heavy machine gun threats, and fragments from roadside improvised explosive devices (IEDs). It should be further understood that kinetic energy threats, for example, can include but are not limited to threats ranging in caliber from about 5 mm-15 mm, more particularly from about 5.45 mm to about 14.5 mm, in both steel and tungsten carbide cores. Still further, these threats can be fired from single and multiple shot assault weapons, sniper rifles and machine guns at near or extended ranges. Even further, it should be understood that the presently claimed armored trailer system 600 can protect against a second class of threats including but not limited to IED type weapons that can be simulated in testing by fragment simulating projectiles (FSP) in calibers up to 20 mm in diameter.

In accordance with the present alternative embodiment of the present invention, the armored trailer system 600 of the present invention comprises a weight in the range of about 18-35 psf for use with missile canister protection systems for munitions, and comprises a weight in the range of about 1-35 psf for use in carrying other types of cargo. More particularly, in accordance with the present invention, the armor system comprises a weight of no greater than about 29 psf in the embodiment in which the present invention is employed for use with a missile canister armor system for munitions. Even more particularly, in accordance with the present invention, the armor system comprises a weight of about 23 psf in the embodiment in which the present invention is employed for use with a missile canister armor system for munitions. Still further, the armored trailer system 600 in accordance with the present alternative embodiment of the present invention can have a total thickness of about 8.0 inches as set forth above, and can be further modified by elimination of certain components and/or materials. For example, metal strike face plate may be an optional metal strike face plate in accordance with the armored trailer system 600 of the alternative embodiment of the present invention and may comprise a material including but not limited to carbon steels, alloyed steels, stainless steels or titanium. In other words, metal strike face plate may be omitted in armored trailer system 600 depending on the required level of protection desired for the particular cargo being protected. The airspace according to armored trailer system 600 may be in the range of about 0 inches (i.e., negligible or no airspace) to about 10 inches. The rear composite layer of armored trailer system 600 may comprise any material as described above, including but not limited to polyethylene, aramid- or glass-based composite materials. In accordance with the present invention, the respective weights meet those that are needed by the particular application of use with which the present invention is employed. It should be further appreciated that each of two opposing walls 612*a*, 612*b*, ceiling or roof 614, rear end 616, front end 618 and floor 620 which are integrally formed with the armor system of the present invention may be joined to each other or otherwise interconnected by mechanisms known in the art, such as but not limited to welding, conventional threaded bolt and nut securing mechanisms and the like, or any other comparable mechanisms that are conventional in the art.

Additional Examples

Table 8A below sets forth and describes testing results regarding armor systems comprising perforated titanium/polymer composite backing for 30 caliber armor-piercing (APM2) threats. "Total weight" in Table 8A is shown as "pounds per square feet" and "velocity" is shown as "feet per second."

TABLE 8A

| Design # | Total Weight | Shot# | Velocity | Penetration |
|---|---|---|---|---|
| 9 | 8.52 | 1 | 2856 | Full |
| | | 2 | 2873 | Partial |
| 9 | 10.32 | 1 | 2866 | Partial |
| | | 2 | | Partial |
| | | 3 | 2880 | Partial |
| 12 | 10.16 | 1 | 2870 | Partial |
| 14 | 10.78 | 1 | 2865 | Partial |
| | | 2 | 2870 | Full |

TABLE 8A-continued

| Design # | Total Weight | Shot# | Velocity | Penetration |
|---|---|---|---|---|
| 16 | 8.78 | 1 | 2875 | Partial |
| | | 1 | 2862 | Partial |
| | | 2 | 2858 | Partial |

Table 8B below sets forth and describes additional testing results regarding light weight armor systems for defeating 30 caliber M2AP projectiles. Weights of 7.1 to 10.4 psf are shown. All systems tested comprise at least one perforated metal strike plate, a 2" space, and a corresponding composite backing.

TABLE 8B

| 30 caliber M2AP Test | | | | | | |
|---|---|---|---|---|---|---|
| | | | Shot 1 | | Shot 2 | |
| Sample # | Thickness | psf | Velocity | Result | Velocity | Result |
| 031615-07M | | 10.3 | 2850 | full penetration | 2857 | partial penetration |
| 031615-08S | | 10.4 | 2691 | partial penetration | 2816 | partial penetration |
| 031615-09S | | 9.1 | 2833 | partial penetration | 2863 | full penetration |
| 031615-10S | | 8.1 | 2851 | partial penetration | 2810 | full penetration |
| 031615-11S | | 7.1 | 2827 | partial penetration | | |

Testing of Tables 8A and 8B demonstrates that the perforated metal and composite backing configuration in accordance with the present invention is effective at stopping 30 cal APM2 threats at weights as low as 7.1 psf. This system could be employed as an armor system for aircraft, vehicles, shields, shelters, body armor, and the like.

Table 9 below sets forth and describes testing results regarding light weight armor systems having a weight of 5.6 psf employing a perforated hardened steel plate/polymer composite having UHMWPE for use with armored vehicles with both threats shot at the same panel.

TABLE 9

| Threat | Velocity (ft/sec) | Result |
|---|---|---|
| 5.56 × 45 M193 | 3243 | Partial Penetration |
| SS 109 (M855 equivalent) | 3094 | Partial Penetration |

Tables 10-18 below set forth and describe background information and testing results regarding light weight armor systems employing a perforated hardened steel plate/polymer composite having S-Glass for use with structures such as missile canisters for insensitive munitions requirements compliance.

Tables 10-18 below set forth and describe background information and testing results regarding light weight armor systems for insensitive munitions (IM) bullet impact/fragment impact (BI/FI) testing. In particular, a design for Type V non-propulsive burning reaction were done to limit canister penetrations to "below threshold" impacts, as well as to maximize breakup damage to the impactor and to spread debris and rotate the penetrator to increase the surface area of impact. Weights of 6.2 psf and 5.6 psf are shown in Tables 10-15. Insensitive munitions (IM) are defined as munitions which reliably fulfill (specified) performance, readiness and operational requirements on demand but which minimize the probability of inadvertent initiation and severity of subsequent collateral damage to the weapon platforms, logistic systems and personnel when subjected to unplanned stimuli. IM test methodologies and compliance requirements defined by MIL-STD-2105(D) and supporting Standard NATO Agreements (STANAGs) include testing for fast cook off, slow cook off, bullet impact, fragment impact, sympathetic reaction and shaped charged jet impact. IM assessments includes Type I-Type VI, as summarized below, with each IM test having a maximum allowable reaction requirement. For example, shaped charged jet requires reaction of Type III or better and bullet and fragment impact require reaction of Type V or better.

TABLE 10

| Reactions | Description |
|---|---|
| Type I detonation | Prompt consumption of all energetic materials; shockwave equal to calculation; large ground craters |
| Type II partial detonation | Intense shockwave equal to calculation; damage to neighboring structures; large ground craters |
| Type III Explosion | Rapid combustion of energetic material; long distance scattering of fragments; small craters |
| Type IV Deflagration | Combustion of some or all of the energetic materials; at least one piece travels more than 15 m |
| Type V burn | Low pressure burn of some or all of the energetic materials; no item travels more than 15 m |
| Type VI no reaction | No reaction of the energetic materials without a continued external stimulus |

TABLE 11

| 6.2psf "Triple 0.50-Cal."Projectile Data | | | | |
|---|---|---|---|---|
| Shot Number | Projectile Velocity ft/sec (1-2) | Projectile Velocity ft/sec (2-3) | Strike Velocity ft/sec | Exit Velocity ft/sec |
| 1 | 2785.9 | 2785.5 | 2781.1 | 2453.9 |
| 2 | 2824.5 | 2823.3 | 2809.8 | 2670.2 |
| 3 | 2840.7 | 2840.3 | 2835.8 | 2560.8 |

Average Strike Velocity = 2808.9 fps

Average Exit Velocity = 2561.6 fps (247.3 fps reduction)

All three (3) penetrators were tipped and caught broad side in the "Catcher Panel" and Shot Number two (2) was cracked and separated into two (2) separate "fragments".

TABLE 12

| 5.6psf System "Triple 0.50-Cal Bullet" Projectile Data | | | | |
|---|---|---|---|---|
| Shot Number | Projectile Velocity ft/sec (1-2) | Projectile Velocity ft/sec (2-3) | Strike Velocity ft/sec | Exit Velocity ft/sec |
| 1 | 2846.6 | 2845 | 2826.7 | 2531.6 |
| 2 | 2834.9 | 2834.5 | 2830 | 2570.6 |
| 3 | 2855.9 | 2825.5 | 2813.5 | 2534.8 |

Average Strike Velocity = 2823.4 fps

Average Exit Velocity = 2545.6 fps. (277.8 fps reduction)

All three (3) penetrators were tipped and caught broad side in the "Catcher Panel". No penetrators were fractured.

TABLE 13

| 6.2psf System 0.50 cal FSP Projectile Data | | | | |
|---|---|---|---|---|
| Shot Number | Projectile Velocity ft/sec (1-2) | Projectile Velocity ft/sec (2-3) | Strike Velocity ft/sec | Exit Velocity ft/sec |
| 1 | 4548 | 4507.6 | 4052.2 | 1357.7 |

FSP was slowed 2694.5 fps from the Strike Velocity

The FSP was also substantially deformed in length as well as being fractured approximately one fifth of its original mass.

TABLE 14

| 5.6psf System 0.50 cal FSP Projectile Data | | | | |
|---|---|---|---|---|
| Shot Number | Projectile Velocity ft/sec (1-2) | Projectile Velocity ft/sec (2-3) | Strike Velocity ft/sec | Exit Velocity ft/sec |
| 1 | 4589.3 | 4548.6 | 4090.6 | 2538 |

FSP was slowed 1552.6 fps from the Strike Velocity

The FSP also appears to be substantially deformed and broken up as determined by visual inspection of the "Catcher Panel" as no fragments of the FSP were located

- Tested two metal/composite designs: 5.6 psf and 6.2 psf
  - Utilized only materials in ATC's inventory
  - Non-optimized designs
- Both panels were ~0.25" thick
  - Test included 0.25" glass epoxy panel as a canister simulator material placed 2" behind ballistic panel
- Modified STANAG 4241 testing protocol was used
  - Three 50-Cal APM2 shots in 5 cm diameter; non-burst
  - Allows target inspection/damage evaluation after each shot
  - Same post-test cumulative response on armor as burst
- Measurement of exit velocities
- Catcher plate used to catch penetrators for post test analysis

TABLE 15

| Energy reduction of about 50% is shown | | | | |
|---|---|---|---|---|
| | 5.6 psf Strikeface | | 6.2 psf Strikeface | |
| Shot No. | Impact Velocity (fps) | Exit Velocity (fps) | Impact Velocity (fps) | Exit Velocity (fps) |
| 1 | 2826.7 | 2531.6 | 2781.1 | 2453.9 |
| 2 | 2830.0 | 2570.6 | 2809.8 | 2670.2 |
| 3 | 2813.5 | 2534.8 | 2835.8 | 2560.8 |
| Average Velocity | 2823.4 | 2545.7 | 2808.9 | 2561.6 |
| Average velocity loss | 277.7 | | 247.3 | |
| Comments | All three penetrators were tipped<br>Jacket stripped from all three penetrators<br>9.8% velocity loss<br>No penetrator fracturing | | All three penetrators were tipped and caught broad side in the catcher Panel<br>Jacket stripped from all three penetrators<br>8.8% velocity loss<br>Shot 2 fragmented | |

Tables 16-17 below set forth and describe background information and testing results regarding light weight armor systems for insensitive munitions (IM) bullet impact/fragment impact (BI/FI) testing. Weights of 4.7 to 7.7 psf are shown.

TABLE 16

| |
|---|
| Tested designs 4.7 psf to 7.7 psf |
| Utilized only materials in ATC's inventory |
| Non-optimized designs |
| Panels were approximately 0.25" thick |
| Test included 0.25" glass epoxy panel as a canister simulator material placed 2" behind ballistic panel |
| Systems were tested against the 0.50 cal.M2AP threat, single shot fired at 850 +/− 20 m/s. |
| Exit velocities were measured and a catcher plate was used to catch penetrators |

TABLE 17

| Energy reduction of greater than 50% is shown | | | | | | | |
|---|---|---|---|---|---|---|---|
| Panel No. | Panel Wt. psf. | Strike velocity fps. | Strike Energy ft/lbs | Exit Velocity fps. | Exit Energy ft/lbs | % Energy Reduction | Strike/Exit Velocity Difference fps. |
| 61314-17 | 7.2 | 2850 | 12626 | 2663 | 6298 | 50.12% | 187 |
| 61314-18 | 5.2 | 2843 | 12562 | 2642 | 6198 | 50.66% | 210 |
| 61314-19 | 7.7 | 2834 | 12478 | 2516 | 5620 | 54.96% | 318 |
| 61314-22 | 4.7 | 2824 | 12396 | 2591 | 5960 | 51.92% | 234 |

Testing of Table 17 reflects copper jacket and lead stripped from the tested bullet/projectile (weighing about 45 g) while only a core of approximately 25.9 g would pass through the respective canister. 44% mass reduction after exit of the test panel is shown which reflects substantial energy reduction.

In view of testing results set forth in Tables 14-17, it is shown that in accordance with the present invention a test projectile is significantly disrupted at an areal density of about 4.7 psf to about 7.7 psf. Specifically, it is shown that the jacket/lead is stripped thereby reducing mass reduction by about 44%, a velocity reduction of about 7-10%, a significant amount of the penetrator tipping energy is spread over a wider impact zone, penetrator fracturing can occur and about a 50% penetrator energy reduction due to armor interaction, i.e., energy reduction primarily due to mass reduction. The testing indicates that the armor systems have a high probability of enabling munitions to meet the insensitive munitions requirements for bullet impact.

Table 18 below sets forth and describes testing results regarding light weight armor systems for 14.3 mm fragment impact testing for insensitive munitions compliance. Weights of 4.2 to 6.7 psf are shown.

TABLE 18

14.3 mm Fragment Test

| Sample # | Thickness | psf | Velocity (fps) Impact | Velocity (fps) Exit | Comments |
|---|---|---|---|---|---|
| 031615-01M | 6 mm | 6.7 | 4371 | NA | 1 piece; penetrated 3 witness plates |
| 031615-02M | 6 mm | 6.7 | 4428 | NA | 1 piece; penetrated 3 witness plates |
| 031615-03S | .25" | 6.2 | 4429 | NA | 2 pieces; penetrated 3 witness plates |
| 031615-04S | .22" | 5.2 | 4425 | NA | 3 pieces; penetrated 3 witness plates |
| 031615-05S | .18" | 4.2 | 4444 | NA | 4 pieces; penetrated 4 witness plates |
| 031615-06S | .25" | 6.2 | 4417 | NA | 2 pieces; penetrated 3 witness plates |

Testing of Table 18 demonstrates that the armor system can significant disrupt and deflect the 14.3 mm FSP and provides an increased likelihood that munitions will be able to meet the insensitive munitions requirements for fragment impact.

Figure 40:
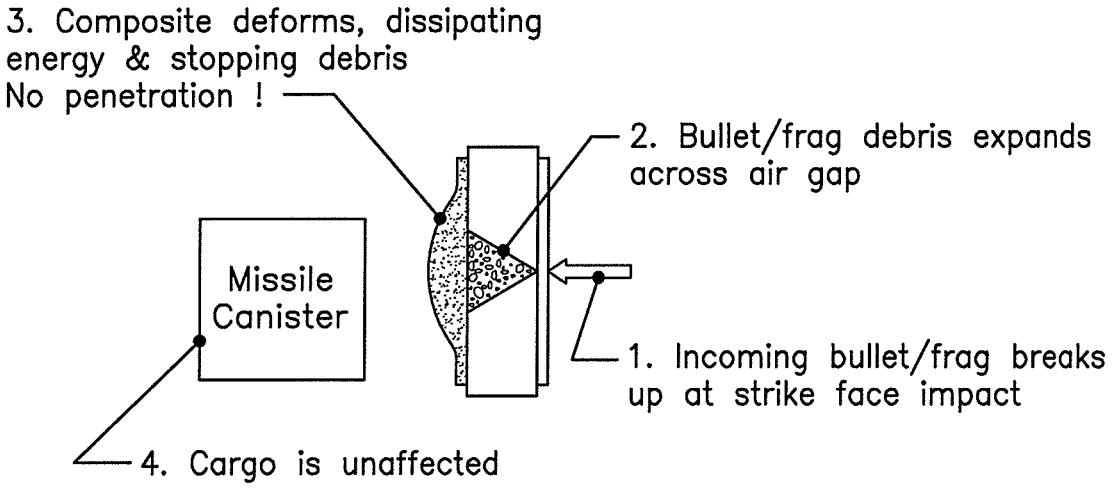
FIG. 40 shows a schematic rendering of a TPS (transportation protection system) in accordance with any embodiment of the present invention.

A schematic rendering of a TPS (transportation protection system) in accordance with any embodiment of the present invention is shown at FIG. 40.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

We claim:

1. A lightweight ballistic armor system for protection against projectiles consisting of:

at least one metal strike face plate in the range of 1-3 metal strike face plates and having a predetermined defined thickness and comprising a plurality of slotted holes, said holes being sufficiently small to prevent the passage of a projectile therethrough;

at least one laminate composite backing material secured to at least one of said metal strike face plates, wherein said laminate composite backing material comprises a cross-sectional composition of a backing material of fibers being at least one material selected from the group comprising aramid fiber, S-glass, E-glass and UHMWPE, and being in combination with a polymer resin-based binder material;

an environmentally insensitive layer comprising a polymer or metal applied directly onto at least one surface of said at least one laminate composite backing material; and wherein said system has a weight in the range of about 4-15 psf for defeating energy of a projectile, wherein said at least one of said metal strike face plates that is secured to said at least one laminate composite backing material includes a proximate metal strike face plate that is proximate to said laminate composite backing material, said proximate metal strike face plate and said composite backing material being separated by a space to define a distance therebetween, wherein said space comprises a distance in a range between about ¼ to about 4 inches, and wherein said lightweight ballistic armor system at least meets the appropriate military ballistic specifications and test requirements defined in STANAG 4241 by stopping three (3) 50-caliber bullets shot at a velocity of 850±20 m/s within a 5 cm diameter area and shot in a time interval of 1/10 second apart.

2. The lightweight ballistic armor system according to claim 1, wherein said metal strike face plates comprise at least one material selected from the group consisting of steel, perforated hardened steel, steel alloys, aluminum, magnesium and titanium.

3. The lightweight ballistic armor system according to claim 2, wherein said metal strike face plates comprise a ductile cast iron material.

4. The lightweight ballistic armor system according to claim 1, wherein said metal strike face plates comprise a total thickness in the range from about 0.10 inch-1.5 inches each.

5. The lightweight ballistic armor system according to claim 4, wherein said metal strike face plates comprise a thickness in the range from about 0.15 inch to 0.65 inch each.

6. The lightweight ballistic armor system according to claim 5, wherein said metal strike face plates comprise a thickness in the range from about 0.25 inch to 0.50 inch each.

7. The lightweight ballistic armor system according to claim 1, wherein said laminate composite backing material comprises a cross-sectional composition of a backing material of fibers selected from the group consisting of aramid fiber, S-glass, E-glass, polypropylene, and UHMWPE, and being in combination with a polymer resin-based binder material selected from the group consisting of silicones, epoxies, urethanes, polyethylenes, polyurethanes and polyureas.

8. The lightweight ballistic armor system according to claim 1, further comprising an energy-absorbing foam, wherein the proximate metal strike face plate and said composite backing material are separated by said energy-absorbing foam for filling said distance, wherein said energy-absorbing foam is a low density foam selected from the group consisting of a polyurethane-based foam and a polypropylene-based foam.

9. The lightweight ballistic armor system according to claim 1, further comprising an additional protective layer selected from the group consisting of a polymer, a composite layer and a metal skin layer for covering the front face of either or both of said at least two metal strike face plates, wherein said additional protective layer comprises a material being the same as or different from the material of said metal strike face plate and having a thickness in the range from about 1/32 inch to about 1/4 inch.

10. The lightweight ballistic armor system according to claim 1, wherein said plurality of slotted holes are set at an angle of up to about 35° relative to the vertical orientation of either or both of said two or more metal strike face plates.

11. The lightweight ballistic armor system according to claim 1, wherein said laminate composite backing material comprises a thickness in the range of about 0.1 to 4 inches.

12. The lightweight ballistic armor system according to claim 11, wherein said laminate composite backing material comprises a thickness of about 0.1 to 2 inches.

13. The lightweight ballistic armor system according to claim 1, wherein said metal strike face plate and said laminate composite backing material are bonded directly together by a method selected from the group consisting of a urethane bonding, a polymer bonding and a polyurethane bonding or are secured together by a mechanical threaded securing mechanism.

14. The lightweight ballistic armor system according to claim 1 wherein said system has a weight in a range of about 6-15 psf.

15. The lightweight ballistic armor system according to claim 1, wherein said system has a weight in a range of about 7-12 psf.

16. The lightweight ballistic armor system according to claim 1, wherein said laminate composite backing material further comprises a layer of high tensile strength material adjacent to said cross-sectional composition and forming at least a portion of said cross-sectional composition.

17. The lightweight ballistic armor system according to claim 16, wherein said layer of high tensile strength material is a high tensile strength polymer board having a thickness in the range of about 1/16 inch-4 inches.

18. The lightweight ballistic armor system according to claim 1, wherein said backing material of fibers comprises a plurality of layers of ballistic grade UHMWPE tape.

19. The lightweight ballistic armor system according to claim 1, further comprising an optional protective layer selected from the group of materials consisting of a polymer and a metal secured onto at least one surface of said ballistic armor system.

20. The lightweight ballistic armor system according to claim 19, wherein said polymer is polypropylene and wherein said metal is selected from the group consisting of aluminum and titanium and alloys thereof.

21. The lightweight ballistic armor system according to claim 19, further comprising a frame secured or bonded around said optional protective layer for reinforcing said optional protective layer onto said lightweight ballistic armor system.

22. The lightweight ballistic armor system according to claim 19, wherein said optional protective layer is one selected from the group consisting of a wrap for encasing said composite backing layer and a wrap for encasing said composite backing layer combined with said plurality of metal strike face plates.

23. The lightweight ballistic armor system according to claim 19, wherein at least one of the fibers or composite material optionally wrap said at least one of perforated metal strike face plates.

24. The lightweight ballistic armor system according to claim 1, wherein said lightweight ballistic armor system at least meets the appropriate weight specifications, said appropriate weight specifications and requirements being at least one selected from the group consisting of specifications and requirements for defeating ammunition from small arms, heavy machine guns, improvised explosive devices (IEDs), ammunition in the caliber range of about 5-15 mm and IED type weapons simulated in testing by fragment simulating projectiles (FSP) in calibers of 22-caliber up to 20 mm in diameter.

25. The lightweight ballistic armor system according to claim 11, wherein said laminate composite backing material comprises a thickness in the range of about 0.5 to 3 inches.

26. The system according to claim 1, wherein said system is applied to a system selected from a group consisting of a semi-trailer, a trailer system, a shipping container and a missile canister.

27. The lightweight ballistic armor system according to claim 1, wherein said at least two metal strike face plates and said at least one laminate composite backing material comprises multiple strike face plate layers and/or multiple laminate composite backing material layers, and wherein the plurality of holes of each strike face plate layer of said multiple strike face plate layers is offset in relation to the plurality of holes of a corresponding adjacent strike face plate layer.

28. A lightweight ballistic armor system for protection against projectiles consisting of:

a metal strike face plate having a predetermined defined thickness and comprising a plurality of slotted holes set at an angle relative to the vertical orientation of said metal strike face plate, said plurality of holes being sufficiently small to prevent the passage of a projectile therethrough;

a laminate composite backing material secured to said metal strike face plate, wherein said laminate composite backing material comprises a cross-sectional composition of a backing material of fibers being at least one material selected from the group comprising aramid fiber, S-glass, E-glass and UHMWPE, and being in combination with a polymer resin-based binder material;

an environmentally insensitive layer comprising a polymer or metal applied directly onto at least one surface of said laminate composite backing material; and wherein said system has a weight in the range of about 4-15 psf, wherein said metal strike face plate includes a proximate metal strike face plate that is proximate to said laminate composite backing material, said proximate metal strike face plate and said composite backing material being either adjacent and having no distance therebetween or being separated by a space to define a distance therebetween, wherein said space comprises a distance in a range between about 1/4 to about 4 inches, and wherein said lightweight ballistic armor system at least meets the appropriate military ballistic specifications and test requirements for the test of defeating the threat defined in STANAG 4241 by stopping three (3) 50-caliber bullets shot at a velocity of 850±20 m/s within a 5 cm diameter area and shot in a time interval of 1/10 second apart.

29. The system according to claim 28, wherein said system is secured to or attached to a corresponding canister for insensitive munitions.

30. The system according to claim 28, wherein said system structurally comprises a canister for insensitive munitions.

31. A lightweight ballistic armor system for protection against projectiles consisting of:

at least one metal strike face plate in the range of 1-3 metal strike face plates and having a predetermined defined thickness and comprising a plurality of slotted holes, said holes being sufficiently small to prevent the passage of a projectile therethrough;

at least one laminate composite backing material secured to at least one of said metal strike face plates, wherein said laminate composite backing material comprises a cross-sectional composition of a backing material of fibers being at least one material selected from the group comprising aramid fiber, S-glass, E-glass and UHMWPE, and being in combination with a polymer resin-based binder material;

an environmentally insensitive layer comprising a polymer or metal applied directly onto at least one surface of said at least one laminate composite backing material; and wherein said system has a weight in the range of about 4-15 psf, wherein said at least one of said metal strike face plates that is secured to said at least one laminate composite backing material includes a proximate metal strike face plate that is proximate to said laminate composite backing material, said proximate metal strike face plate and said composite backing material being separated by a space to define a distance therebetween, wherein said space comprises a distance in a range between about ¼ to about 4 inches, wherein said lightweight ballistic armor system at least meets the appropriate military requirements for the test of defeating the threat defined in STANAG 4241 by stopping three (3) 50-caliber bullets shot at a velocity of 850±20 m/s within a 5 cm diameter area and shot in a time interval of 1/10 second apart; and wherein one metal strike face plate of said plurality of metal strike face plates and one laminate composite backing of said at least one laminate composite backing material are secured together by a mechanical threaded securing mechanism.

32. A lightweight ballistic armor system for protection against insensitive munition projectiles consisting of:

at least one metal strike face plate in the range of 1-3 metal strike face plates and having a predetermined defined thickness and comprising a plurality of slotted holes, said holes being sufficiently small to prevent the passage of a projectile therethrough;

at least one laminate composite backing material secured to at least one of said metal strike face plates, wherein said laminate composite backing material comprises a cross-sectional composition of a backing material of fibers being at least one material selected from the group comprising aramid fiber, S-glass, E-glass and UHMWPE, and being in combination with a polymer resin-based binder material;

an environmentally insensitive layer comprising a polymer or metal applied directly onto at least one surface of said at least one laminate composite backing material; and wherein said system has a weight in the range of about 4-15 psf, wherein said at least one of said metal strike face plates that is secured to said at least one laminate composite backing material includes a proximate metal strike face plate that is proximate to said laminate composite backing material, said proximate metal strike face plate and said composite backing material being separated by a space to define a distance therebetween, wherein said space comprises a distance in a range between about ¼ to about 4 inches, and wherein said lightweight ballistic armor system at least meets the appropriate military ballistic specifications and test requirements for defeating, decelerating or slowing projectiles sufficiently to cause a Type V or Type VI reaction.

33. The system of claim 32, wherein said system has a weight in a range of about 6-15 psf.

34. The system of claim 32, wherein said metal strike face plates comprise at least one material selected from the group consisting of steel, perforated hardened steel, steel alloys, aluminum, magnesium and titanium.

35. The system of claim 34, wherein said metal strike face plates comprise a ductile cast iron material.

36. The system of claim 32, wherein said metal strike face plates comprise a total thickness in the range from about 0.10 inch-1.5 inches each.

37. The system of claim 36, wherein said metal strike face plates comprise a thickness in the range from about 0.15 inch to 0.65 inch each.

38. The system of claim 37, wherein said metal strike face plates comprise a thickness in the range from about 0.25 inch to 0.50 inch each.

39. The system according to claim 32, wherein said laminate composite backing material comprises a cross-sectional composition of a backing material of fibers selected from the group consisting of aramid fiber, S-glass, E-glass, polypropylene, and UHMWPE, and being in combination with a polymer resin-based binder material selected from the group consisting of silicones, epoxies, urethanes, polyethylenes, polyurethanes and polyureas.

40. The system of claim 32, further comprising an energy-absorbing foam, wherein the proximate metal strike face plate and said composite backing material are separated by said energy-absorbing foam for filling said distance, wherein said energy-absorbing foam is a low density foam selected from a group consisting of a polyurethane-based foam and a polypropylene-based foam.

41. The system of claim 32, further comprising an additional protective layer selected from a group consisting of a polymer, a composite layer and a metal skin layer for covering the front face of either or both of said at least two metal strike face plates, wherein said additional protective layer comprises a material being the same as or different from the material of said metal strike face plate and having a thickness in the range from about 1/32 inch to about ¼ inch.

42. The system of claim 32, wherein said plurality of slotted holes are set at an angle of up to about 35° relative to the vertical orientation of either or both of said two or more metal strike face plates.

43. The system of claim 32, wherein said laminate composite backing material comprises a thickness in the range of about 0.1 to 4 inches.

44. The system of claim 43, wherein said laminate composite backing material comprises a thickness of about 0.1 to 2 inches.

45. The system of claim 32, wherein said metal strike face plates and said laminate composite backing material are secured together by a mechanical threaded securing mechanism.

46. The system of claim 33, wherein said system has a weight in a range of about 7-12 psf.

47. The system of claim 32, wherein said system has a weight in the range of about 3-8 psf.

48. The system of claim 47, wherein said system has a weight in the range of about 4-6 psf.

49. The system of claim 32, wherein said system has a weight in the range of about 4.0-7.7 psf.

50. The system of claim 49, wherein said system has a weight of about 4.0 to 6.2 psf.

51. The system of claim 32, wherein said laminate composite backing material further comprises a layer of high tensile strength material adjacent to said cross-sectional composition and forming at least a portion of said cross-sectional composition.

52. The system of claim 51, wherein said layer of high tensile strength material is a high tensile strength polymer board having a thickness in the range of about 1/16 inch-4 inches.

53. The system of claim 32, wherein said backing material of fibers comprise a plurality of layers of ballistic grade UHMWPE tape.

54. The system of claim 32, further comprising an optional protective layer selected from a group of materials consisting of a polymer and a metal secured onto at least one surface of said ballistic armor system.

55. The system of claim 54, wherein said polymer is polypropylene and wherein said metal is selected from a group consisting of aluminum and titanium and alloys thereof.

56. The system of claim 54, further comprising a frame secured or bonded around said optional protective layer for reinforcing said optional protective layer onto said lightweight ballistic armor system.

57. The system of claim 54, wherein said optional protective layer is one selected from a group consisting of a wrap for encasing said composite backing layer and a wrap for encasing said composite backing layer combined with said plurality of metal strike face plates.

58. The system of claim 54, wherein at least one of the fibers or composite material optionally wrap said at least one of perforated metal strike face plates.

59. The system of claim 32, wherein said lightweight ballistic armor system at least meets the appropriate weight specifications, said appropriate weight specifications and requirements being at least one selected from a group consisting of specifications and requirements for defeating ammunition from small arms, heavy machine guns, improvised explosive devices (IEDs), ammunition in the caliber range of about 5-15 mm and TED type weapons simulated in testing by fragment simulating projectiles (FSP) in calibers of 22-caliber up to 20 mm in diameter.

60. The system of claim 43, wherein said laminate composite backing material comprises a thickness in the range of about 0.5 to 3 inches.

61. The system of claim 32, wherein said armored structure system is applied to a structure system selected from the group consisting of a semi-trailer, a trailer system, a shipping container and a missile canister.

62. The system of claim 32, wherein said at least two metal strike face plates and said at least one laminate composite backing material comprise multiple strike face plate layers and/or multiple laminate composite backing material layers, and wherein the plurality of holes of each strike face plate layer of said multiple strike face plate layers are offset in relation to the plurality of holes of a corresponding adjacent strike face plate layer.

63. The system of claim 32, wherein said system is secured to or attached to a corresponding canister for insensitive munitions.

64. The system according to claim 32, wherein said system structurally comprises a canister for insensitive munitions.

65. The system according to claim 32, wherein said system is applied to an armored structure system selected from the group consisting of an armored semi-trailer, an armored trailer system, an armored shipping container and an armored missile canister.

66. The system according to claim 32, wherein said system is secured to or attached to a corresponding canister for insensitive munitions.

67. The system according to claim 32, wherein said system structurally comprises a canister for insensitive munitions.

* * * * *